US010990032B2

(12) United States Patent
Sakaguchi et al.

(10) Patent No.: US 10,990,032 B2
(45) Date of Patent: Apr. 27, 2021

(54) IMAGE-FORMING APPARATUS CAPABLE OF CONTROLLING SEPARATION/CONTACT TIMING BETWEEN DEVELOPING ROLLERS AND PHOTOSENSITIVE DRUMS IN TIMED RELATION TO SHEET CONVEYANCE

(71) Applicant: BROTHER KOGYO KABUSHIKI KAISHA, Nagoya (JP)

(72) Inventors: Shintaro Sakaguchi, Nagoya (JP); Toshiyuki Sano, Aichi-ken (JP); Masahito Saeki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/819,703

(22) Filed: Mar. 16, 2020

(65) Prior Publication Data

US 2020/0333727 A1 Oct. 22, 2020

(30) Foreign Application Priority Data

Apr. 18, 2019 (JP) ..... JP2019-079312

(51) Int. Cl.

| | |
|---|---|
| ***G03G 15/08*** | (2006.01) |
| ***G03G 15/00*** | (2006.01) |
| ***G03G 21/16*** | (2006.01) |
| ***G03G 21/18*** | (2006.01) |

(52) U.S. Cl.

CPC ..... *G03G 15/0813* (2013.01); *G03G 15/0808* (2013.01); *G03G 15/607* (2013.01); *G03G 15/6508* (2013.01); *G03G 15/6558* (2013.01); *G03G 21/1647* (2013.01); *G03G 21/1857* (2013.01); *G03G 2215/00409* (2013.01);

(Continued)

(58) Field of Classification Search

CPC ..... G03G 2215/0617

See application file for complete search history.

(56) References Cited

U.S. PATENT DOCUMENTS

2001/0028806 A1* 10/2001 Makino ..... G03G 15/0887 399/53
2005/0220464 A1* 10/2005 Kobayashi ..... G03G 15/0882 399/27
2013/0108290 A1* 5/2013 Funatani ..... G03G 15/0813 399/43

FOREIGN PATENT DOCUMENTS

JP 2012-128017 A 7/2012

* cited by examiner

*Primary Examiner* — Sevan A Aydin

(74) *Attorney, Agent, or Firm* — Scully, Scott, Murphy & Presser, PC

(57) ABSTRACT

An image-forming apparatus includes a photosensitive drum, a developing roller, a cam, a switching mechanism, a sheet tray, a sheet feed mechanism, a sheet sensor, and a controller. The switching mechanism rotates the cam to move the developing roller from a contact position in contact with the photosensitive drum to a separated position away from the photosensitive drum after development for the first sheet, if feeding of a second sheet is not started after elapse of a prescribed time period since detection of a first sheet. If image data for the second sheet is ready and upon elapse of a predetermined standby time period from elapse of the prescribed time period, the sheet feed mechanism starts feeding the second sheet toward the photosensitive drum and the switching mechanism rotates the cam to move the developing roller to the separated position in accordance with conveyance of the second sheet.

10 Claims, 28 Drawing Sheets

(52) U.S. Cl.
CPC ..... *G03G 2215/00603* (2013.01); *G03G 2215/00721* (2013.01); *G03G 2221/1657* (2013.01)

IMAGE-FORMING APPARATUS CAPABLE OF CONTROLLING SEPARATION/CONTACT TIMING BETWEEN DEVELOPING ROLLERS AND PHOTOSENSITIVE DRUMS IN TIMED RELATION TO SHEET CONVEYANCE

CROSS REFERENCE TO RELATED APPLICATION

This application claims priority from Japanese Patent Application No. 2019-079312 filed Apr. 18, 2019. The entire content of the priority application is incorporated herein by reference.

TECHNICAL FIELD

The present disclosure relates to an electrophotographic image-forming apparatus including a photosensitive drum and a developing roller.

BACKGROUND

Japanese Patent Application Publication No. 2012-128017 discloses an electrophotographic image-forming apparatus including a mechanism for moving a developing roller toward and away from a photosensitive drum to contact and separate from the photosensitive drum in accordance with a rotation of a cam.

SUMMARY

In a case where a period of contact between the developing roller and the photosensitive drum is needlessly prolonged, toner may be adhered to the developing roller and the photosensitive drum, and service life of the developing roller may be shortened. Hence, preferably, the period of contact between the developing roller and the photosensitive drum is as short as possible.

In view of the foregoing, it is an object of the present disclosure to provide an image-forming apparatus capable of minimizing a period of contact between a developing roller and a photosensitive drum.

In order to attain the above and other objects, according to one aspect, the disclosure provides an image-forming apparatus including a photosensitive drum, a developing roller, a cam, a switching mechanism, at least one sheet tray, a sheet feed mechanism, a sheet sensor, and a controller. The developing roller is rotatable about an axis extending in an axial direction and is movable between a contact position in contact with the photosensitive drum and a separated position away from the photosensitive drum. The cam is rotatable to move the developing roller between the contact position and the separated position. The switching mechanism is configured to control the rotation of the cam. The at least one sheet tray is configured to accommodate a plurality of sheets including a first sheet and a second sheet. The sheet feed mechanism is configured to feed each of the sheets from the at least one sheet tray toward the photosensitive drum in a sheet conveying direction. The sheet sensor is positioned upstream of the photosensitive drum in the sheet conveying direction and is configured to detect passage of each sheet therethrough. The controller is configured to provide control to the switching mechanism and the sheet feed mechanism. In a case where conveyance of the second sheet is not started upon elapse of a prescribed period of time from a timing when the sheet sensor detects a trailing edge of the first sheet, the controller is configured to control the switching mechanism to rotate the cam to move the developing roller from the contact position to the separated position after development of a first image to be transferred to the first sheet is completed. In a case where data of a second image to be transferred to the second sheet is ready and a predetermined standby time period has elapsed from elapse of the prescribed period of time, the controller is configured to control the sheet feed mechanism to start feeding the second sheet toward the photosensitive drum and subsequently control the switching mechanism to rotate the cam to move the developing roller from the separated position to the contact position in accordance with conveyance of the second sheet for development of the second image on the photosensitive drum.

According to another aspect, the disclosure provides an image-forming apparatus including a photosensitive drum, a developing roller, a rotatable cam, a sheet tray, a sheet feed mechanism, and a controller. The developing roller is movable between: a contact position where the developing roller is in contact with the photosensitive drum; and a separated position where the developing roller is separated from the photosensitive drum. The rotatable cam is configured to move the developing roller between the contact position and the separated position. The sheet tray is configured to accommodate a first sheet and a second sheet. The sheet feed mechanism is configured to feed each of the first sheet and the second sheet from the sheet tray to the photosensitive drum along a sheet feeding path. The controller is configured to control the rotatable cam and the sheet feed mechanism. In a case where feeding of the second sheet is not started upon elapse of a prescribed period of time from a timing when the sheet sensor detects a trailing edge of the first sheet, the controller is configured to rotate the rotatable cam to move the developing roller from the contact position to the separated position after development of a first image to be transferred to the first sheet is completed. In a case where data of a second image to be transferred to the second sheet is ready and a predetermined standby time period) has elapsed from elapse of the prescribed period of time, the controller is configured to control the sheet feed mechanism to start feeding the second sheet toward the photosensitive drum and subsequently rotate the rotatable cam to move the developing roller from the separated position to the contact position in accordance with conveyance of the second sheet for development of the second image on the photosensitive drum.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

An image-forming apparatus 1 according to one embodiment of the disclosure will be described with reference to the accompanying drawings. The image-forming apparatus 1 of the present embodiment is a color printer.

In the following description, directions with respect to the image-forming apparatus 1 will be referred to assuming that the image-forming apparatus 1 is disposed in an orientation in which it is intended to be used. Specifically, a left side, a right side, an upper side, and a lower side in FIG. 1 will be referred to as a front side, a rear side, an upper side, and a lower side of the image-forming apparatus 1, respectively. Further, a near side and a far side in FIG. 1 will be referred to as a right side and a left side, respectively.

<Overall Structure of Image-Forming Apparatus 1>

Figure 1:
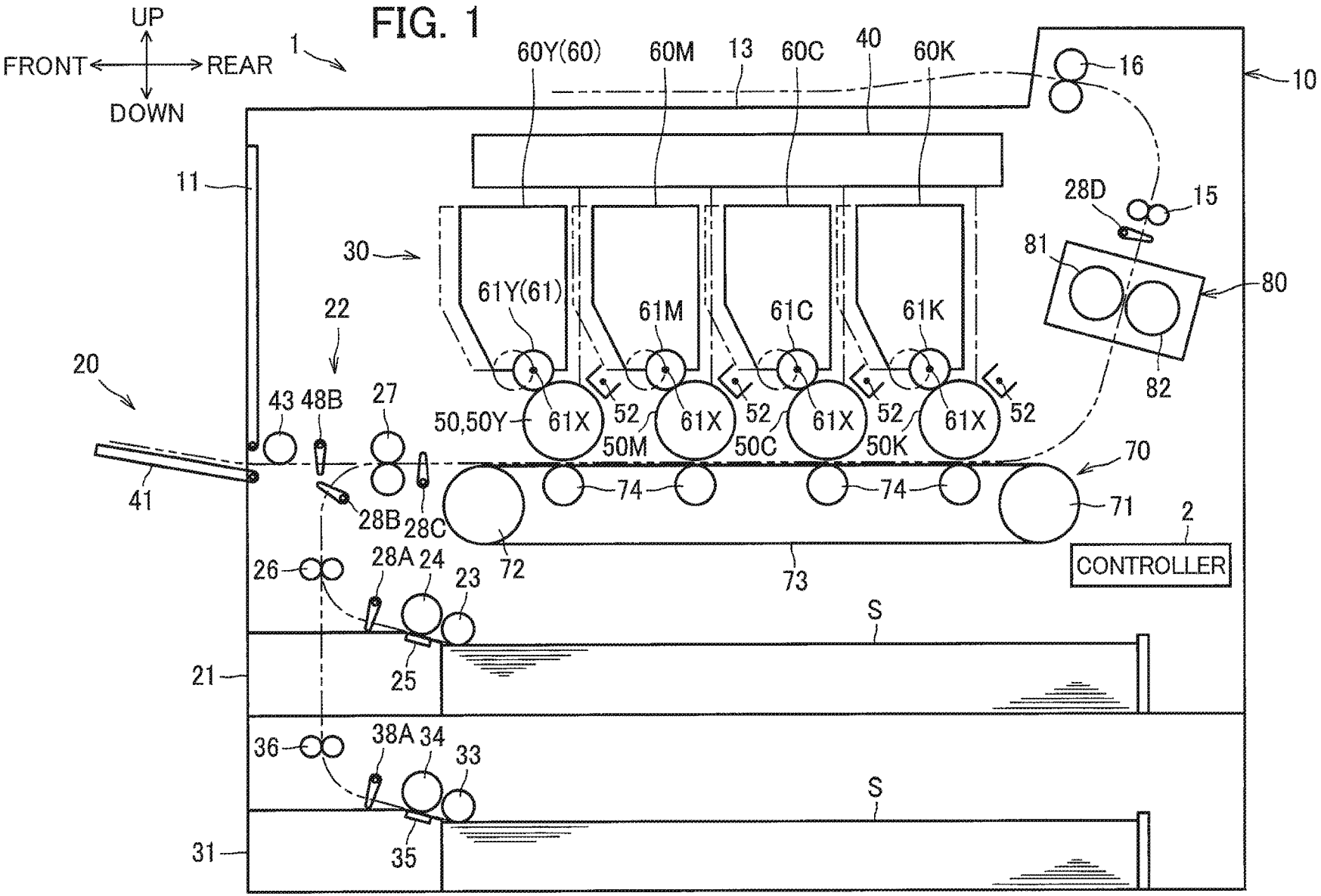
FIG. 1 is a schematic view illustrating an overall configuration of an image-forming apparatus according to an embodiment.

Referring to FIG. 1, the image-forming apparatus 1 includes a housing 10 within which a sheet feed unit 20, an image-forming unit 30, a motor 3 (FIGS. 7 and 9) as a drive source, and a controller 2 are positioned.

The housing 10 is formed with a front opening, and includes a front cover 11 for opening and closing the front opening. Further, the housing 10 has an upper surface functioning as a discharge tray 13.

The sheet feed unit 20 is positioned at a lower internal portion of the housing 10. The sheet feed unit 20 includes a plurality of sheet trays for accommodating sheets S, and a sheet feed mechanism 22. The plurality of sheet trays includes: a first tray 21, a second tray 31, and a manual insertion tray 41. The sheet feed mechanism 22 is configured to supply sheets S from the respective trays 21, 31 and 41 toward the image-forming unit 30 (including photosensitive drums 50). The first tray 21 and the second tray 31 are detachable from the housing 10 through the front opening by pulling the trays frontward (leftward in FIG. 1). The first tray 21 and the second tray 31 are positioned at the lower internal portion of the housing 10. The second tray 31 is an additional sheet tray positioned below the first tray 21. The manual insertion tray 41 is positioned higher than the first tray 21, and frontward of the image-forming unit 30.

Lengths of sheet conveying paths indicated by two dotted chain lines from a photosensitive drum 50Y to each of the trays 21, 31 and 41 are different from one another. Specifically, the length of the sheet conveying path from the photosensitive drum 50Y to the second tray 31 is greater than the length of the sheet conveying path from the photosensitive drum 50Y to the first tray 21. Further, the path length from the photosensitive drum 50Y to the manual insertion tray 41 is shorter than the path length from the photosensitive drum 50Y to the first tray 21.

Hereinafter, each direction in which the sheet S is configured to be conveyed inside the housing 10 from the respective trays 21, 31 and 41 (depicted in phantom lines in FIG. 1) will be defined as a sheet conveying direction.

The sheet feed mechanism 22 is positioned at a front internal portion of the housing 10. The sheet feed mechanism 22 includes sheet feed rollers 23, 33 and 43, separation rollers 24 and 34, separation pads 25 and 35, conveyer rollers 26 and 36, and a pair of registration rollers 27 for supplying the sheets S toward the photosensitive drums 50. The registration rollers 27 are closest to the photosensitive drum 50Y in the sheet conveying direction among those rollers positioned upstream of the photosensitive drum 50Y in the sheet conveying direction.

Incidentally, in the present disclosure, the sheet S is an example of an image-forming medium on which an image can be formed by the image-forming apparatus 1. For example, plain paper, an envelope, a post card, thin paper, thick paper, calendered paper, a resin sheet, and a seal are available as the sheet S.

In the sheet feed unit 20, the sheets S accommodated in the first tray 21 are configured to be fed by the sheet feed roller 23, and then separated one by one by the separation roller 24 and the separation pad 25. Likewise, the sheets S accommodated in the second tray 31 are configured to be fed by the sheet feed roller 33, and then separated one by one by the separation roller 34 and the separation pad 35. The sheets S accommodated in the manual insertion tray 41 are configured to be fed by the sheet feed roller 43. Subsequently, a position of a leading edge of each sheet S (fed from respective trays 21, 31, 41) is configured to be regulated by the registration rollers 27 whose rotation is halted, and the sheet S is then configured to be supplied to the image-forming unit 30 by the rotations of the registration rollers 27.

Further, a plurality of sheet sensors is provided upstream of the photosensitive drum 50Y in the sheet conveying direction each for detecting passage of the sheet S therethrough. Specifically, these sheet sensors include sheet feed sensors 28A and 38A, front sensors 28B and 48B, and a back sensor 28C.

The front sensor 28B is positioned downstream of the sheet feed sensors 28A and 38A but upstream of the registration rollers 27 in the sheet conveying direction. Specifically, the front sensor 28B is positioned between the conveyer rollers 26 and registration rollers 27 in the sheet conveying direction. The front sensor 48B is positioned upstream of the registration rollers 27 in the sheet conveying direction. Specifically, the front sensor 48B is positioned between the manual insertion tray 41 (the sheet feed roller 43) and the registration rollers 27 in the sheet conveying direction.

The back sensor 28C is positioned downstream of the registration rollers 27 and upstream of the photosensitive drum 50Y, i.e., between the registration rollers 27 and the photosensitive drum 50Y in the sheet conveying direction. The sheet feed sensor 28A is configured to initially detect the passage of the sheet S fed from the first tray 21. The sheet feed sensor 28A is positioned between the separation roller 24 and the conveyer rollers 26 in the sheet conveying direction. The sheet feed sensor 38A is configured to initially detect the transit of the sheet S fed from the second tray 31, and is positioned between the separation roller 34 and the conveyer rollers 36 in the sheet conveying direction.

The image-forming unit 30 includes an exposure device 40, a plurality of photosensitive drums 50, a plurality of developing cartridges 60, a conveying device 70, and a fixing device 80.

The exposure device 40 includes a laser diode, a deflector, lenses, and mirrors those not illustrated. The exposure device 40 is configured to emit laser beams to expose surfaces of the respective photosensitive drums 50 and to scan the surfaces.

The photosensitive drums 50 include: a first photosensitive drum 50Y for a first color of yellow; a second photosensitive drum 50M for a second color of magenta; a third photosensitive drum 50C for a third color of cyan; and a fourth photosensitive drum 50K for a fourth color of black. Throughout the specification and drawings, in a case where colors must be specified, members or components corresponding to the colors of yellow, magenta, cyan and black are designated by adding "Y", "M", "C", "K", respectively. On the other hand, in a case where distinction of colors is unnecessary, the addition of "Y", "M", "C", "K" is omitted and naming of "first" through "fourth" is also omitted.

Four of the developing cartridges 60 are provided in one-to-one correspondence with the four photosensitive drums 50. Specifically, the developing cartridges 60 include: a first developing cartridge 60Y including a first developing roller 61Y for supplying toner of the first color (yellow) to the first photosensitive drum 50Y; a second developing cartridge 60M including a second developing roller 61M for supplying toner of the second color (magenta) to the second photosensitive drum 50M; a third developing cartridge 60C including a third developing roller 61C for supplying toner of the third color (cyan) to the third photosensitive drum 50C; and a fourth developing cartridge 60K including a fourth developing roller 61K for supplying toner of the fourth color (black) to the fourth photosensitive drum 50K.

The first developing roller 61Y, the second developing roller 61M, the third developing roller 61C, and the fourth developing roller 61K are arranged in line in this order toward downstream in the sheet conveying direction.

Each developing cartridge 60 is movable between a contact position where the developing roller 61 is in contact with the corresponding photosensitive drum 50 (indicated by a solid line in FIG. 1) and a separated position where the developing roller 61 is separated from the corresponding photosensitive drum 50 (indicated by a dashed line in FIG. 1).

Further, in a state where the second developing roller 61M, the third developing roller 61C and the fourth developing roller 61K are respectively at their separated positions, each of the second developing cartridge 60M, the third developing cartridge 60C and the fourth developing cartridge 60K is overlapped with a path of the laser beam for irradiating the photosensitive drum 50 positioned immediately upstream thereof the in the sheet conveying direction.

Specifically, the second developing cartridge 60M is overlapped with the path of the laser beam directing to the first photosensitive drum 50Y when the second developing roller 61M is at the separated position. Likewise, the third developing cartridge 60C is overlapped with the path of the laser beam directing to the second photosensitive drum 50M when the third developing roller 61C is at the separated position; and the fourth developing cartridge 60K is overlapped with the path of the laser beam directing to the third photosensitive drum 50C when the fourth developing roller 61K is at the separated position.

Figure 2:
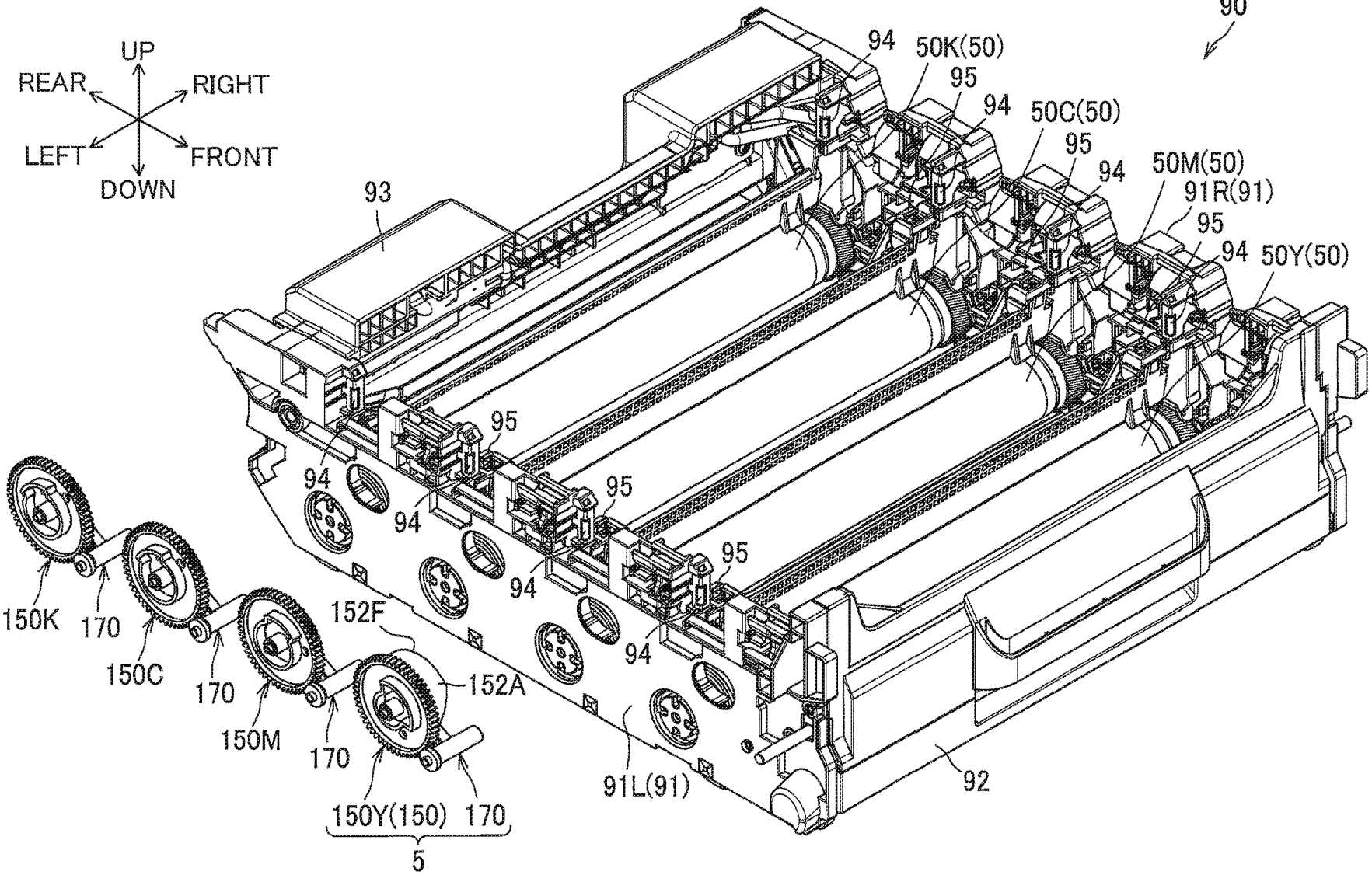
FIG. 2 is a perspective view of a support member, cams, and cam followers in the image-forming apparatus according to the embodiment.

As illustrated in FIG. 2, the photosensitive drums 50 are rotatably supported by a support member 90. Further, the support member 90 detachably supports the first developing cartridge 60Y, the second developing cartridge 60M, the third developing cartridge 60C, and the fourth developing cartridge 60K. The support member 90 is attachable to and detachable from the housing 10 through the front opening when the front cover 11 is opened. Detailed structures of the support member 90 and developing cartridges 60 will be described later.

Turning back to FIG. 1, the conveying device 70 is positioned between the first tray 21 and the photosensitive drums 50 in the upward/downward direction. The conveying device 70 includes a drive roller 71, a driven roller 72, an endless belt as a conveyer belt 73, and four transfer rollers 74. The conveyer belt 73 is mounted over the drive roller 71 and the driven roller 72 under tension, and has an outer peripheral surface facing each of the photosensitive drums 50. Each transfer roller 74 is positioned within a loop of the conveyer belt 73 to nip the conveyer bel 73 in cooperation with each photosensitive drum 50. The sheet S is configured to be conveyed as the conveyer belt 73 circulates while the sheet S is mounted on an upper portion of the outer peripheral surface of the conveyer belt 73, and at the same time, each toner image formed on each photosensitive drum 50 is transferred onto the sheet S, sequentially.

The fixing device 80 is positioned rearward of the photosensitive drum 50K and the conveying device 70. The fixing device 80 includes a heat roller 81 and a pressure roller 82 positioned in confrontation with the heat roller 81. A sheet discharge sensor 28D is positioned downstream of the fixing device 80 in the sheet conveying direction to detect that the sheet S moves past the sensor 28D. A pair of conveyer rollers 15 is positioned above the fixing device 80, and a pair of discharge rollers 16 is positioned above the conveyer rollers 15.

In the image-forming unit 30, a peripheral surface of each photosensitive drum 50 is uniformly charged by the corresponding charger 52, and is then exposed to light by the laser beam irradiated from the exposure device 40. Thus, an electrostatic latent image on a basis of image data is formed on the peripheral surface of each photosensitive drum 50.

Further, toner accommodated in each developing cartridge 60 is carried on a peripheral surface of each developing roller 61, and is then supplied from each developing roller 61 to the peripheral surface of each photosensitive drum 50 when the developing roller 61 comes into contact with the corresponding photosensitive drum 50. Hence, a toner image is formed on the peripheral surface of each photosensitive drum 50.

Subsequently, each toner image formed on each photosensitive drum 50 is transferred onto the sheet S while the sheet S fed onto the conveyer belt 73 moves past positions between each photosensitive drum 50 and the corresponding transfer roller 74. Then, the toner image transferred onto the sheet S is thermally fixed to the sheet S while the sheet S passes a position between the heat roller 81 and the pressure roller 82.

The sheet S discharged from the fixing device 80 is then discharged onto the discharge tray 13 by the conveyer rollers 15 and the discharge rollers 16.

<Support Member 90, Developing Cartridges 60 and Separation Mechanisms 5>

Referring to FIG. 2, the support member 90 includes: a pair of side frames 91 positioned away from each other in an axial direction of each photosensitive drum 50; a front connection frame 92 connecting front end portions of the respective side frames 91; and a rear connection frame 93 connecting rear end portions of the respective side frames 91. The pair of side frames 91 includes a right side frame 91R and a left side frame 91L. Further, chargers 52 (FIG. 1) are provided in the support member 90. Each charger 52 is positioned to face corresponding one of the photosensitive drums 50 for charging the same.

Counterpart abutment portions 94 are provided four each on respective upper portions of the side frames 91R and 91L of the support member 90. The counterpart abutment portions 94 are configured to abut slide members 64 (FIG. 3A) described later. Each counterpart abutment portion 94 is in a form of a roller rotatable about an axis extending in an upward/downward direction. Here, the upward/downward direction may be defined as a third direction which is perpendicular to a first direction (leftward/rightward direction) in parallel to the axial direction of the photosensitive drum 50 and a second direction (frontward/rearward direction) in which the photosensitive drums 50 are juxtaposed.

The support member 90 also includes a plurality of pressure members 95 two each for corresponding one of the developing cartridges 60. For each developing cartridge 60, two of the pressure members 95 are positioned one each outward of the photosensitive drum 50 in the axial direction thereof. Each of the pressure members 95 is urged rearward by a spring 95A (FIGS. 4A and 4B). In accordance with the attachment of the developing cartridge 60 to the support portion 90, the pair of pressure members 95 presses against the corresponding developing cartridge 60 (specifically, protrusions 63D of the developing cartridge 60 (FIGS. 3A through 4D) as will be described later) by urging forces of the respective springs 95A, to permit the developing roller 61 to be in pressure contact with the corresponding photosensitive drum 50.

The image-forming apparatus 1 further includes four separation mechanisms 5 (FIG. 2) each for moving the corresponding developing roller 61 (first developing roller 61Y, the second developing roller 61M, the third developing roller 61C or the fourth developing roller 61K) between the contact position in contact with the corresponding photosensitive drum 50 and the separated position away from the corresponding photosensitive drum 50. Each separation mechanism 5 is provided for each of the first through fourth colors (yellow, magenta, cyan and black).

Specifically, each separation mechanism 5 includes: a cam 150 (150Y, 150M, 150C, 150K) rotatable about an axis parallel to an axis 61X (FIG. 1) of the corresponding developing roller 61; and a cam follower 170. The cam 150 is rotatable in a prescribed rotational direction upon receipt of a driving force from the motor 3. The cam 150 includes a first cam portion 152A protruding rightward, i.e., inward in a direction of the rotation axis 61X of the developing roller 61 (hereinafter simply referred to as "axial direction"). The first cam portion 152A has an end face (right end face) serving as a cam surface 152F.

The cam follower 170 is movable between an operating position (illustrated in FIG. 4B) in contact with the cam surface 152F for positioning the developing roller 61 at the separated position and a standby position (illustrated in FIG. 4A) for positioning the developing roller 61 at the contact position. The cam follower 170 is configured to be slidingly moved in the axial direction (rightward) to the operating position while being in contact with the cam surface 152F to apply a pressing force to the developing cartridge 60, thereby separating the developing roller 61 from the corresponding photosensitive drum 50. While the cam follower 170 is at the standby position, the cam follower 170 is separated from the corresponding developing cartridge 60.

Turning back to FIG. 2, each pair of the cam 150 and cam follower 170 are provided for each of the developing cartridges 60. Each pair of cam 150 and the cam follower 170 is positioned leftward of the left side frame 91L, i.e., outward of the left side frame 91L in a leftward/rightward direction. The cam 150 and the cam follower 170 will be described in detail later.

Figure 3A:
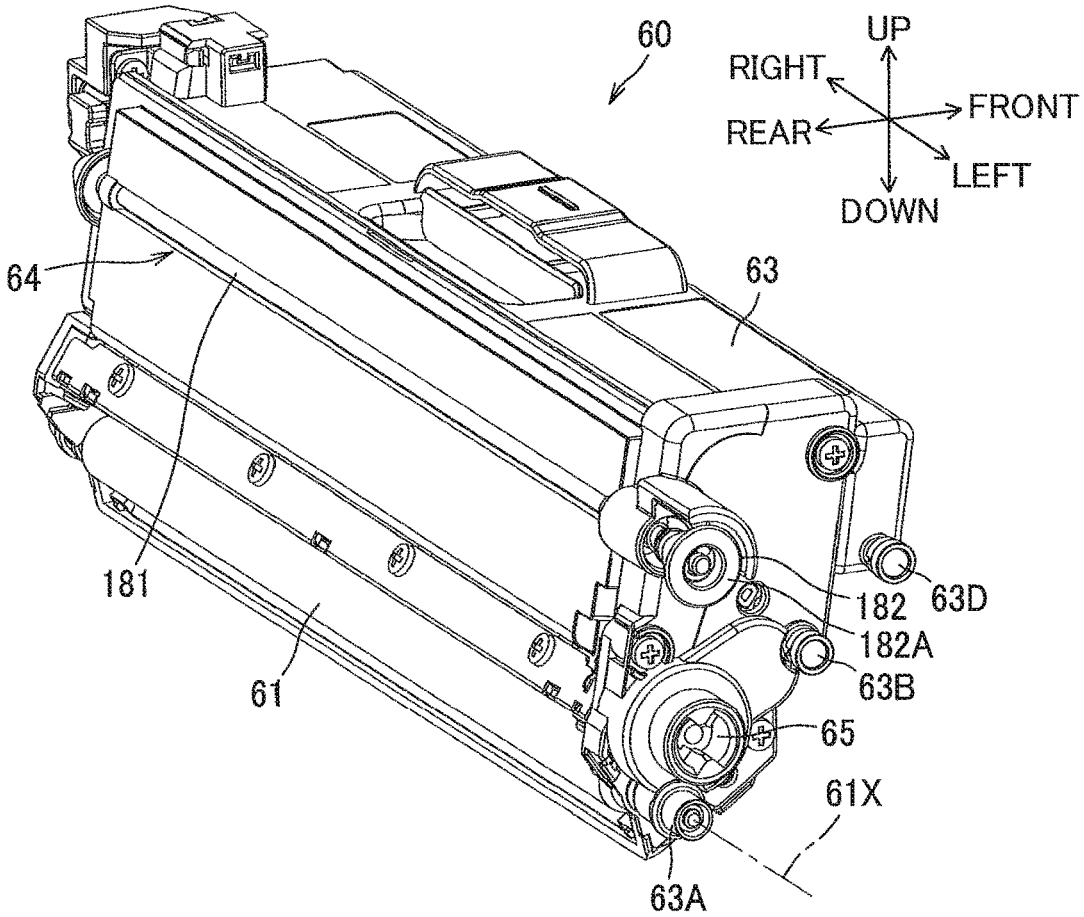
FIG. 3A is a perspective view of a developing cartridge to be accommodated in the image-forming apparatus according to the embodiment.
Figure 3B:
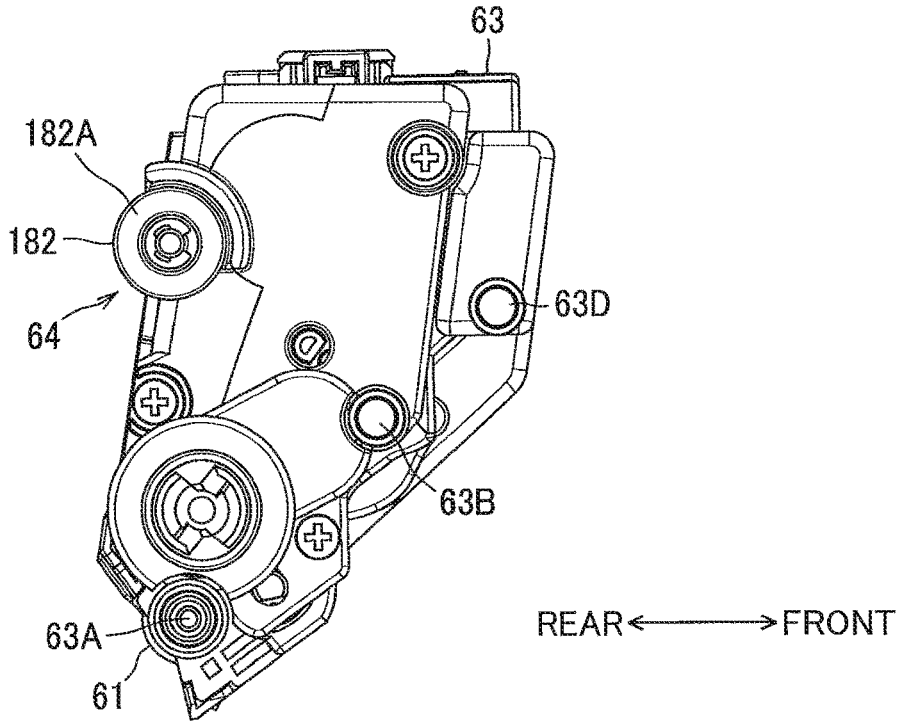
FIG. 3B is a side view of the developing cartridge of FIG. 3A.
Figure 4A:
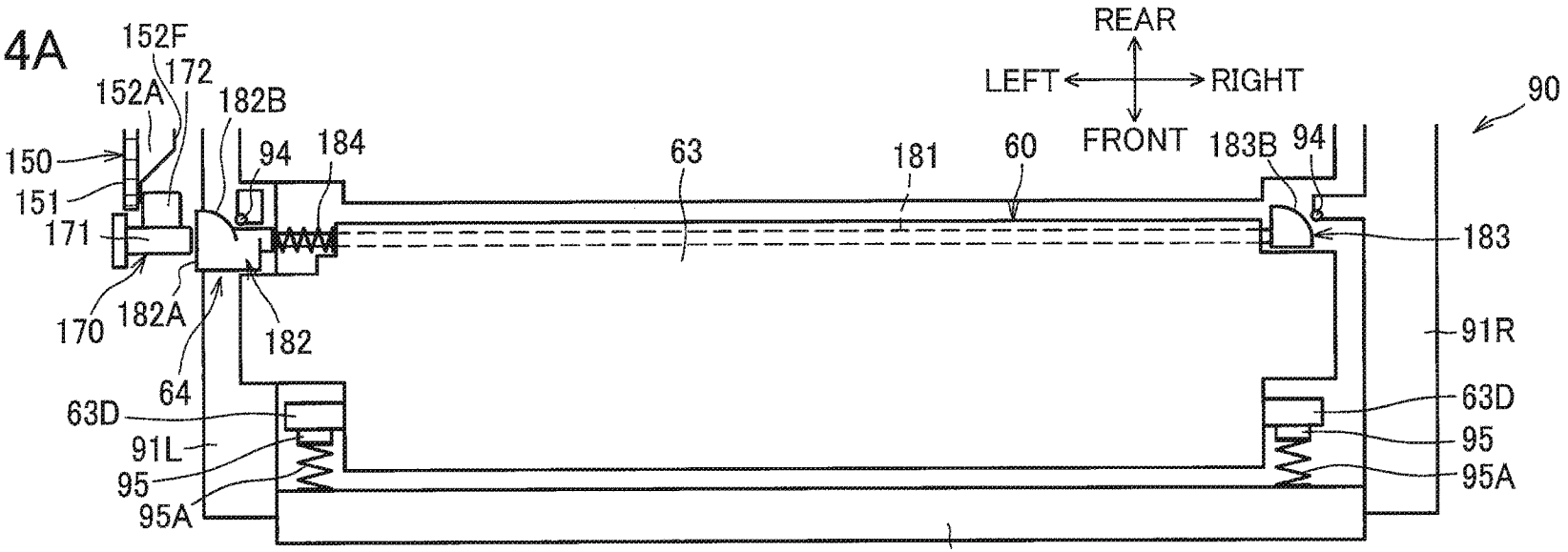
FIG. 4A is a schematic top view illustrating the developing cartridge and components in the vicinity thereof for description of a slide member of the developing cartridge, and particularly illustrating a state where the cam follower is at a standby position in the image-forming apparatus according to the embodiment.
Figure 4B:
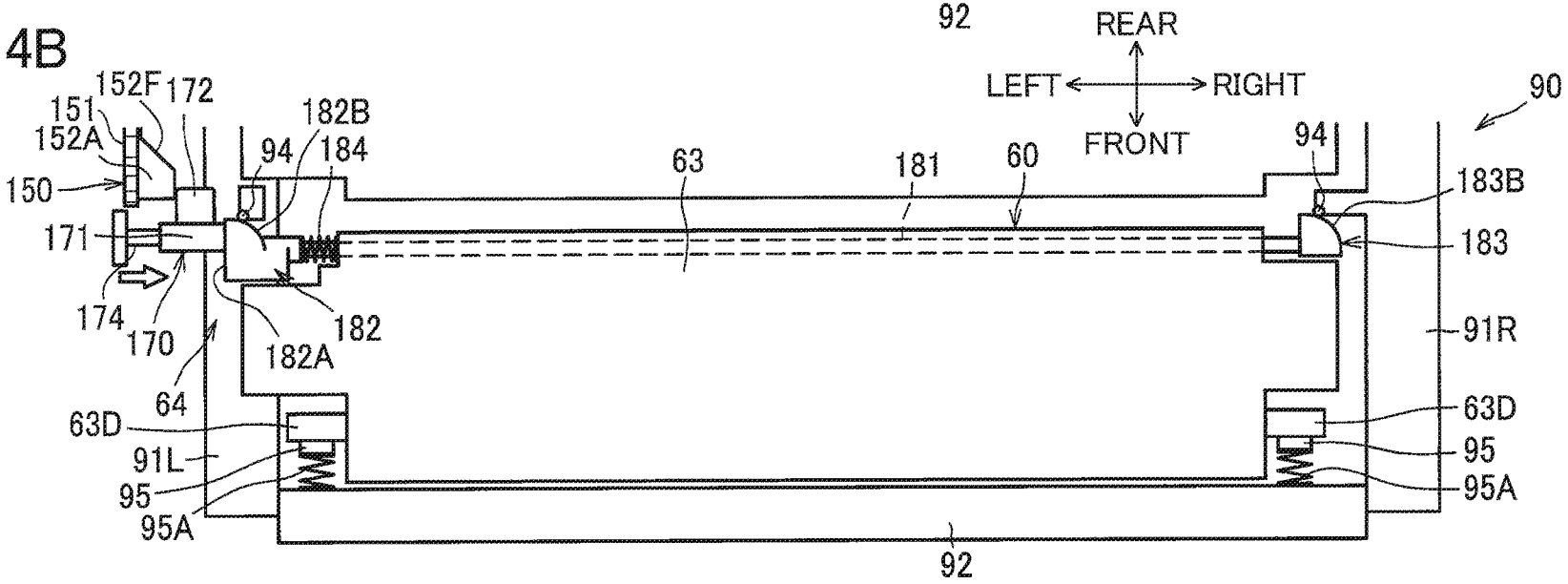
FIG. 4B is a schematic top view illustrating the developing cartridge and the components in the vicinity thereof for description of the slide member, and particularly illustrating a state where the cam follower is at an operating position in the image-forming apparatus according to the embodiment.

As illustrated in FIGS. 3A and 3B, each developing cartridge 60 (60Y, 60M, 60C, 60K) includes a casing 63, the slide member 64, and a coupling 65.

The casing 63 is configured to store toner of the corresponding color therein. The casing 63 has one side surface in the axial direction (left end surface) provided with a first protruding portion 63A and a second protruding portion 63B. the first and second protruding portions 63A and 63B protrude in the axial direction, or in the direction of the rotation axis 61X. The first protruding portion 63A is coaxial with the rotation axis 61X of the developing roller 61. The second protruding portion 63B is positioned away from the first protruding portion 63A by a predetermined distance. In the present embodiment, the second protruding portion 63B is positioned diagonally above the first protruding portion 63A. That is, the second protruding portion 63B is positioned higher than the first protruding portion 63A.

The first and second protruding portions 63A and 63B are provided as rollers rotatable about their axes extending in parallel to the axial direction of the rotation axis 61. Although not illustrated, the first and second protruding portions 63A and 63B are also provided at another side surface of the casing 63 in the axial direction (right end face) at positions symmetrical with the first and second protruding portions 63A and 63B provided at the one side surface (left end surface).

Further, the above-described protrusion 63D configured to be pressed by the pressure member 95 is positioned frontward of the first and second protruding portions 63A and 63B. The protrusion 63D protrudes outward in the axial direction from each side surface of the casing 63 in the axial direction.

The coupling 65 is configured to be engaged with a coupling shaft 119 of a power transmission mechanism 100 described later. Rotational driving force is configured to be inputted to the coupling 65 from the coupling shaft 119.

The slide member 64 is slidably movable in the axial direction relative to the casing 63 upon application of the pressing force from the corresponding cam follower 170. As illustrated in FIGS. 4A and 4B, the slide member 64 includes a shaft 181, a first abutment member 182 fixed to one end (left end) of the shaft 181, and a second abutment member 183 fixed to another end (right end) of the shaft 181. The casing 63 is formed with a hole extending in the axial direction. The shaft 181 extends through the hole and is slidably supported by the casing 63.

Referring to FIGS. 3A through 4B, the first abutment member 182 has a pressure receiving surface 182A and a sloped surface 182B. The pressure receiving surface 182A is a left end face of the first abutment member 182, that is, an end face thereof in the axial direction. The sloped surface 182B extends from the pressure receiving surface 182A to be sloped with respect to the axial direction. The pressure receiving surface 182A is configured to be pressed by the corresponding cam follower 170. When the slide member 64 is pressed in the axial direction by the cam follower 170, the sloped surface 182B is configured to abut against the corresponding counterpart abutment portion 94 of the support member 90 to urge the developing cartridge 60 in a direction perpendicular to the axial direction (frontward), i.e., in a direction parallel to the sheet conveying direction, thereby moving the developing cartridge 60 to the position as illustrated in FIG. 4B. The sloped surface 182B is sloped in a curved fashion to extend gradually frontward toward the right. That is, the sloped surface 182B is sloped in a direction from the photosensitive drum 50 toward the corresponding developing roller 61 (frontward) as extending in a direction from the one end (left end) to the other end (right end) of the shaft 181 in the axial direction.

The second abutment member 183 has a sloped surface 183B similar to the sloped surface 182B of the first abutment member 182. The second sloped surface 183B is configured to abut against the counterpart abutment portion 94 of the support member 90 when the slide member 64 is pressed in the axial direction by the corresponding cam follower 170, thereby urging the developing cartridge 60 in the sheet conveying direction to move the developing cartridge 60 to the position as illustrated in FIG. 4B.

A spring 184 is interposed between the first abutment member 182 and the casing 63 to urge the slide member 64 leftward, i.e., outward in the axial direction (in a direction from the other end (right end) to the one end (left end) of the shaft 181). The spring 184 is a compression spring disposed over the shaft 181.

Figure 5:
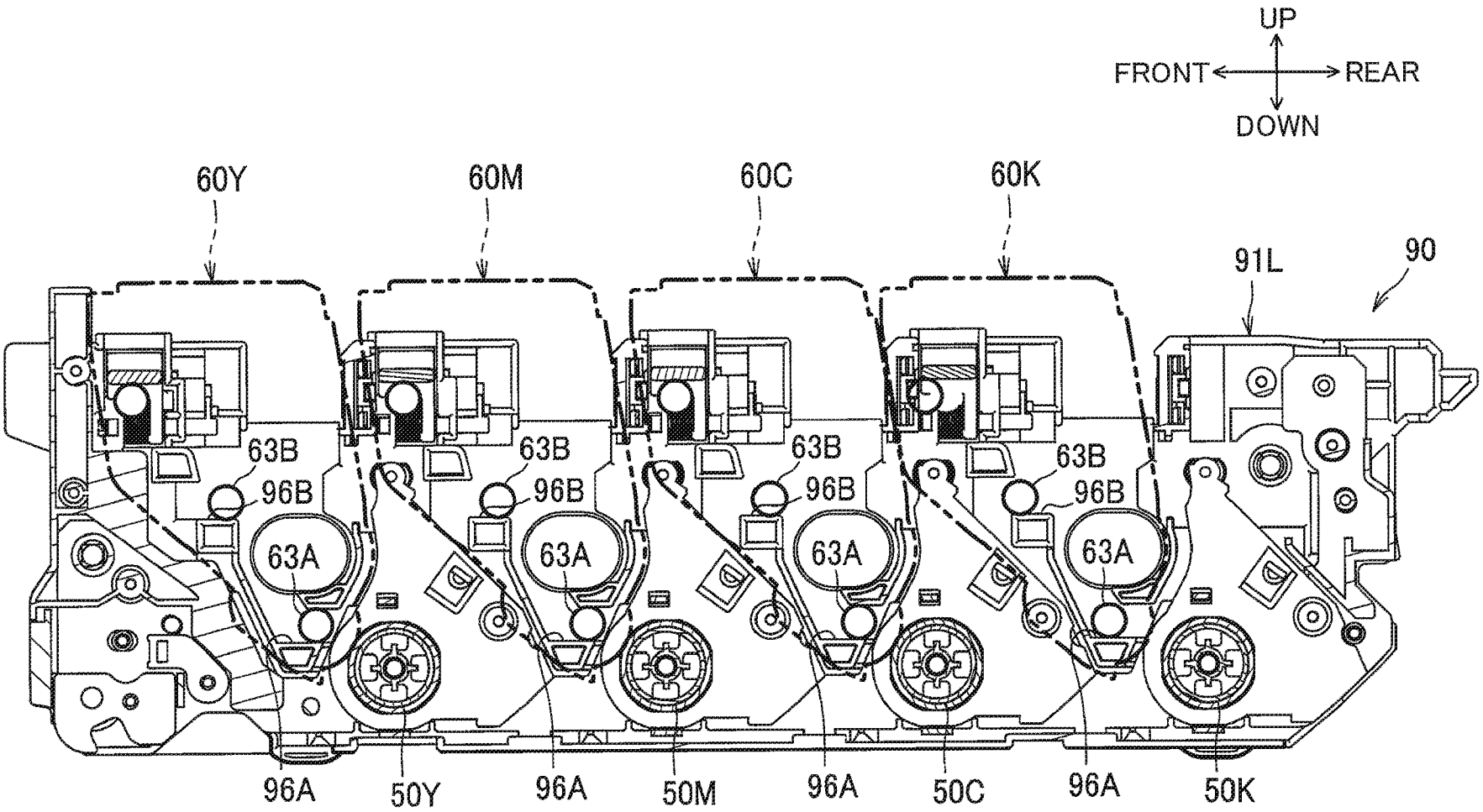
FIG. 5 is a side view of a side frame of the support member, and particularly illustrating an inner surface of the side frame to which the developing cartridge is attachable in the image-forming apparatus according to the embodiment.

As illustrated in FIG. 5, the side frame 91L of the support member 90 has an inner surface provided with a first support surface 96A and a second support surface 96B. The first support surface 96A and the second support surface 96B support the first protruding portion 63A and the second protruding portion 63B of the corresponding developing cartridge 60 from below when the developing roller 61 is moved from the contact position to the separated position. The first support surface 96A and the second support surface 96B extend in the sheet conveying direction (i.e., from the front to the rear).

The first support surface 96A is positioned to support the first protruding portion 63A. The first support surface 96A is configured to guide the developing roller 61 and to fix a position thereof in the upward/downward direction when the developing cartridge 60 is attached to the support member 90. The second support surface 96B is positioned upward of the first support surface 96A to support the second protruding portion 63B when the developing cartridge 60 is attached to the support member 90. Although not illustrated, the first and second support surfaces 96A and 96B are also provided at an inner surface of the right side frame 91R at positions symmetrical with the first and second support surfaces 96A and 96B of the left side frame 91L.

Referring to FIG. 5, when the developing roller 61 is positioned at the contact position in contact with the corresponding photosensitive drum 50, the first protruding portion 63A is positioned at a rear region of the corresponding first support surfaces 96A (see the first protruding portions 63A of the first through third developing cartridges 60Y, 60M and 60C). When the developing roller 61 is at the separated position away from the corresponding photosensitive drum 50, the first protruding portion 63A is positioned at a front region of the corresponding first support surface 96A (see the first protruding portion 63A of the fourth developing cartridge 60K).

In this way, the first through fourth developing rollers 61Y, 61M, 61C and 61K are moved rearward, i.e., in a direction opposite to the sheet conveying direction (toward upstream in the sheet conveying direction) when the separation mechanisms 5 moves the developing rollers 61Y, 61M, 61C and 61K from the contact positions to the separated positions, respectively.

Figure 11A:
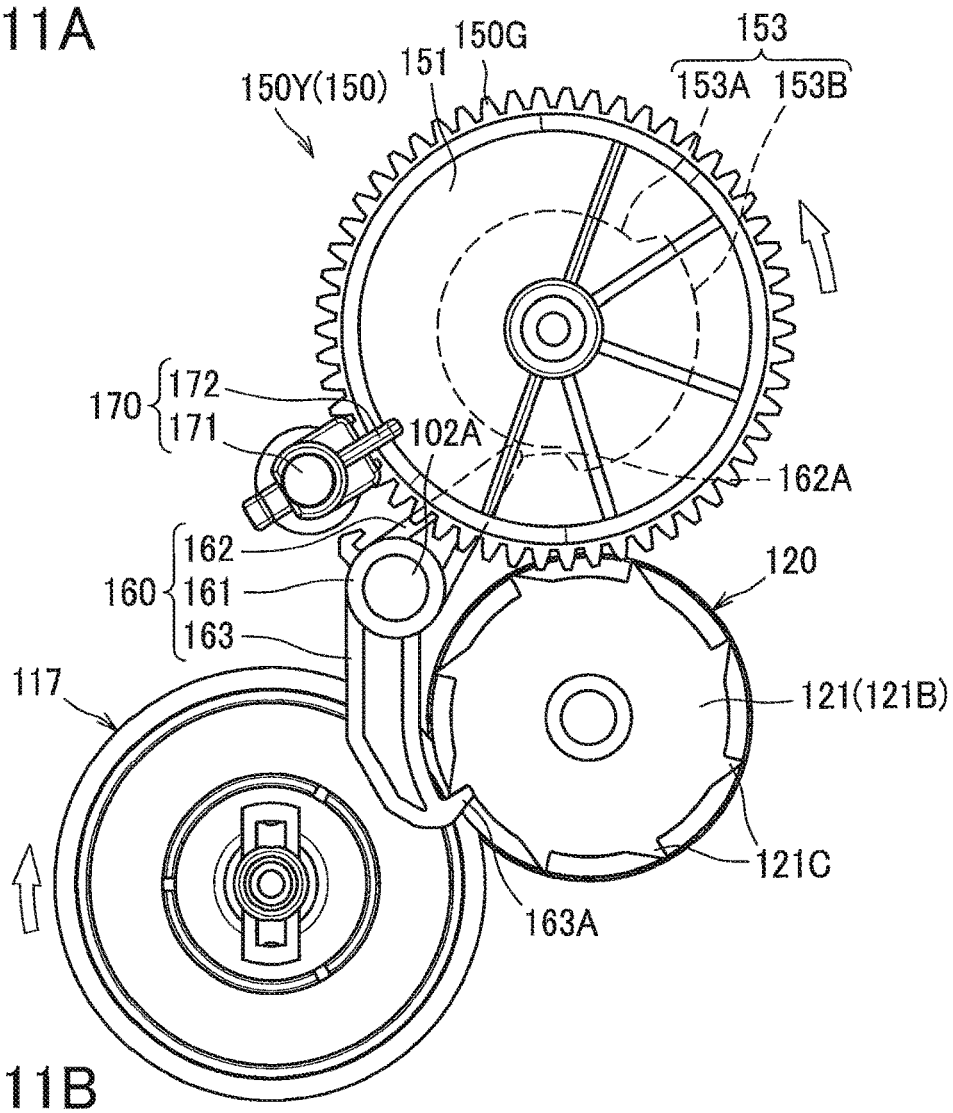
FIG. 11A is a view illustrating a separation mechanism, a lever, the clutch, and a coupling gear in a state where a developing roller is at a contact position and the clutch is at a transmission state as viewed in the axial direction in the image-forming apparatus according to the embodiment.
Figure 11B:
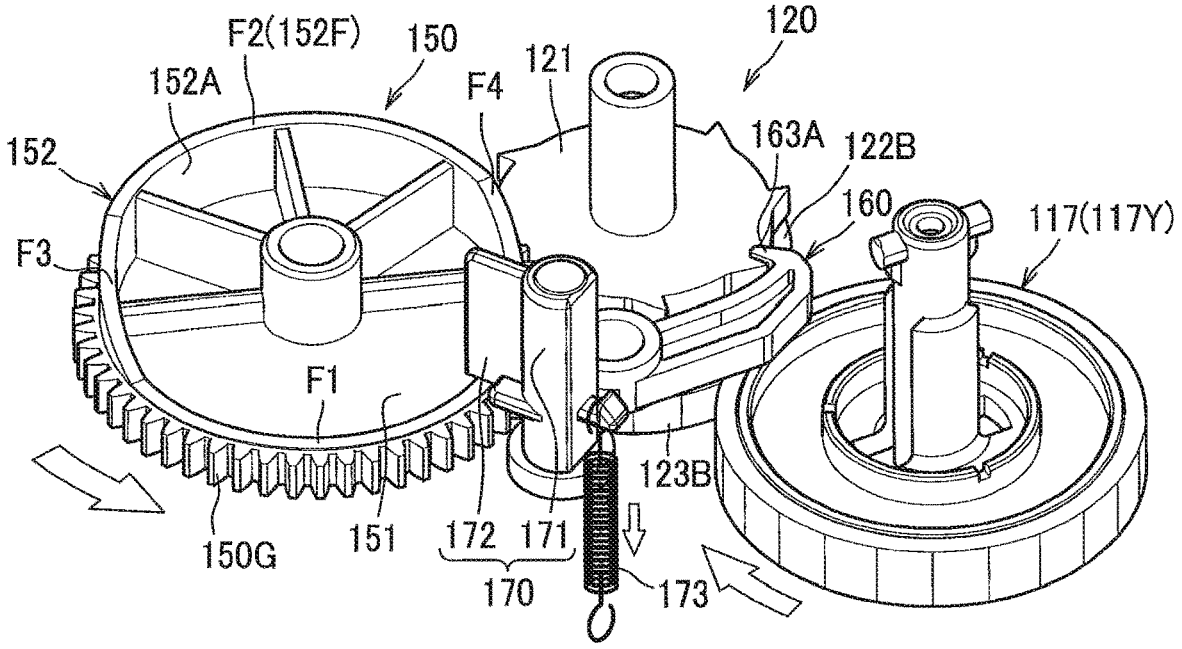
FIG. 11B is a perspective view illustrating the separation mechanism, the lever, the clutch, and the coupling gear in the state where the developing roller is at the contact position and the clutch is at the transmission state.

As illustrated in FIGS. 11A and 11B, each cam 150 includes a disc portion 151, a gear portion 150G, an end face cam 152, and a clutch control cam 153. The cam 150 is configured to move the corresponding developing roller 61 between the contact position and the separated position.

The disc portion 151 is generally circular plate shaped, and is rotatably supported by a support plate 102 (FIGS. 6-9) fixed to the housing 10 of the image-forming apparatus 1. The gear portion 150G is provided on an outer peripheral surface of the disc portion 151. The end face cam 152 constitutes one of components of the corresponding separation mechanism 5. The end face cam 152 includes the above-described first cam portion 152A protruding rightward from the disc portion 151. The end face cam 152 has the cam surface 152F which is the protruding end face (right end face) of the first cam portion 152A.

The cam surface 152F includes a first holding surface F1, a second holding surface F2, a first guide surface F3, and a second guide surface F4. In other words, the first holding surface F1, the second holding surface F2, the first guide surface F3 and the second guide surface F4 altogether constitute the cam surface 152F.

The first holding surface F1 is a flat surface configured to hold the corresponding cam follower 170 at its standby position. The second holding surface F2 is a flat surface configured to hold the corresponding cam follower 170 at its operating position. The first guide surface F3 connects the first holding surface F1 and the second holding surface F2 together and is inclined with respect to the first holding surface F1. The first guide surface F3 is configured to guide movement of the corresponding cam follower 170 from the first holding surface F1 to the second holding surface F2 in accordance with the rotation of the cam 150. The second guide surface F4 connects the second holding surface F2 and the first holding surface F1 together and is inclined with respect to the first holding surface F1. The second guide surface F4 is configured to guide movement of the corresponding cam follower 170 from the second holding surface F2 to the first holding surface F1 in accordance with the rotation of the cam 150.

The clutch control cam 153 includes a base portion 153A having a generally columnar shape, and a second cam portion 153B protruding radially outwardly from the base portion 153A. The clutch control cam 153 is integral with and coaxial with the disc portion 151, and hence, the second cam portion 153B rotates together with the cam 150. The clutch control cam 153 is configured to provide control to a clutch 120 (see FIG. 6) of the power transmission mechanism 100 to switch a power transmission status of the clutch 120 between a transmission state and a cut-off state, in cooperation with a lever 160 (FIG. 9) of the power transmission mechanism 100. Details of the power transmission mechanism 100 will be described later.

The cam follower 170 includes a slide shaft portion 171, and a contact portion 172. The slide shaft portion 171 is slidable relative to a shaft 174 (FIG. 4B) fixed the housing 10 so as to be movable in the axial direction. The slide shaft portion 171 is urged by a spring 173 (an urging member) in such a direction that the contact portion 172 is in contact with the cam surface 152F of the cam 150. Hence, the cam follower 170 is urged toward the standby position.

Specifically, the spring 173 is a tension spring having one end portion engaged with the slide shaft portion 171 and another end portion engaged with a spring attaching portion (not illustrated) provided in the housing 10. The contact portion 172 protrudes radially outward from the slide shaft portion 171 and extends in the axial direction. The contact portion 172 has one axial end face (left end face) facing the cam surface 152F and contactable with the cam surface 152F.

Figure 8:
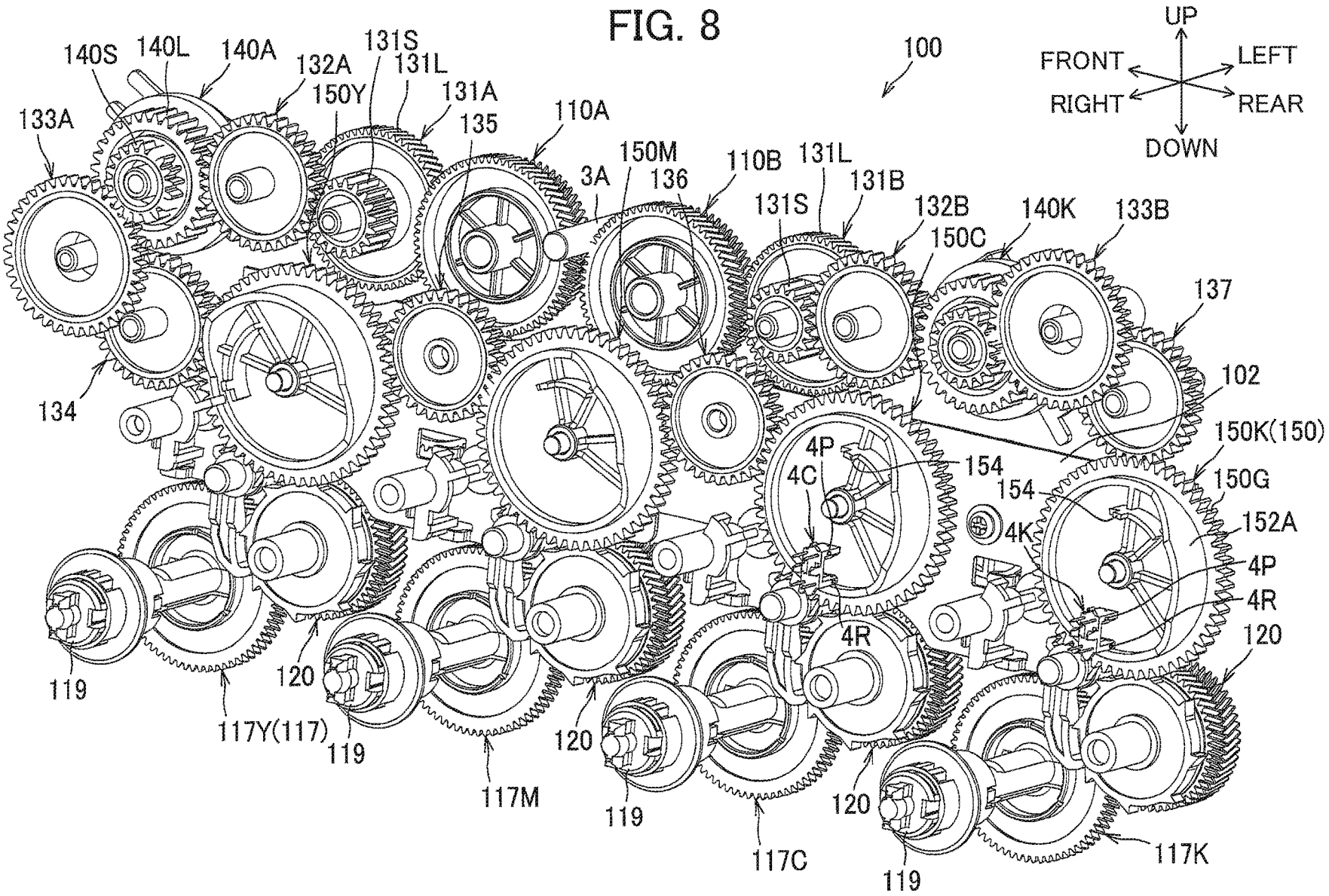
FIG. 8 is a perspective view of the power transmission mechanism as viewed from an upper right side thereof.

As illustrated in FIG. 8, the cams 150Y, 150M, 150C and 150K have generally the same configuration as one another except that a length of the first cam portion 152A of the cam 150Y in a rotational direction thereof is greater than a length of the first cam portion 152A of each of the remaining cams 150M, 150C and 150K in a rotational direction thereof.

Each of the cams 150C and 150K is further provided with a counterpart detection portion 154 protruding from each disc portion 151 in the axial direction at a position radially inward of the corresponding first cam portion 152A. Further, the housing 10 is provided with separation sensors 4C and 4K corresponding to the colors of black and cyan.

The separation sensors 4C and 4K are phase sensors or displacement sensors for detecting phases or rotational positions of the respective cams 150C and 150K. The separation sensors 4C and 4K are configured to output separation signals in response to a timing where the cams 150C and 150K are positioned within a predetermined phase range indicative of the third developing roller 61C and the fourth developing roller 61K being at the separated positions, respectively. The separation sensors 4C and 4K are configured not to output the separation signals in response to a timing where the cams 150C and 150K are positioned outside of the predetermined phase range. In the present embodiment, for simplification, output of the separation signal will be referred to as ON, and non-output of the separation signal will be referred to as OFF. A voltage level of an ON state may be higher or lower than that of an OFF state.

Each of the separation sensors 4K and 4C includes a light emitting portion 4P configured to emit detection light, and a light receiving portion 4R configured to receive the detection light. In a state where the counterpart detection portion 154 is positioned between the light emitting portion 4P and the light receiving portion 4R to block the detection light so that the light receiving portion 4R cannot receive the detection light, each separation sensor 4C, 4K is configured to output a signal indicative of being at the ON state (ON signal) to the controller 2. On the other hand, in a state where the counterpart detection portion 154 is displaced from a path of the detection light so that the light receiving portion 4R can receive the detection light, each separation sensor 4C, 4K is configured to output a signal indicative of being at the OFF state (OFF signal) to the controller 2.

Incidentally, each of the cam 150Y and 150M has a part having the same shape as the counterpart detection portion 154 of the cam 150C and 150K. However, a separation sensor corresponding to each of these parts is not provided at the housing 10, and therefore, these parts do not function as the counterpart detection portion 154 does.

<Mechanisms for Performing Driving/Stop and Contact/Separation of Developing Rollers 61>

Next, a structure for driving and stopping the developing rollers 61, and a structure for moving the developing rollers 61 to come into contact with and to be separated from the photosensitive drums 50 will be described in detail.

Figure 6:
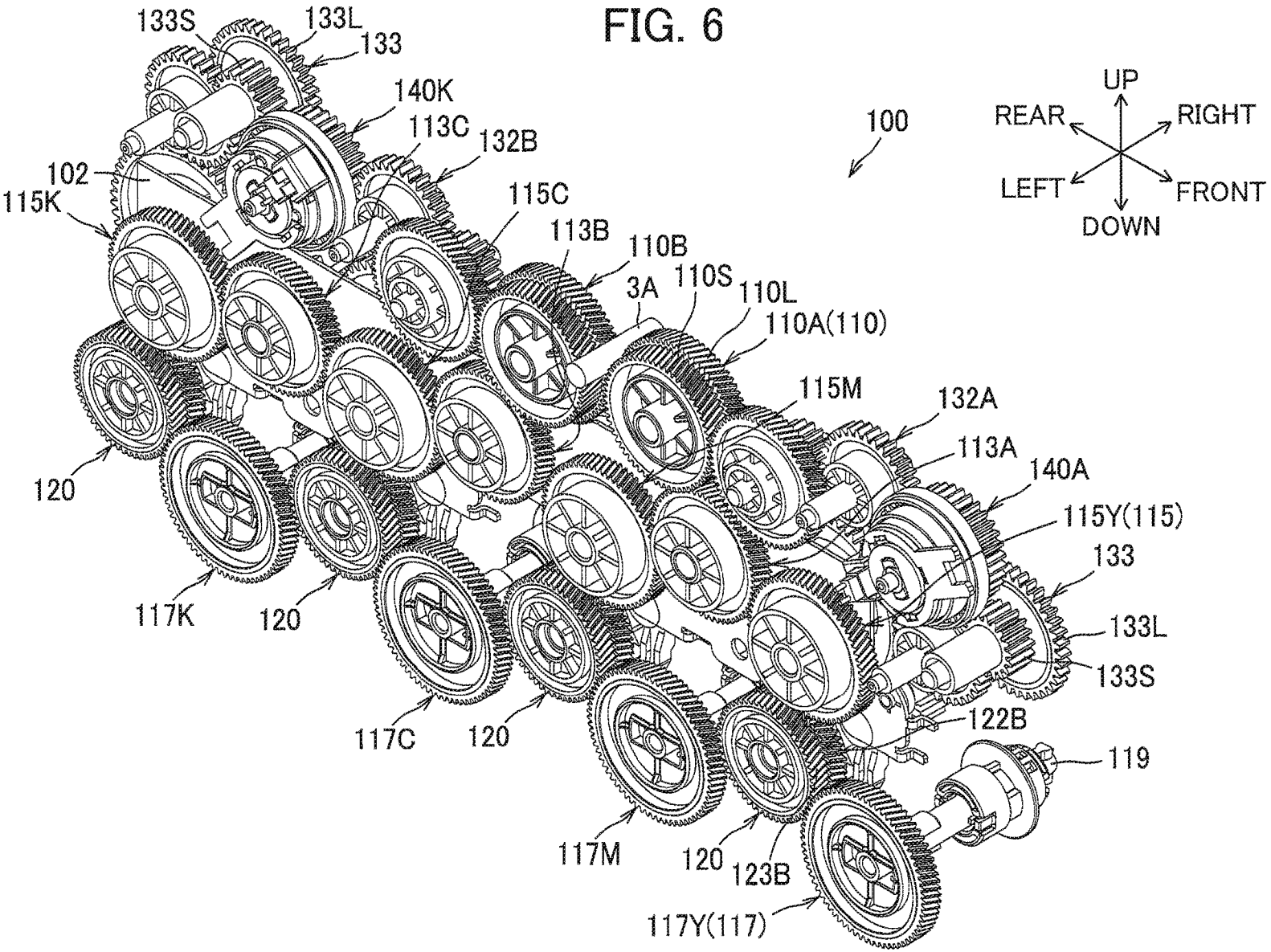
FIG. 6 is a perspective view of a power transmission mechanism as viewed from upper left side thereof in the image-forming apparatus according to the embodiment.
Figure 7:
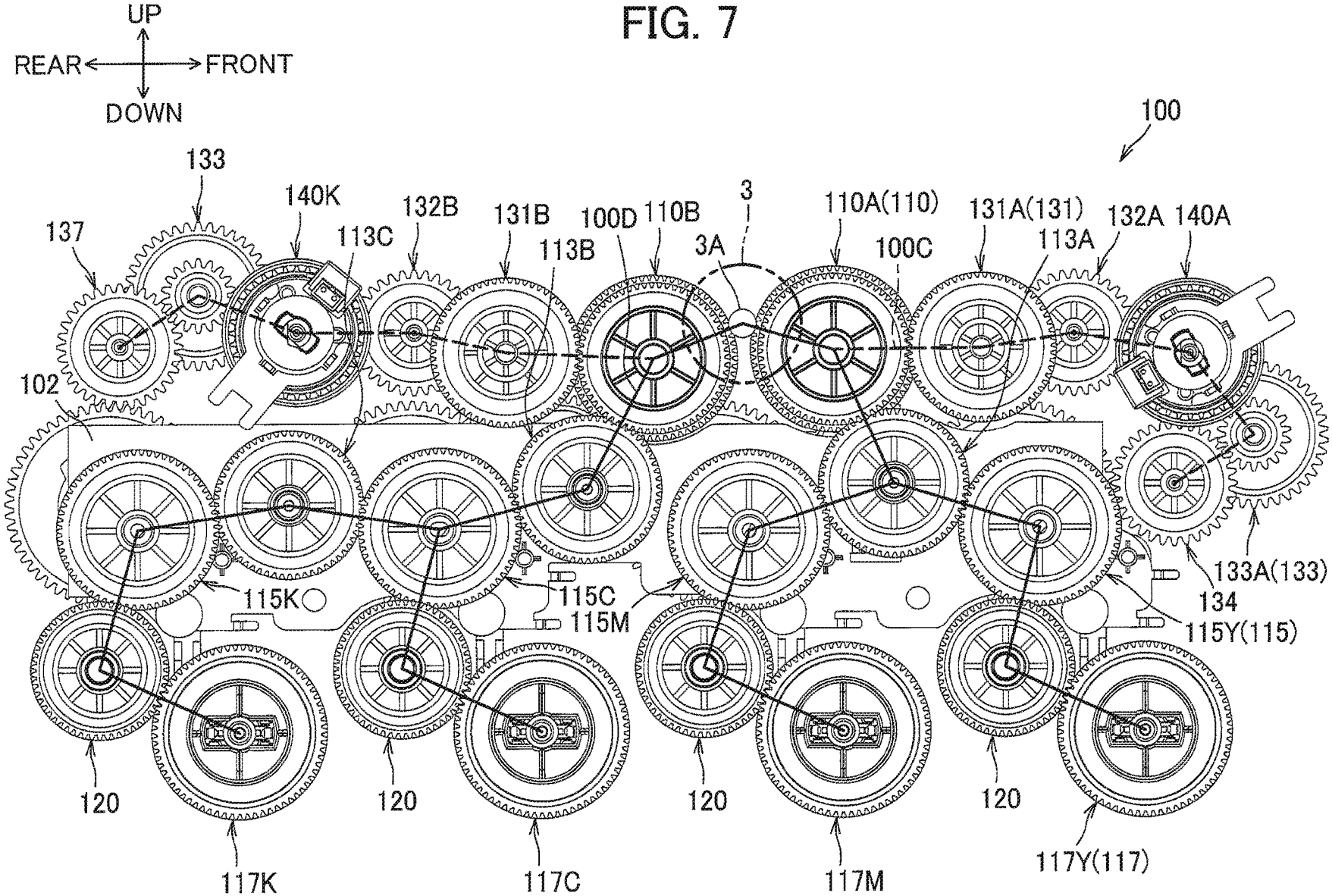
FIG. 7 is a view illustrating the power transmission mechanism as viewed in an axial direction thereof from a left side thereof.

As illustrated in FIGS. 6 and 7, the image-forming apparatus 1 further includes: the motor 3 configured to supply driving force to the cams 150; and the power transmission mechanism 100 configured to transmit the driving force of the motor 3 to the first developing roller 61Y, the second developing roller 61M, the third developing roller 61C, and the fourth developing roller 61, respectively. Each of the above-described cams 150 (constituting part of each separation mechanism 5) is mechanically connected to the power transmission mechanism 100. The power transmission mechanism 100 is configured not to transmit the driving force of the motor 3 to the first developing roller 61Y, the second developing roller 61M, the third developing roller 61C and the fourth developing roller 61K when these developing rollers 61 are at their respective separated positions.

Figure 9:
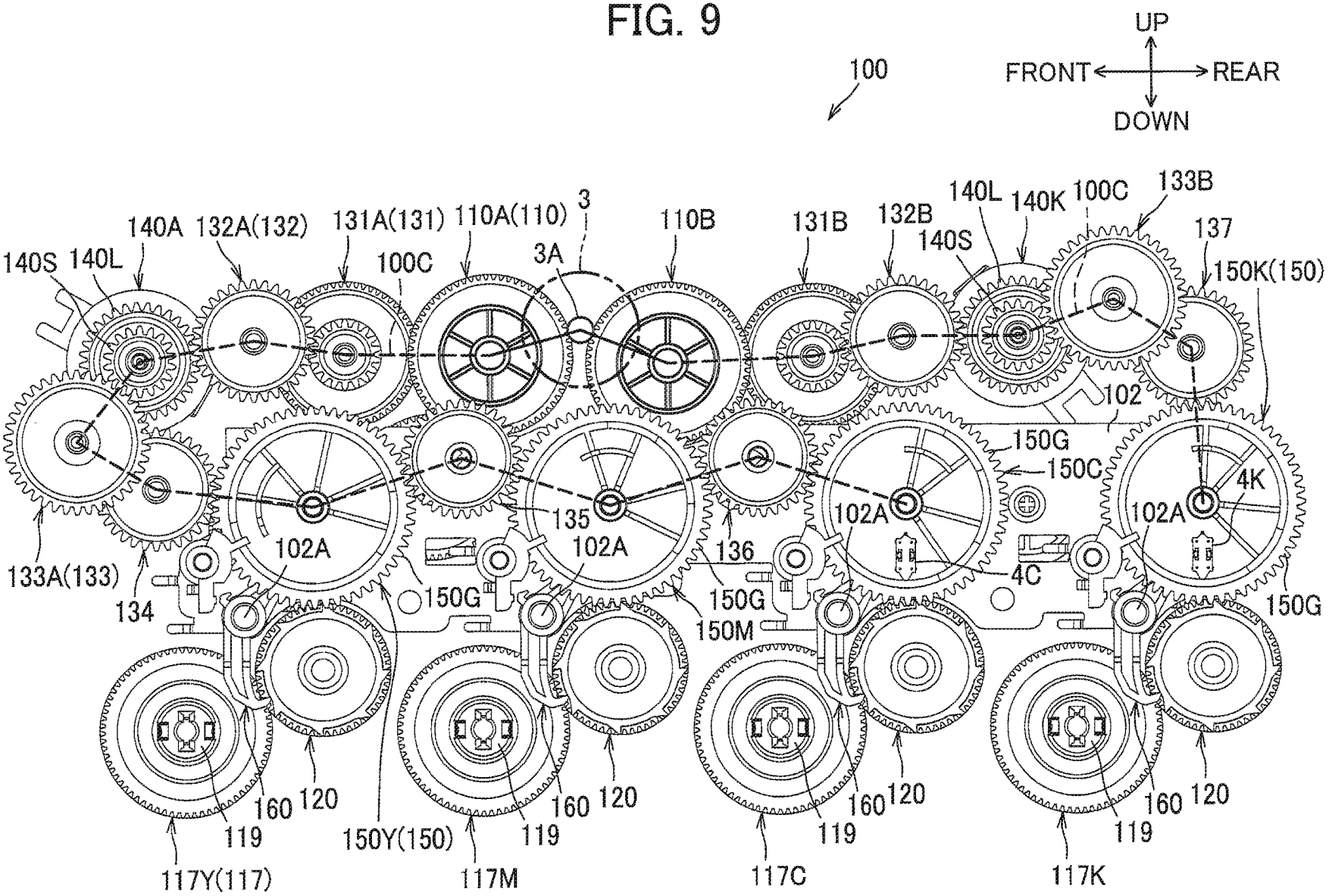
FIG. 9 is a view illustrating the power transmission mechanism as viewed in the axial direction from a right side thereof in the axial direction.

As best illustrated in FIG. 7, the power transmission mechanism 100 includes: a power transmission gear train 100D configured to transmit the driving force of the motor 3 to the respective developing rollers 61; and a transmission control gear train 100C configured to control transmission of the driving force of the power transmission gear train 100D. The power transmission gear train 100D is mechanically connected to the transmission control gear train 100C. In FIGS. 7 and 9, meshing engagement of the gears in the power transmission gear train 100D is indicated by a bold solid line, and meshing engagement of the gears in the transmission control gear train 100C is indicated by a bold broken line.

The power transmission gear train 100D includes: two first idle gears 110 (110A, 110B); three second idle gears 113A, 113B and 113C; four third idle gears 115 (115Y, 115M, 115C, 115K); four clutches 120; and four coupling gears 117 (117Y, 117M, 117C, 117K). Each of these gears constituting the power transmission gear train 100D is supported by the support plate 102 or a frame (not illustrated) of the housing 10 so as to be rotatable about an axis extending in the axial direction.

The motor 3 includes an output shaft 3A. A gear (not illustrated) is concentrically fixed to the output shaft 3A.

As illustrated in FIG. 6, each first idle gear 110 is a two-stage gear including a large diameter gear 110L and a small diameter gear 110S. The small diameter gear 110S has a certain number of gear teeth which is smaller than a number of gear teeth of the large diameter gear 110L. The large diameter gear 110L is rotatable integrally with the small diameter gear 110S. The first idle gear 110A is positioned frontward of the output shaft 3A, and the other first idle gear 110B is positioned rearward of the output shaft 3A. The large diameter gear 110L of each first idle gear 110 is in meshing engagement with the gear of the output shaft 3A.

As illustrated in FIG. 7, the second idle gear 113A is in meshing engagement with the small diameter gear 110S of the front first idle gear 110A. The second idle gear 113B is in meshing engagement with the small diameter gear 110S of the rear first idle gear 110B.

The four third idle gears 115Y, 115M, 115C and 115K are provided in one-to-one correspondence with each of the four colors, and are arrayed in this order in a front-to-rear direction. The third idle gears 115Y and 115M are in meshing engagement with the second idle gear 113A. The third idle gear 115C is in meshing engagement with the second idle gear 113B and the second idle gear 113C. The third idle gear 115K is in meshing engagement with the second idle gear 113C. Hence, the third idle gear 115K is driven by the third idle gear 115C through the second idle gear 113C.

The four clutches 120 have the same structure as one another. Each clutch 120 is in meshing engagement with one of the four third idle gears 115 (one of the third idle gears 115Y, 115M, 115C and 115K) to receive the driving force from the third idle gear 115. A structure of the clutch 120 will be described later in detail.

Each coupling gear 117 is in meshing engagement with one of the clutches 120. Each coupling gear 117 includes the coupling shaft 119 rotatable integrally and coaxially therewith (FIG. 6). The coupling shaft 119 is movable in the axial direction in interlocking relation to the opening/closing movement of the front cover 11. The coupling shaft 119 is configured to be engaged with the coupling 65 (FIG. 3A) of the corresponding developing cartridge 60 in accordance with the closing motion of the front cover 11.

In the power transmission gear train 100D, the coupling gear 117Y for the color of yellow is configured to receive the driving force from the motor 3 through the first idle gear 110A, the second idle gear 113A, the third idle gear 115Y, and the clutch 120.

The coupling gear 117M for the color of magenta is configured to receive the driving force from the motor 3 through the first idle gear 110A, the second idle gear 113A, the third idle gear 115M, and the clutch 120.

The coupling gear 117C for the color of cyan is configured to receive the driving force from the motor 3 through the first idle gear 110B, the second idle gear 113B, the third idle gear 115C, and the clutch 120.

The coupling gear 117K for the color of black is configured to receive the driving force from the motor 3 through the first idle gear 110B, the second idle gear 113B, the third idle gear 115C, the second idle gear 113C, the third idle gear 115K, and the clutch 120.

As illustrated in FIGS. 8 and 9, the transmission control gear train 100C includes: two fourth idle gears 131 (131A, 131B); two fifth idle gears 132 (132A, 132B); a YMC clutch 140A; a K clutch 140K; two sixth idle gears 133 (133A, 133B); a seventh idle gear 134; an eighth idle gear 135; a ninth idle gear 136; a tenth idle gear 137; and the cams 150 (150Y, 150M, 150C, 150K). These gears constituting the transmission control gear train 100C are supported by the support plate 102 or the frame (not illustrated) of the housing 10 so as to be rotatable about their axes extending in the axial direction.

Each fourth idle gear 131 is a two-stage gear including a large diameter gear 131L and a small diameter gear 131S (FIG. 8). The small diameter gear 131S has a certain number of gear teeth is smaller than a number of gear teeth of the large diameter gear 131L. The large diameter gear 131L is rotatable integrally with the small diameter gear 131S. The fourth idle gear 131A is positioned frontward of the first idle gear 110A, and the other fourth idle gear 131B is positioned rearward of the first idle gear 110B. The large diameter gear 131L of each fourth idle gear 131 is in meshing engagement with the small diameter gear 110S of the first idle gear 110 (first idle gear 110A or 110B).

Of the two fifth idle gears 132, the fifth idle gear 132A is positioned frontward of the fourth idle gear 131A, and the fifth idle gear 132B is positioned rearward of the fourth idle gear 131B. The fifth idle gear 132A is in meshing engagement with the small diameter gear 131S of the fourth idle gear 131A, and the fifth idle gear 132B is in meshing engagement with the small diameter gear 131S of the fourth idle gear 131B.

The YMC clutch 140A is configured to change-over transmission and cut-off of the driving force to the cams 150 with respect to the color of yellow, magenta, and cyan in the transmission control gear train 100C. That is, the YMC clutch 140A is configured to perform switching of the cams 150Y, 150M and 150C between their rotating state and non-rotating state.

The YMC clutch 140A includes a large diameter gear 140L and a small diameter gear 140S whose number of gear teeth is smaller than a number of gear teeth of the large diameter gear 140L. The YMC clutch 140A is positioned frontward of the fifth idle gear 132A, and the large diameter gear 140L of the YMC clutch 140A is in meshing engagement with the fifth idle gear 132A.

An electromagnetic clutch is available as the YMC clutch 140. Upon receipt of power supply (turning ON), the large diameter gear 140L and the small diameter gear 140S integrally rotate together, and upon halting of the power supply (turning OFF), the large diameter gear 140L idly rotates to prevent rotation of the small diameter gear 140S.

The K clutch 140K has a structure the same as that of the YMC clutch 140A. The K clutch 140K is configured to perform change-over between transmission and cut-off of the driving force to the cam 150 with respect to the color of black (i.e., the cam 150K) in the transmission control gear train 100C. That is, the K clutch 140K is configured to perform switching of the cam 150K between the rotating state and the non-rotating state.

As in the YMC clutch 140A, the K clutch 140K includes the large diameter gear 140L and the small diameter gear 140S whose number of gear teeth is smaller than that of the large diameter gear 140L. The K clutch 140K is positioned rearward of the fifth idle gear 132B, and the large diameter gear 140L of the K clutch 140K is in meshing engagement with the fifth idle gear 132B.

Each of the two sixth idle gears 133 is a two-stage gear including a large diameter gear 133L and a small diameter gear 133S whose number of gear teeth is smaller than that of the large diameter gear 133L (FIG. 6). The large diameter gear 133L and the small diameter gear 133S rotate integrally. Specifically, the sixth idle gear 133A is positioned frontward of the K clutch 140K, and the sixth idle gear 133B is positioned rearward of the K clutch 140K. The large diameter gear 133L of the sixth idle gear 133A is in meshing engagement with the small diameter gear 140S of the YMC clutch 140A, and the large diameter gear 133L of the sixth idle gear 133B is in meshing engagement with the small diameter gear 140S of the K clutch 140K.

The seventh idle gear 134 is positioned between the sixth idle gear 133A and the cam 150Y. The seventh idle gear 134 is in meshing engagement with the small diameter gear 133S (FIG. 6) of the sixth idle gear 133A and the gear portion 150G of the cam 150Y.

The eighth idle gear 135 is positioned between the cam 150Y and the cam 150M. The eighth idle gear 135 is in meshing engagement with the gear portion 150G of the cam 150Y and the gear portion 150G of the cam 150M.

The ninth idle gear 136 is positioned between the cam 150M and the cam 150C. The ninth idle gear 136 is in meshing engagement with the gear portion 150G of the cam 150M and the gear portion 150G of the cam 150C.

The tenth idle gear 137 is positioned between the sixth idle gear 133B and the cam 150K. The tenth idle gear 137 is in meshing engagement with the small diameter gear 133S of the sixth idle gear 133B (FIG. 6) and the gear portion 150G of the cam 150K.

In the transmission control gear train 100C, the yellow cam 150Y is configured to receive the driving force of the motor 3 through the first idle gear 110A, the fourth idle gear 131A, the fifth idle gear 132A, the YMC clutch 140A, the sixth idle gear 133A, and the seventh idle gear 134. Further, the magenta cam 150M is configured to receive the driving force from the yellow cam 150Y through the eighth idle gear 135. Further, the cyan cam 150C is configured to receive the driving force from the magenta cam 150M through the ninth idle gear 136. Upon power supply to the YMC clutch 140A, the cams 150Y, 150M and 150C are configured to rotate concurrently, and upon halting of the power supply to the YMC clutch 140A, the cams 150Y, 150M and 150C are configured to stop rotating.

On the other hand, the black cam 150K is configured to receive the driving force of the motor 3 through the first idle gear 110B, the fourth idle gear 131B, the fifth idle gear 132B, the K clutch 140K, the sixth idle gear 133B, and the tenth idle gear 137. Upon power supply to the K clutch 140K, the cam 150K is configured to rotate, and the cam 150K is configured to stop rotating upon halting of the power supply to the K clutch 140K.

Next, a structure and functions of the clutch 120 will be described.

Figure 10A:
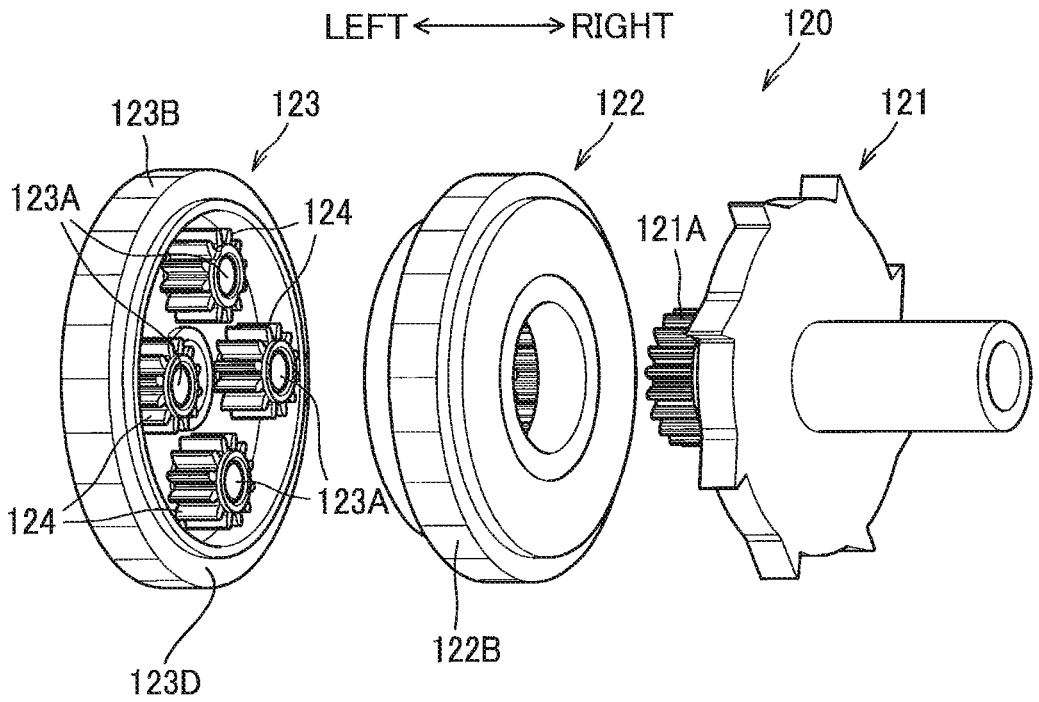
FIG. 10A is an exploded perspective view illustrating a clutch as viewed from a sun gear side thereof in the image-forming apparatus according to the embodiment.
Figure 10B:
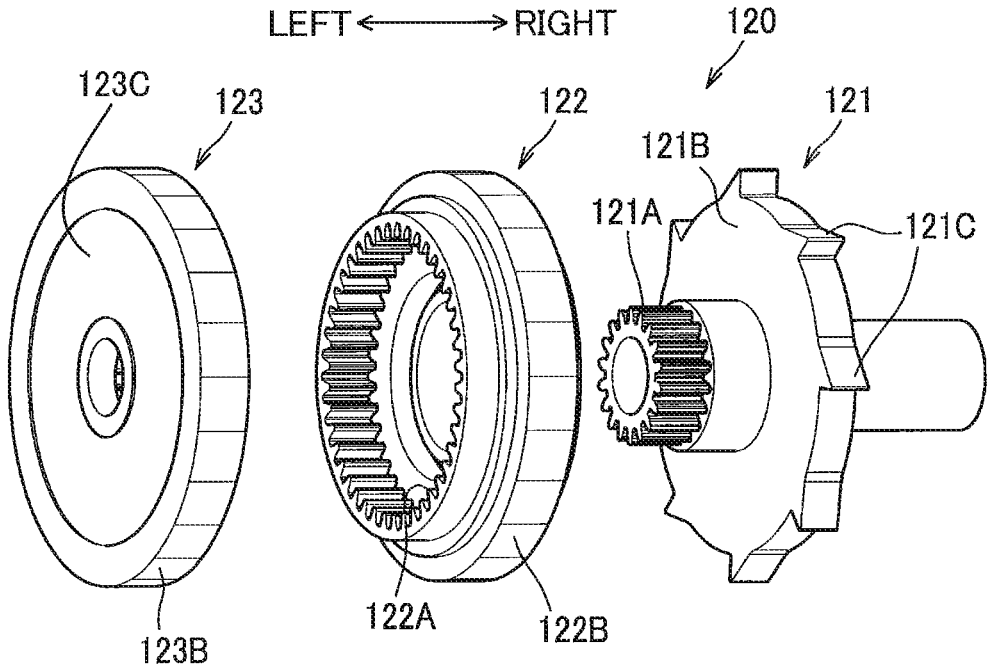
FIG. 10B is an exploded perspective view illustrating the clutch as viewed from a carrier side thereof in the mage forming apparatus according to the embodiment.

As illustrated in FIGS. 10A and 10B, each clutch 120 includes a planetary gear mechanism. The clutch 120 is configured to perform change-over between the transmission state where the driving force of the motor 3 is transmitted to the developing roller 61 and the cut-off state where the driving force is not transmitted to the developing roller 61. Specifically, the clutch 120 includes: a sun gear 121 rotatable about an axis thereof; a ring gear 122; a carrier 123; and a plurality of (four) planetary gears 124 supported by the carrier 123. The ring gear 122 and carrier 123 are rotatable coaxially about the axis of the sun gear 121.

The sun gear 121 includes a gear portion 121A, a disc portion 121B rotatable integrally with the gear portion 121A, and a plurality of pawls 121C provided at an outer peripheral surface of the disc portion 121B. The pawls 121C have acute tip end portions each of which is inclined toward upstream in a rotational direction of the sun gear 121 along the outer peripheral surface. The ring gear 122 has an annular shape having an inner peripheral surface provided with an inner gear 122A and an outer peripheral surface provided with an input gear 122B.

The carrier 123 includes: a circular portion 123C; an annular portion 123D extending from an inner surface of the circular portion 123C; four shaft portions 123A each extending from the inner surface of the circular portion 123C; and an output gear 123B provided at an outer peripheral surface of the annular portion 123D.

Each of the four planetary gears 124 is rotatably supported by one of the four shaft portions 123A. Each planetary gear 124 is in meshing engagement with the gear portion 121A of the sun gear 121, and with the inner gear 122A of the ring gear 122.

As illustrated in FIGS. 6 and 7, the input gear 122B of each clutch 120 is in meshing engagement with the corresponding third idle gear 115, and the output gear 123B is in meshing engagement with the corresponding coupling gear 117.

In a state where the rotation of the sun gear 121 is stopped, the driving force input into the input gear 122B can be transmitted to the output gear 123B (the transmission state). On the other hand, in a state where the sun gear 121 is allowed to rotate, the driving force input into the input gear 122B cannot be transmitted to the output gear 123B (the cut-off state). In a state where the clutch 120 is at the cut-off state and the driving force is input into the input gear 122 while load is imparted on the output gear 123B, the output gear 123B does not rotate and the sun gear 121 idly rotates.

As illustrated in FIG. 9, the power transmission mechanism 100 further includes a plurality of (four) the levers 160 corresponding to the respective four colors. Four support shafts 102A are fixed to and extends from the support plate 102. Each lever 160 is pivotally movably supported by the corresponding one of the support shafts 102A. Each lever 160 is configured, in cooperation with the corresponding cam 150, to engage the sun gear 121 of the planetary gear mechanism in the corresponding clutch 120 to prevent the rotation of the sun gear 121 to provide the transmission state, and to disengage from the sun gear 121 to provide the cut-off state.

Specifically, as illustrated in FIG. 11A, each lever 160 includes a rotation support portion 161, a first arm 162 extending from the rotation support portion 161, and a second arm 163 extending from the rotation support portion 161 in a direction different from an extending direction of the first arm 162.

The rotation support portion 161 is hollow cylindrical. The corresponding support shaft 102A of the support plate 102 is inserted in a hollow space of the rotation support portion 161. Hence, the rotation support portion 161 is supported by the support shaft 102A.

The second arm 163 has a tip end portion extending toward the outer peripheral surface of the disc portion 121B of the sun gear 121 of the corresponding clutch 120. The lever 160 is urged by a torsion spring (not illustrated) so that the tip end portion of the second arm 163 is urged toward the outer peripheral surface of the disc portion 121B. A hook 163A is provided at the tip end portion of the second arm 163. The hook 163A is configured to engage any one of the pawls 121C of the sun gear 121 to prevent the sun gear 121 from rotating.

The first arm 162 has a tip end portion 162A contactable with the second cam portion 153B of the corresponding cam 150. Specifically, the lever 160 is pivotally movable between an engagement position and a disengagement position. In the engagement position, the tip end portion 162A is positioned in confrontation with the circular base portion 153A, so that the hook 163A is engaged with one of the pawls 121C of the corresponding clutch 120 (see FIGS. 11A-13B). In the disengagement position, the tip end portion 162A of the first arm 162 comes into contact with the second cam portion 153B to be urgingly moved by the same, so that the hook 163A is disengaged from the pawl 121C (see FIGS. 14A-15B). The engagement position of the lever 160 separated from the second cam portion 153B brings the clutch 120 into the transmission state, and the disengagement position of the lever 160 in contact with the second cam portion 153B brings the clutch 120 into the cut-off state.

<Operations of the Cam 150, Lever 160, Clutch 120 and Cam Follower 170>

Operations of the lever 160, the clutch 120, the cam 150 and the cam follower 170 will be described with reference to FIGS. 11A through 15B. The components illustrated in these drawings are for the color of yellow. Components corresponding to the other colors have the same structure as the components illustrated in FIGS. 11A through 15B except for the difference in the phase of each cam 150.

As illustrated in FIGS. 11A and 11B, the tip end portion 162A of the first arm 162 is brought into confrontation with the circular base portion 153A after the tip end portion 162A is separated from the second cam portion 153B. Hence, the hook 163A of the second arm 163 is brought into engagement with one of the pawls 121C of the sun gear 121 of the corresponding clutch 120 to position the lever 160 at its engagement position. Since the rotation of the sun gear 121 is stopped by the lever 160, the clutch 120 is brought to the transmission state where the output gear 123B rotates in accordance with the rotation of the input gear 122B. Hence, the driving force of the motor 3 can be transmitted to the developing roller 61, and accordingly, the developing roller 61 is rotatable by the rotation of the motor 3 through the power transmission gear train 100D.

Further, the end face (left end face) of the contact portion 172 of the cam follower 170 is positioned on the first holding surface F1 of the cam surface 152F of the cam 150. Therefore, the slide shaft portion 171 is positioned to be spaced away from the slide member 64 of the developing cartridge 60 in the axial direction (see FIG. 4A). Accordingly, the developing roller 61 is positioned at its contact position.

Figure 12A:
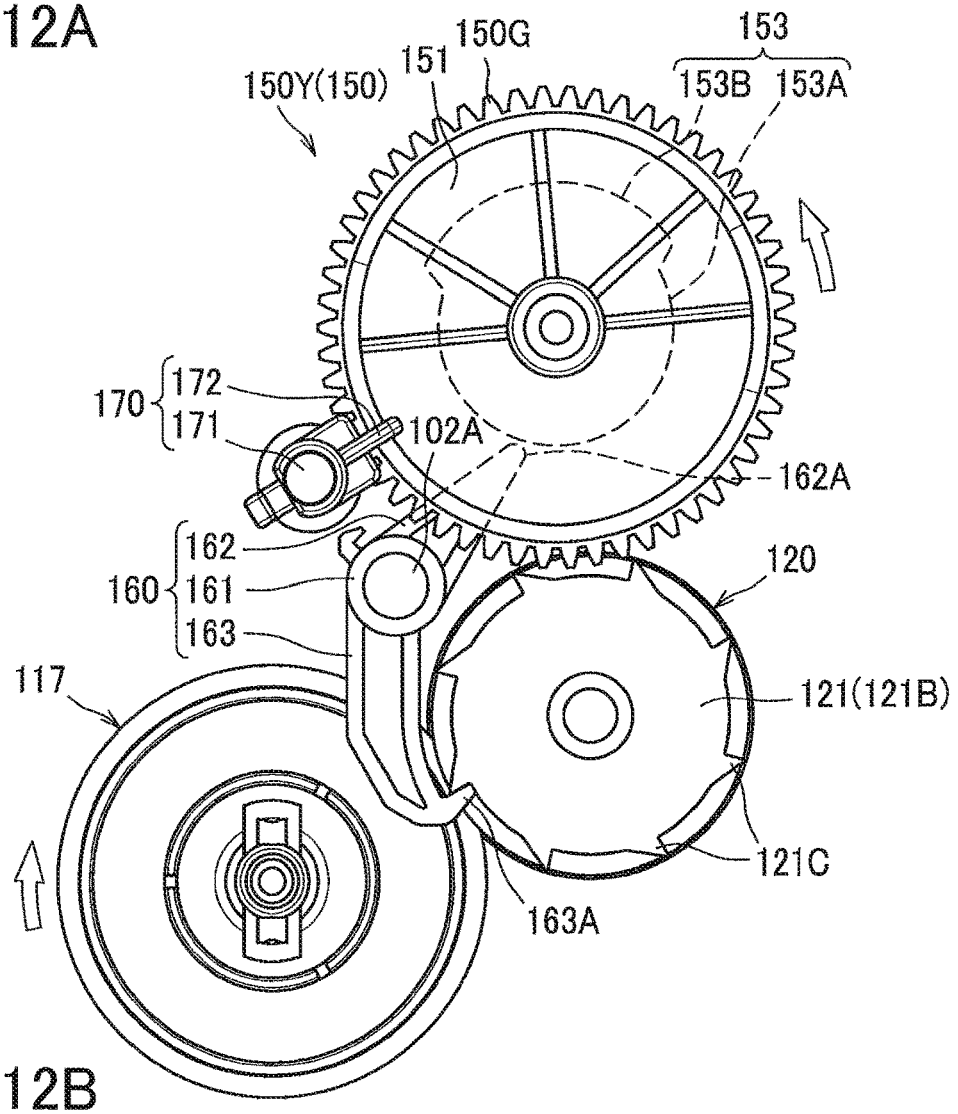
FIG. 12A is a view illustrating the separation mechanism, the lever, the clutch, and the coupling gear in a state where the cam rotates from the state of FIG. 11A and the developing roller corresponding to the color of yellow is at the contact position to perform image formation as viewed in the axial direction.
Figure 12B:
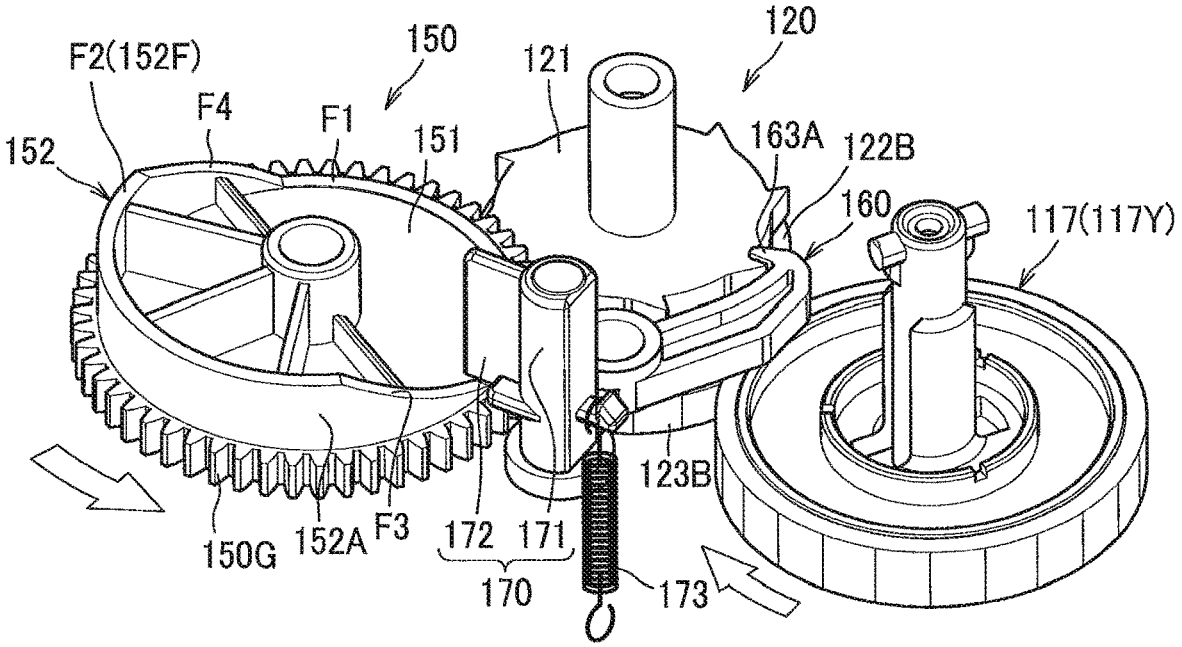
FIG. 12B is a perspective view illustrating the separation mechanism, the lever, the clutch, and the coupling gear in the state where the cam rotates from the state of FIG. 11A and the developing roller corresponding to the color of yellow is at the contact position to perform image formation.

As illustrated in FIGS. 12A and 12B, in accordance with further rotation of the cam 150 from the state illustrated in FIGS. 11A, and 11B, the contact portion 172 of the cam follower 170 slidingly moves over the first holding surface F1 of the cam 150 and approaches the first guide surface F3. Among the four cams 150, in particular, in a case where the rotation of the yellow cam 150Y is to be stopped while the developing roller 61 is at the contact position, the rotation of the yellow cam 150Y is stopped when the contact portion 172 is in contact with the first guide surface F3, as illustrated in FIGS. 12A and 12B.

Figure 13A:
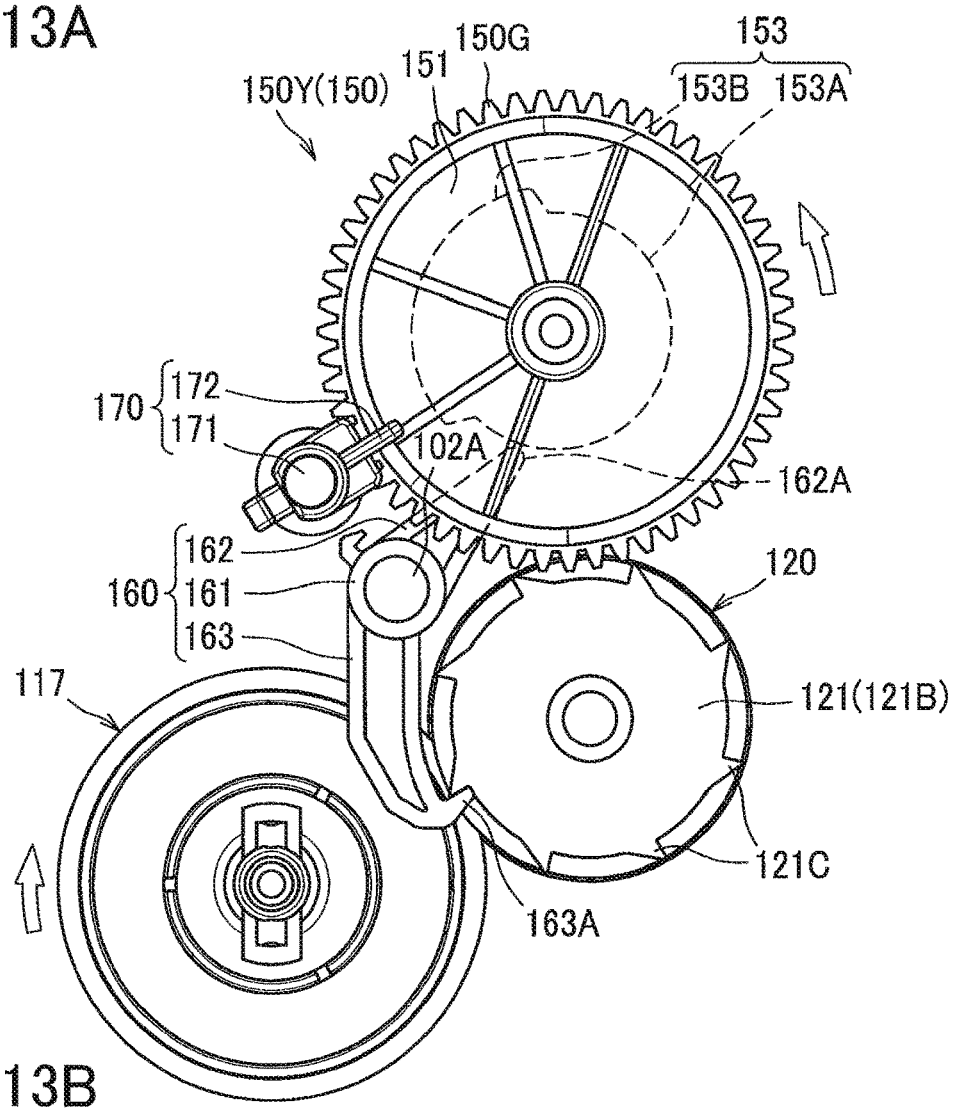
FIG. 13A is a view illustrating the separation mechanism, the lever, the clutch, and the coupling gear in a state where the cam further rotates from the state of FIG. 12A and the developing roller is at a separated position thereof and the clutch is at the transmission state as viewed in the axial direction.
Figure 13B:
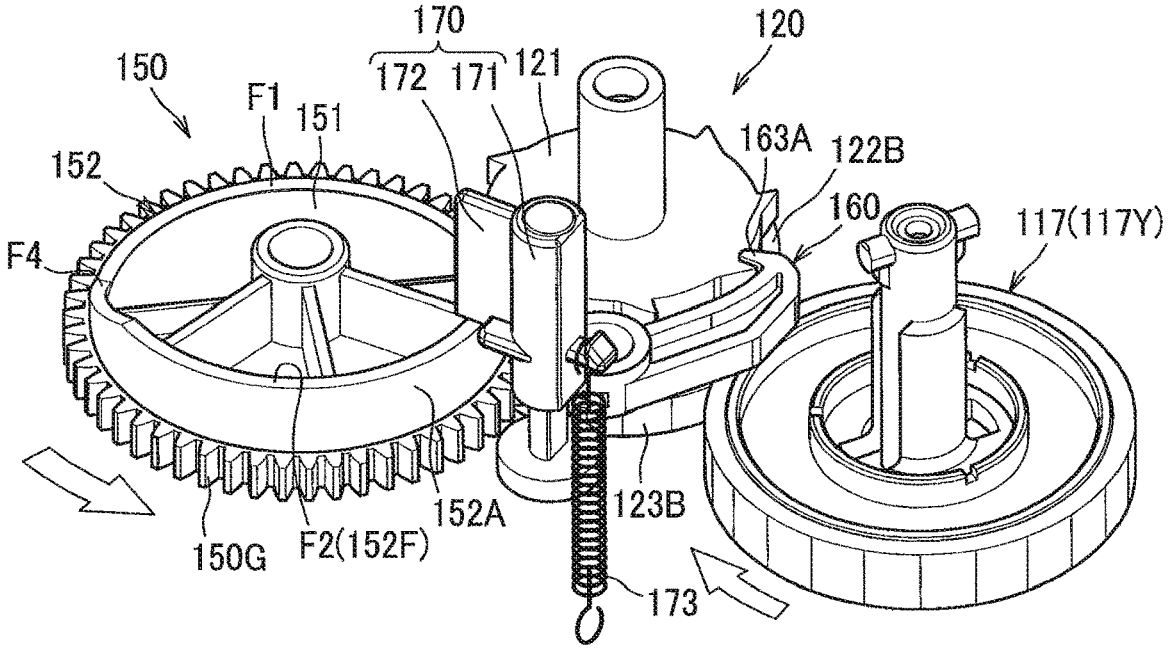
FIG. 13B is a perspective view illustrating the separation mechanism, the lever, the clutch, and the coupling gear in the state where the cam further rotates from the state of FIG. 12A and the developing roller is at the separated position and the clutch is at the transmission state.

In order to separate the developing roller 61 away from the photosensitive drum 50, the cam 150Y is further rotated, so that the contact portion 172 of the cam follower 170 slidingly moves over the first guide surface F3 and is brought into contact with the second holding surface F2, as illustrated in FIGS. 13A and 13B. Hence, the slide shaft portion 171 of the cam follower 170 pushes the slide member 64 of the developing cartridge 60 in the axial direction (rightward), so that the developing cartridge 60 is pushed frontward by the reaction force from the counterpart abutment portions 94 provided on the support member 90 (see FIG. 4B).

The developing roller 61 is thus separated from the photosensitive drum 50 in a state where the contact portion 172 is positioned on a region of the first guide surface F3, the region being closer to the second holding surface F2 than to the first holding surface F1. The separated position of the developing roller 61 is maintained as long as the contact portion 172 is positioned on the second holding surface F2.

Figure 14A:
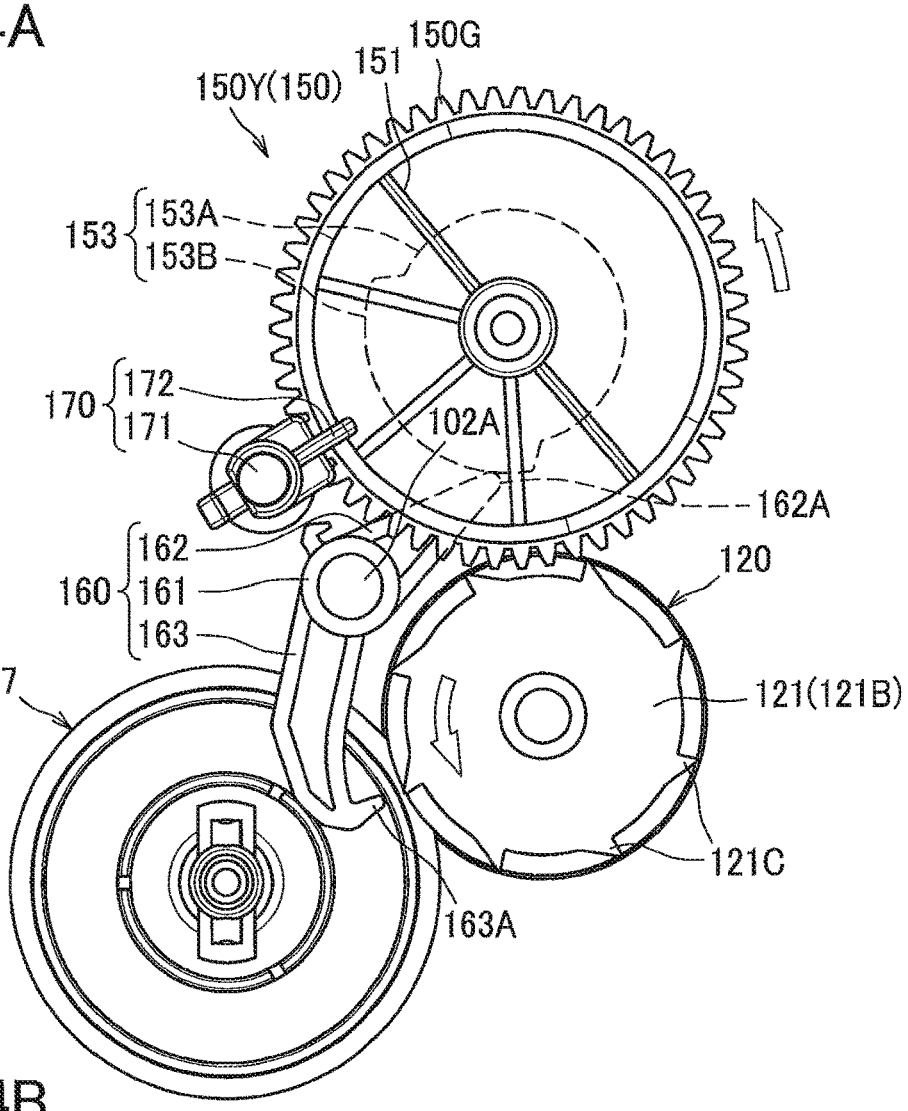
FIG. 14A is a view illustrating the separation mechanism, the lever, the clutch, and the coupling gear in a state where the cam further rotates from the state of FIG. 13A and the developing roller is at the separated position and the clutch is at a cut off state as viewed in the axial direction.
Figure 14B:
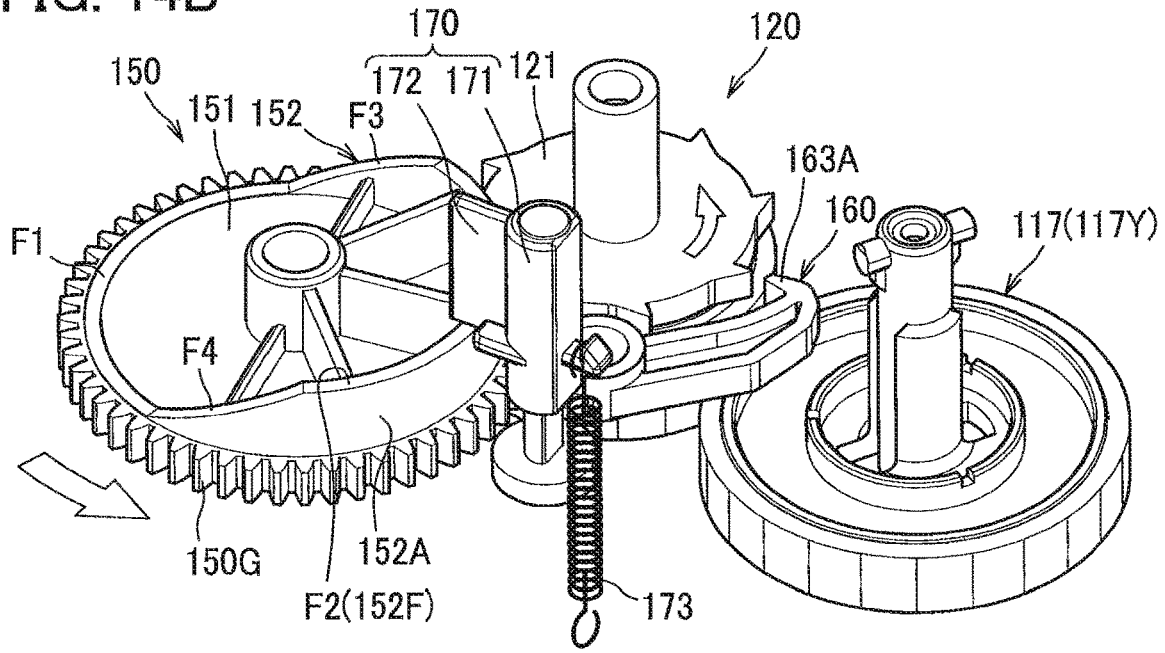
FIG. 14B is a perspective view illustrating the separation mechanism, the lever, the clutch, and the coupling gear in the state where the cam further rotates from the state of FIG. 13A and the developing roller is at the separated position and the clutch is at the cut off state.

As illustrated in FIGS. 14A and 14B, the cam 150 further rotates after the developing roller 61 is positioned at the separated position, so that the tip end portion 162A of the first arm 162 of the lever 160 is brought into contact with the second cam portion 153B. The lever 160 is pivotally moved by the first arm 162 being pushed by the second cam portion 153B. Hence, the hook 163A is disengaged from the pawl 121C of the sun gear 121, thereby providing the disengagement position of the lever 160.

Since the lever 160 no longer stops rotation of the sun gear 121 of the clutch 120 at this time, the clutch 120 is switched to the cut-off state where the output gear 123B does not perform power transmission during the rotation of the input gear 122B. Accordingly, the driving force of the motor 3 cannot be transmitted to the developing roller 61. That is, the rotation of the motor 3 does not cause rotation of the developing roller 61, but only causes idle rotation of the sun gear 121.

Figure 15A:
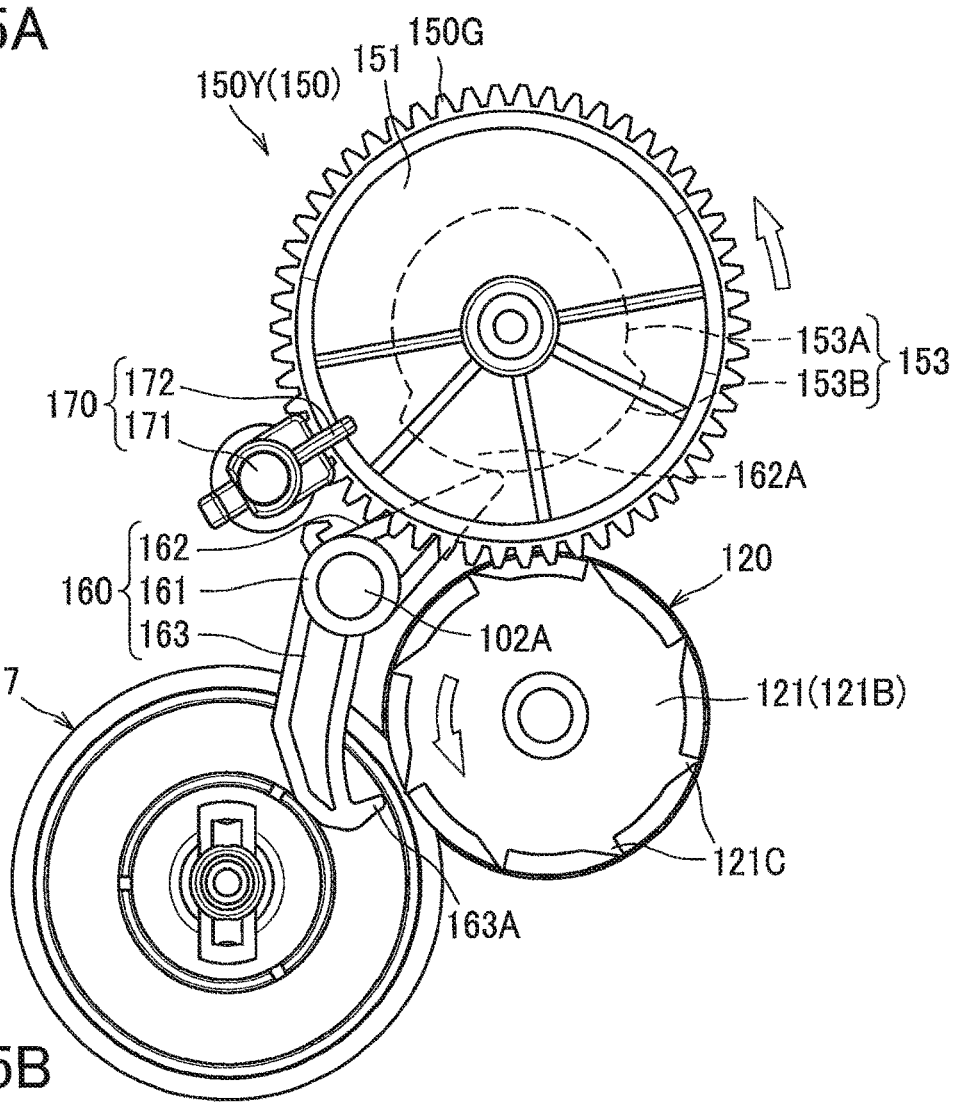
FIG. 15A is a view illustrating the separation mechanism, the lever, the clutch, and the coupling gear in a state where the cam further rotates from the state of FIG. 14A and the developing roller corresponding to the color of yellow temporarily stops rotating immediately before starting to move to the contact position as viewed in the axial direction.
Figure 15B:
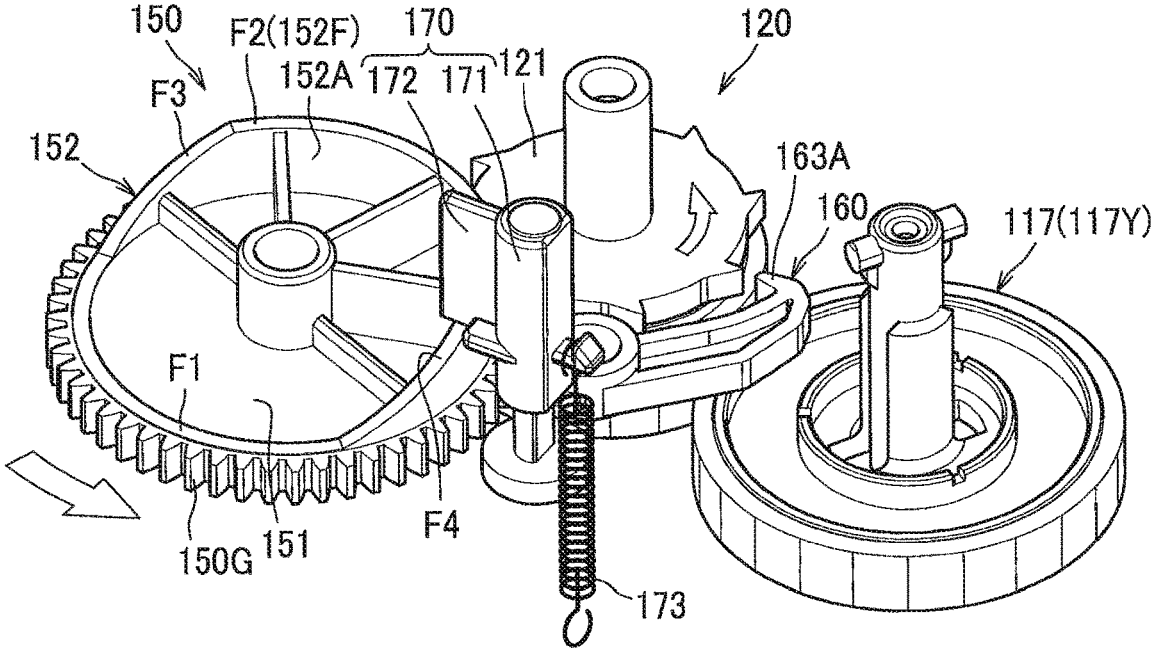
FIG. 15B is a perspective view illustrating the separation mechanism, the lever, the clutch, and the coupling gear in the state where the cam further rotates from the state of FIG. 14A and the developing roller corresponding to the color of yellow temporarily stops rotating immediately before starting to move to the contact position.

In order to maintain the separated position of the developing roller 61, the rotation of the cam 150 is halted while the lever 160 is at the disengagement position illustrated in FIGS. 14A and 14B. For temporarily stopping the rotation of the yellow cam 150Y while the developing roller 61Y is at the separated position, the cam 150Y is further rotated from the state illustrated in FIGS. 14A and 14B. Then, as illustrated in FIGS. 15A and 15B, the rotation of the yellow cam 150Y is stopped when the contact portion 172 reaches an end of the second holding surface F2, the end being immediately upstream of the second guide surface F4. That is, the contact portion 172 is stopped immediately before moving onto the second guide surface F4 (before coming into contact with the second guide surface F4).

In order to move the developing roller 61 from the separated position to the contact position, the cam 150 is further rotated from the state illustrated in FIGS. 14A and 14B or FIGS. 15A and 15B. As a result, the contact portion 172 slidingly moves over the second guide surface F4 and comes to the position in contact with the first holding surface F1 by the urging force of the spring 173, as illustrated in FIGS. 11A and 11B.

Accordingly, the cam follower 170 is moved in the axial direction away from the slide member 64, so that the slide member 64 is moved leftward in FIG. 4A by the urging force of the spring 184. Thus, the developing cartridge 60 is returned to the state depicted in FIG. 4A, i.e., to the contact position indicated by the solid line in FIG. 1 where the developing roller 61 is in contact with the photosensitive drum 50. The developing roller 61 is brought into contact with the photosensitive drum 50 when the contact portion 172 moves past a region of the second guide surface F4, the region being adjacent to the second holding surface F2 (see FIG. 15B).

In the meantime, the lever 160 is pivoted to the engagement position where the hook 163A of the second arm 163 engages the pawl 121C of the sun gear 121 since the tip end portion 162A of the first arm 162 faces the circular base portion 153A of the cam 150. The clutch 120 is thus rendered into the transmission state.

<Detailed Operations Performed in the Image-Forming Apparatus 1>

In the image-forming apparatus 1, the first developing roller 61Y, the second developing roller 61M, the third developing roller 61C, and the fourth developing roller 61K are configured to be moved to the contact positions for transferring respective toner images to the sheet S in synchronism with the movement of the sheet S, and are configured to be moved in sequence to the separated positions after the transfer of the toner images to the sheet S.

To this effect, the cams 150Y, 150M and 150C are assembled so that the phases (angular positions) of the respective first cam portions 152A are displaced from one another by a predetermined angle (see FIG. 8). Specifically, the cams 150M and 150C have the same structure as each other. Further, the length of the first cam portion 152A of the yellow cam 150Y in the rotational direction is greater than the length of the cam 150M, 150C in the rotational direction thereof. Further, as illustrated in FIG. 8, the phases or angular positions of downstream ends of the respective first cam portions 152A are displaced from one another by a predetermined angle with respect to the cams 150Y, 150M, and 150C, whereas the phases or angular positions of upstream ends of the respective first cam portions 152A are coincident with each other with respect to the cams 150Y and 150M.

Further, the structure of the cam 150K is identical to the structure of the cams 150M and 150C. However, the controller 2 is configured to control the cam 150K to start operating at a timing later by a predetermined angle (retardation in phase) than a timing at which the operations of the cams 150M and 150C are started.

The controller 2 is configured to control overall operations performed in the image-forming apparatus 1. The controller 2 includes a CPU, a ROM, a RAM, an input portion, and an output portion and the like. The controller 2 is configured to perform various processing by executing programs preliminarily stored therein.

The controller 2 is configured to control the YMC clutch 140A and the K clutch 140K in response to signals transmitted from the sheet feed sensors 28A and 38A, the front sensors 28B and 48B, the back sensor 28C, and the separation sensors 4K and 4C, thereby controlling the contact/separation of the developing rollers 61 relative to the respective photosensitive drums 50.

In the state where the second developing roller 61M, the third developing roller 61C, and the fourth developing roller 61K are at their separated positions, the developing cartridges 60M, 60C and 60K are respectively overlapped with the optical paths of the laser beams irradiating the photosensitive drums 50Y, 50M and 50C (the photosensitive drums 50 positioned adjacent to and upstream of the respective developing rollers 61M, 61C and 61K in the sheet conveying direction), as illustrated in FIG. 1. Therefore, the second developing roller 61M, the third developing roller 61C, and the fourth developing roller 61K are configured to be moved to the contact positions prior to irradiation of the laser beams toward the photosensitive drums 50Y, 50M and 50C, respectively.

The second developing roller 61M and the third developing roller 61C are configured to be moved to the contact positions prior to start of the exposure to the upstream photosensitive drums 50Y and 50M by the difference in length of the first cam portions 152A among the cams 150Y, 150M and 150C, and by the mechanical setting as to displacement of the phases of the cams 150Y, 150M and 150C.

Specifically, in order to move the second developing roller 61M to the contact position prior to the exposure to the first photosensitive drum 50Y, the cams 150Y and 150M are configured such that the second developing roller 61M comes into contact with the second photosensitive drum 50M at a timing concurrent with or prior to the timing at which the first developing roller 61Y comes into contact with the first photosensitive drum 60Y. That is, the timing is so set to satisfy an inequality $t2 \leq t1$, in which time t1 is defined as a time of contact of the first developing roller 61Y with the first photosensitive drum 50Y, and time t2 is defined as a time of contact of the second developing roller 61M with the second photosensitive drum 50M. More specifically, in the present embodiment, the time t1 is set to be equal to the time t2 ($t1=t2$).

For performing color printing, the controller 2 controls the cam 150K to be delayed by the predetermined angle against the cam 150C in association with the movement (moving timing) of the third developing roller 61C. That is, for performing color printing employing the first developing roller 61Y, the second developing roller 61M, the third developing roller 61C, and the fourth developing roller 61K, the controller 2 controls the third developing roller 61C and the fourth developing roller 61K to move to their contact positions prior to start of the exposure to the third photosensitive drum 50C.

The controller 2 further controls the third developing roller 61C to move to the separated position after termination of development with respect to the third photosensitive drum 50C and prior to termination of development with respect to the fourth photosensitive drum 50K. The controller 2 then permits the fourth developing roller 61K to move to the separated position after the termination of development with respect to the fourth photosensitive drum 50K.

On the other hand, for performing monochromatic printing employing only the fourth developing roller 61K, the controller 2 controls the fourth developing roller 61K to move to the contact position prior to start of the exposure to the fourth photosensitive drum 50K, while the first developing roller 61Y, the second developing roller 61M, and the third developing roller 61K are respectively maintained to be at the separated positions. Then, the controller 2 controls the fourth developing roller 61K to move to the separated position after termination of development with respect to the fourth photosensitive drum 50K.

Further, the controller 2 controls contacting timing of the most upstream first developing roller 61Y for the color of yellow with the first photosensitive drum 50Y in timed relation to conveying timing of the sheet S. That is, the controller 2 permits the cams 150Y, 150M and 150C to rotate within a time period prior to arrival of the sheet S at the first photosensitive drum 50Y and after start of conveyance of the sheet S.

Further, the controller 2 controls the YMC clutch 140A to stop rotation of the cams 150Y, 150M and 150C at a temporary stop timing. This temporary stop timing is a timing at which: a first time period T1 has elapsed from the timing at which the ON signal is not transmitted from the separation sensor 4C (the timing at which the signal turns OFF); and the first developing roller 61Y is in separation from the first photosensitive drum 50Y.

Then, the controller 2 controls the YMC clutch 140A to rotate the cams 150Y, 150M and 150C to bring the first developing roller 61Y into contact with the first photosensitive drum 50Y for image formation at a restart timing which is a timing at which a second time period T2 has elapsed from the timing at which the front sensor 28B detects the leading edge of the sheet S.

In the present embodiment, for performing printing on a plurality of sheets S on a consecutive basis, the controller 2 sets a predetermined standby time period Tw in a case where a subsequent sheet (hereinafter simply referred to as "a second sheet S") is not supplied from the tray 21, 31 or 41 and conveyance of the second sheet S has not yet been started upon elapse of a prescribed time period from a timing at which a trailing edge of a preceding sheet (hereinafter simply referred to as "a first sheet S") is detected by the back sensor 28C. In this case, the controller 2 permits the YMC clutch 140A and the K clutch 140K to rotate the respective cams 150 to move the developing rollers 61 from the respective contact positions to the separated positions after development of an image to be transferred to the first sheet S is completed on each photosensitive drum 50.

Here, the prescribed time period is set as a fourth time period T4 (described later) for color printing, and as a fourth time period T24 (described later) for monochromatic printing. Incidentally, the prescribed time period may be "0". That is, the controller 2 may set the standby time period Tw in a case where the second sheet S is not conveyed yet when the trailing edge of the first sheet S is detected by the back sensor 28C, and at the same time, the controller 2 may permit the developing rollers 61 to move from the contact positions to the separated positions after development of an image to be transferred to the first sheet S is completed.

Further, the controller 2 permits the sheet feed mechanism 22 to start supply of the second sheet S from one of the first tray 21, the second tray 31 and the manual insertion tray 41 toward the photosensitive drums 50 in a case where preparation of data of images to be transferred to the second sheet S is completed and the standby time period Tw has elapsed after elapse of the prescribed time period (fourth time period T4 or T24). Then, the controller 2 permits the YMC clutch 140A and/or the K clutch 140K to rotate the corresponding cams 150 in accordance with the conveyance of the second sheet S, thereby moving the developing rollers 61 from the separated positions to the contact positions. Incidentally, the "completion of data preparation" implies completion of a processing to expand image data contained in a print job received in the image-forming apparatus 1 into a raster scan format.

The standby time period Tw is equal to or greater than a time period obtained by subtracting a second arrival time period TA2, TA3, TA4 (described later) from a first arrival time period TA1 (described later). The first arrival time period TA1 starts at a timing when the developing roller 61 (the first developing roller 61Y in a case of color printing and the fourth developing roller 61K in a case of monochromatic printing) starts separating from the corresponding photosensitive drum 50, and ends at a timing when the separated developing roller 61 is again brought into contact with the photosensitive drum 50 and a leading end position of the toner image (developed image) on the photosensitive drum 50 reaches a transfer position between the photosensitive drum 50 and the corresponding transfer roller 74 for transferring the toner image to the second sheet S.

Further, the second arrival time period TA2, TA3, TA4 starts from a timing when the supply of the second sheet S from the sheet tray 21, 31 or 41 is started and ends at a timing when a leading end of an image-forming region of the second sheet S in the sheet conveying direction reaches the transfer position. The image-forming region is a region on the surface of the sheet S where the toner image is actually formed.

In the present embodiment, the controller 2 sets the standby time period Tw to be longer as the length of the sheet conveying path up to the photosensitive drum 50Y is shorter. In other words, the controller 2 sets the standby time period Tw to be shorter as the length of the sheet conveying path up to the photosensitive drum 50Y is longer.

Figure 26:
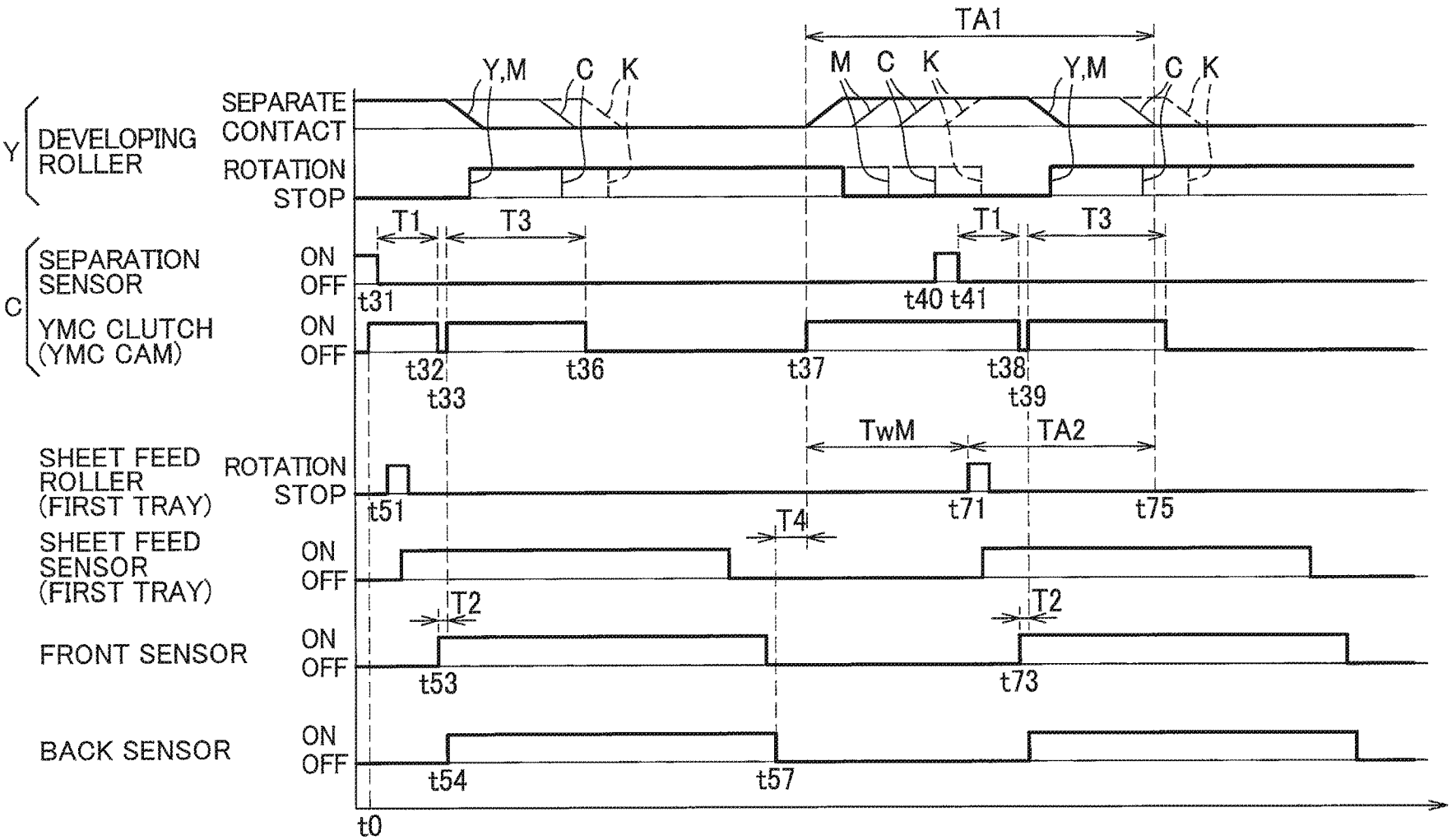
FIG. 26 is a timing chart for description of relationship between each output from each sensor and operations of a sheet feed roller, the YMC clutch and the developing rollers of respective colors for successive color printing on a plurality of sheets, and illustrating a case where a subsequent sheet is supplied from a first tray in the image-forming apparatus according to the embodiment.

Specifically, regarding the first tray 21, the controller 2 sets the standby time period Tw to be a first standby time period TwM. As illustrated in FIG. 26, the first standby time period TwM is obtained by subtracting, from the first arrival time period TA1, the second arrival time period TA2 starting from the timing of start of the supply of the second sheet S from the first tray 21 to the timing at which the leading end of the image-forming region of the second sheet S reaches the transfer position.

Figure 27:
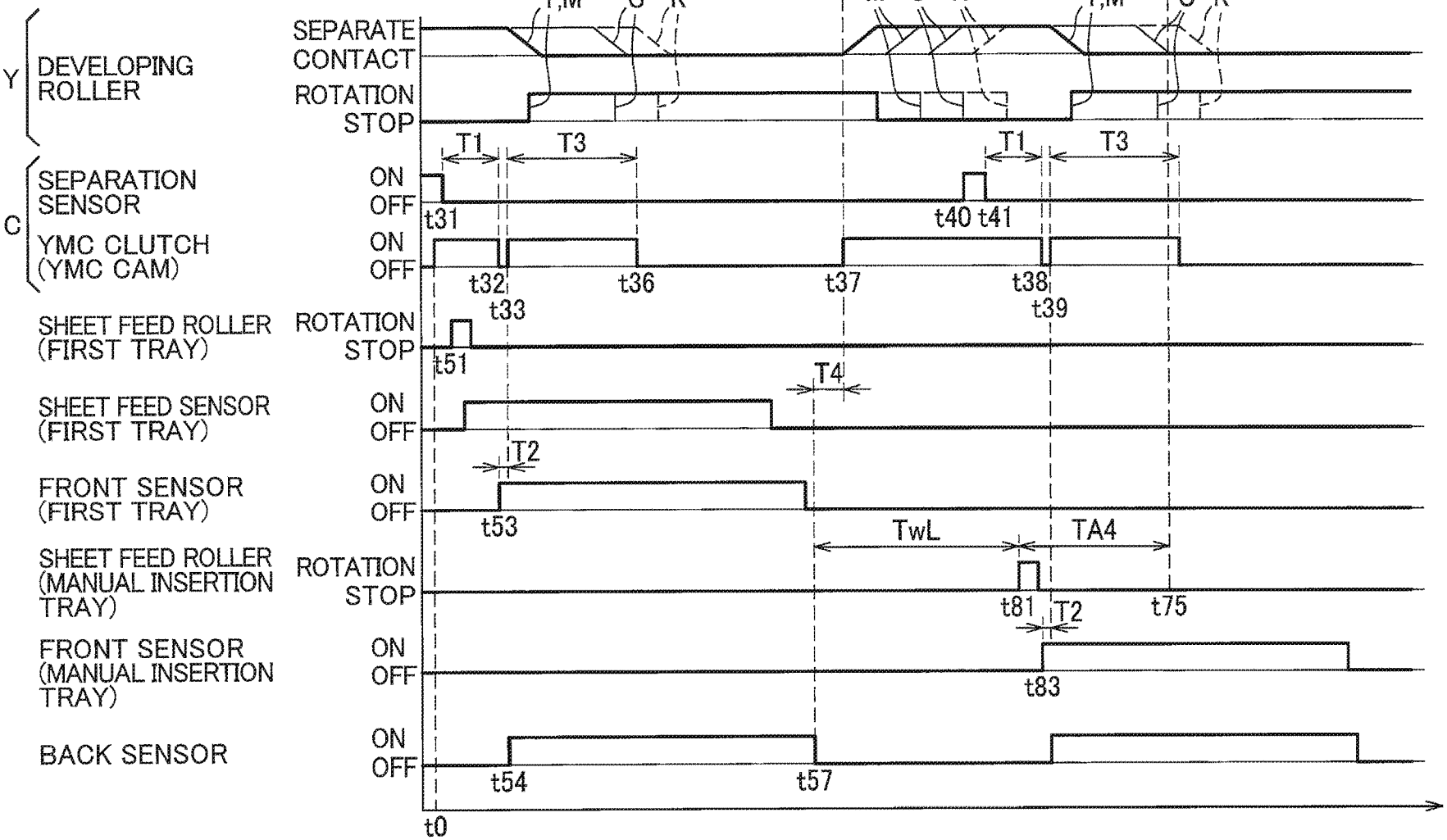
FIG. 27 is a timing chart for description of relationship between each output from each sensor and operations of the sheet feed roller, the YMC clutch and the developing rollers of respective colors for successive color printing on a plurality of sheets, and illustrating a case where a subsequent sheet is supplied from a manual insertion tray in the image-forming apparatus according to the embodiment.

Further, regarding the manual insertion tray 41, the length of the sheet conveying path from the manual insertion tray 41 to the photosensitive drum 50Y is shorter than the length of the sheet conveying path from the first tray 21 to the photosensitive drum 50Y. Hence, the controller 2 sets the standby time period Tw to be a second standby time period TwL longer than the first standby time period TwM. Specifically, as illustrated in FIG. 27, the second standby time period TwL is obtained by subtracting, from the first arrival time period TA1, the second arrival time period TA4 starting from the timing of start of the supply of the second sheet S from the manual insertion tray 41 to the timing at which the leading end of the image-forming region of the second sheet S reaches the transfer position.

Figure 28:
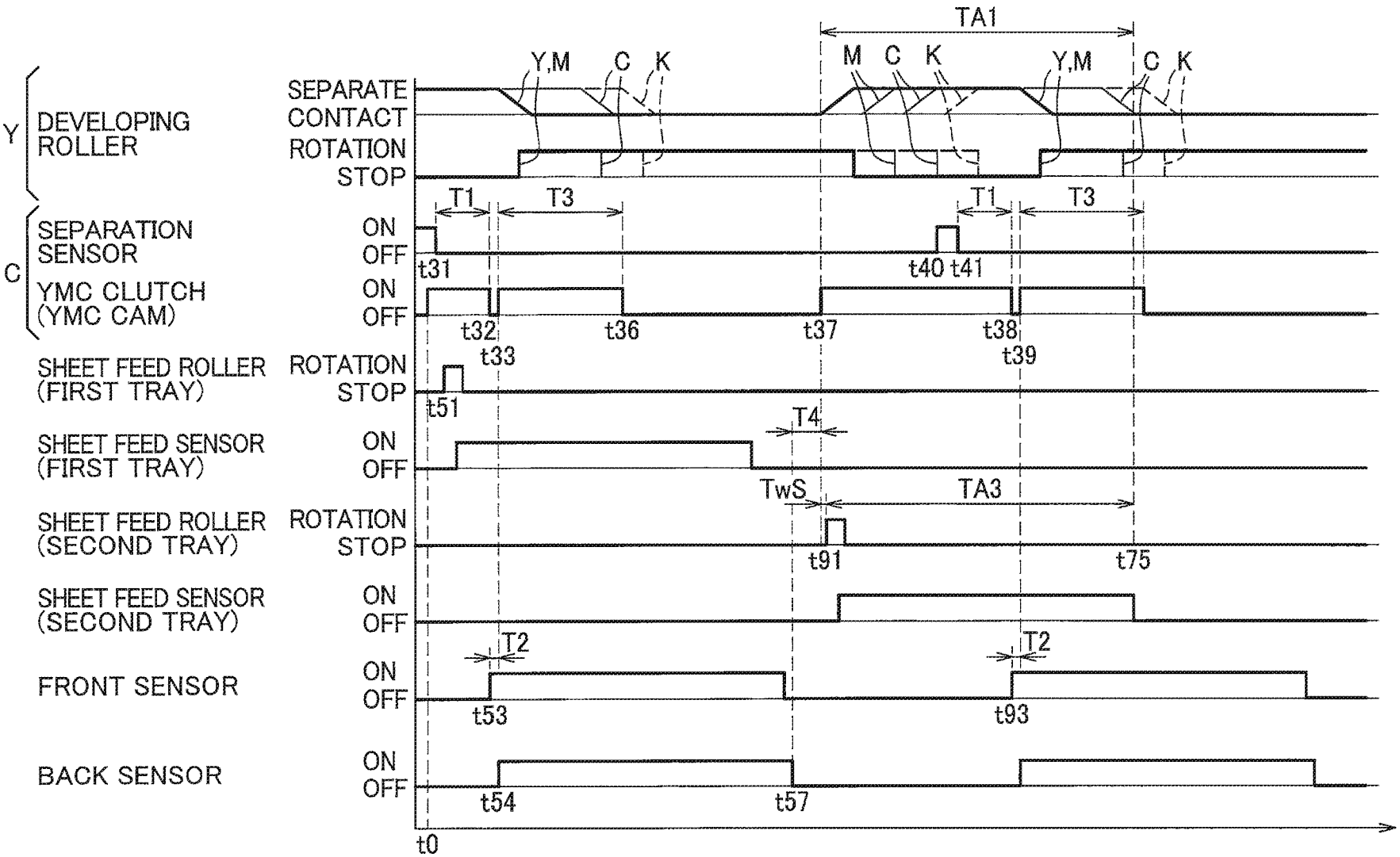
FIG. 28 is a timing chart for description of relationship between each output from each sensor and operations of the sheet supply roller, the YMC clutch and the developing rollers of respective colors for successive color printing on a plurality of sheets, and illustrating a case where a subsequent sheet is supplied from a second tray in the image-forming apparatus according to the embodiment.

Further, regarding the second tray 31, the length of the sheet conveying path from the second tray 31 to the photosensitive drum 50Y is longer than the length of the sheet conveying path from the first tray 21 to the photosensitive drum 50Y. The controller 2 therefore sets the standby time period Tw to be a third standby time period TwS shorter than the first standby time period TwM. Specifically, as illustrated in FIG. 28, the third standby time period TwS is obtained by subtracting, from the first arrival time period TA1, the second arrival time period TA3 starting from the timing of start of the supply of the second sheet S from the second insertion tray 31 to the timing at which the leading end of the image-forming region of the second sheet S reaches the transfer position.

The standby time periods TwL, TwM, TwS are stored in advance in the ROM of the controller 2. Incidentally, since the second arrival time period tends to be greater for a sheet tray providing a greater path length up to the photosensitive drum 50Y, there may be a situation where a value of subtraction obtained by subtracting the second arrival time period from the first arrival time period TA1 may be equal to or less than zero. In such a case, the standby time period Tw may be set to zero.

Upon setting the standby time period Tw, the controller 2 counts down the standby time period Tw every several milliseconds. Incidentally, the down-counting may be started immediately after setting the standby time period Tw. Alternatively, the down-counting may be started upon completion of movement to the separated position from the contact position of the developing roller 61 (the first developing roller 61Y in a case of color printing and the fourth developing roller 61K in a case of monochromatic printing) that finishes development of the image to be transferred to the first sheet S.

Further, the controller 2 determines whether the standby time period Tw has elapsed in a case where the following first to third conditions are met. The first condition is a completion of preparation of data of images to be transferred to the first sheet S. The second condition is that the image-forming apparatus 1 is ready for performing an image-forming operation upon completion of a warming up operation such as preheating of the fixing unit 80. The third condition is elapse of a time period that ensures that a subsequent sheet (second sheet S) does not cause jamming with a preceding sheet (first sheet S).

For example, the third condition is considered to be met in a case where a predetermined time period has elapsed from supply of the first sheet S so that supply of the second sheet S may not cause sheet jamming with the preceding first sheet S. The third condition is also considered to be met in a case where, at the time of elapse of the predetermined time period, the preceding first sheet S has been discharged out of the housing 10.

Further, in the present embodiment, the controller 2 calculates and acquires a sheet interval between a trailing edge of the first sheet S and a leading edge of the second sheet S in the sheet conveying direction based on signals transmitted from the sheet feed sensors 28A, 38A, the front sensors 28B, 48B, and the back sensor 28C. At the timing when the predetermined time period (the fourth time period T4 or T24) has elapsed from the timing of detection of the trailing edge of the first sheet S by the back sensor 28C, the controller 2 controls the YMC clutch 140A and/or the K clutch 140K to rotate the cams 150 in order to move the developing rollers 61 from the contact positions to the separated positions after completion of development of the images to be transferred to the first sheet S, in a case where conveyance of the second sheet S is already started and the sheet interval is determined to be greater than a predetermined sheet interval.

Thereafter, the controller 2 controls the YMC clutch 140A and/or the K clutch 140K to rotate the cams 150 to move the developing rollers 61 from the separated positions to the contact positions in accordance with the conveyance of the second sheet S. Specifically, the controller 2 permits the cams 150 to temporarily stop rotating after the developing rollers 61 are separated from the photosensitive drums 50, and executes a control for matching the conveyance of the second sheet S with the contacting timing of the developing rollers 61. Then, the controller 2 permits the cams 150 to rotate at the restart timing after the detection of the leading edge of the second sheet S by the front sensor 28B to bring the developing rollers 61 into contact with the corresponding photosensitive drums 50.

On the other hand, at a timing when the predetermined time period (the fourth time period T4 or T24) has elapsed from the timing of detection of the trailing edge of the first sheet S by the back sensor 28C, the controller 2 controls the cams 150 not to rotate to maintain the contact positions of the developing rollers 61 for the development of the images to be transferred to the second sheet S, in a case where conveyance of the second sheet S is started and the sheet interval is determined to be equal to or shorter than the predetermined sheet interval.

The predetermined sheet interval is set such that, in a case of color printing, a time lag from the timing at which the trailing edge of the first sheet S is detected by the front sensor 28B, 48B to the timing at which the leading edge of the second sheet S is detected by the front sensor 28B, 48B is equal to or longer than a time period required for the first developing roller 61Y to move to the contact position, then to the separated position, and then to the contact position during a single rotation of the cam 150Y.

Further, in a case of monochromatic printing, the predetermined sheet interval is set such that a time lag from the timing at which the trailing edge of the first sheet S is detected by the back sensor 28C to the timing at which the leading edge of the second sheet S is detected by the back sensor 28C is equal to or longer than a time period required for the fourth developing roller 61K to move to the contact position then to the separated position, and then to the contact position during a single rotation of the cam 150K.

Accordingly, a sheet interval equal to or shorter than the predetermined sheet interval means such a short period that the developing roller 61 cannot be timely brought into contact with the corresponding photosensitive drum 50 by the time when the photosensitive drum 50 starts development after separation of the developing roller 61 from the photosensitive drum 50.

Next, processing performed by the controller 2 will be described with reference to FIGS. 16 and 17. The controller 2 performs a contact/separation process for the developing roller 61 as illustrated in FIG. 16, in parallel with a sheet feed process as illustrated in FIG. 17.

Figure 16:
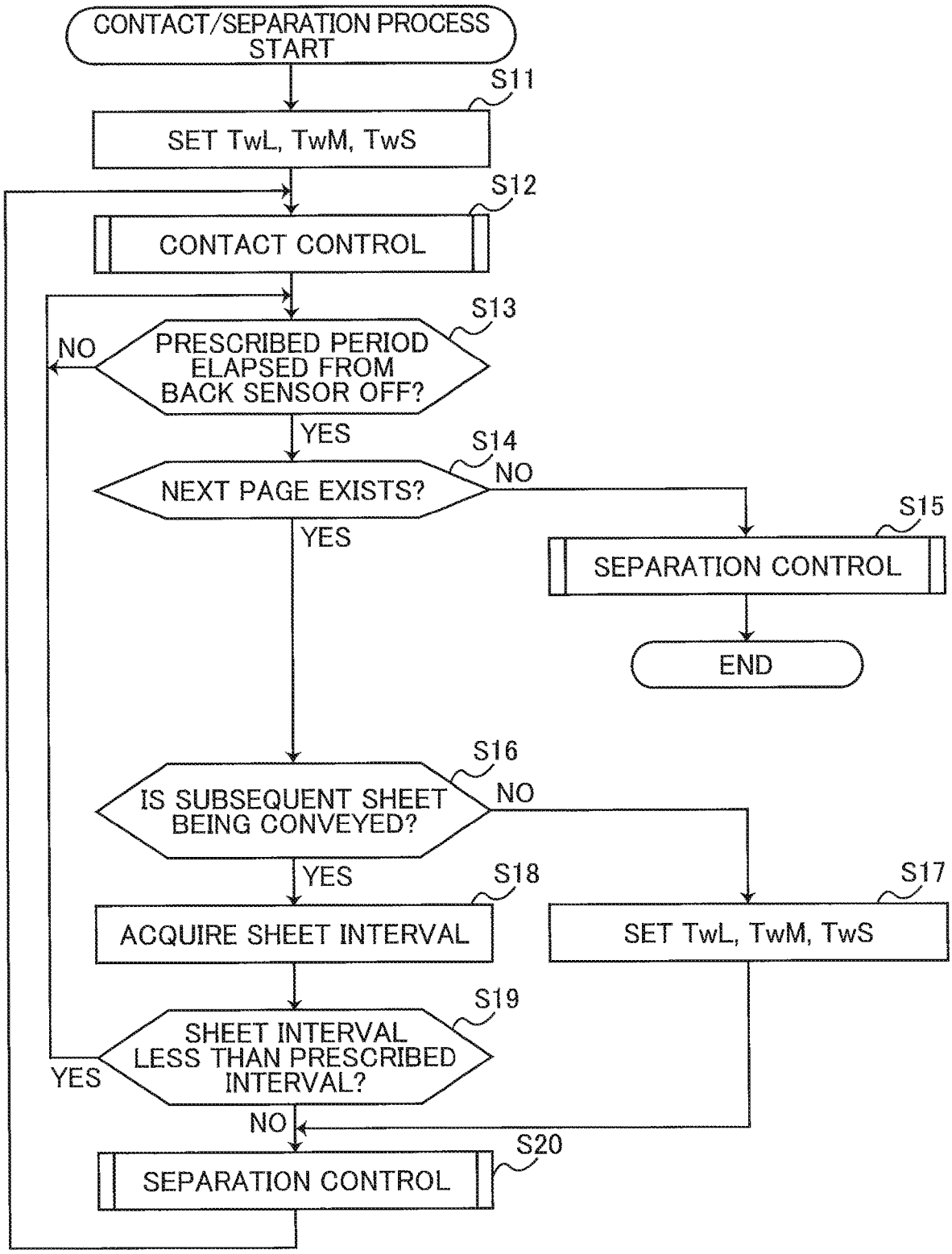
FIG. 16 is a flowchart illustrating an example of a process to perform contact/separation of the developing rollers in the image-forming apparatus according to the embodiment.

As illustrated in FIG. 16, in response to receipt of a print job, the controller 2 reads and sets in S11 the standby time period Tw (the second standby time period TwL of the manual insertion tray 41, the first standby time period TwM of the first tray 21, and the third standby time period TwS of the second tray 31) from the ROM. The controller 2 down-counts each of the standby time periods TwL, TwM, TwS every 1 millisecond (ms) in accordance with the setting of the standby time periods TwL, TwM, TwS.

Figure 17:
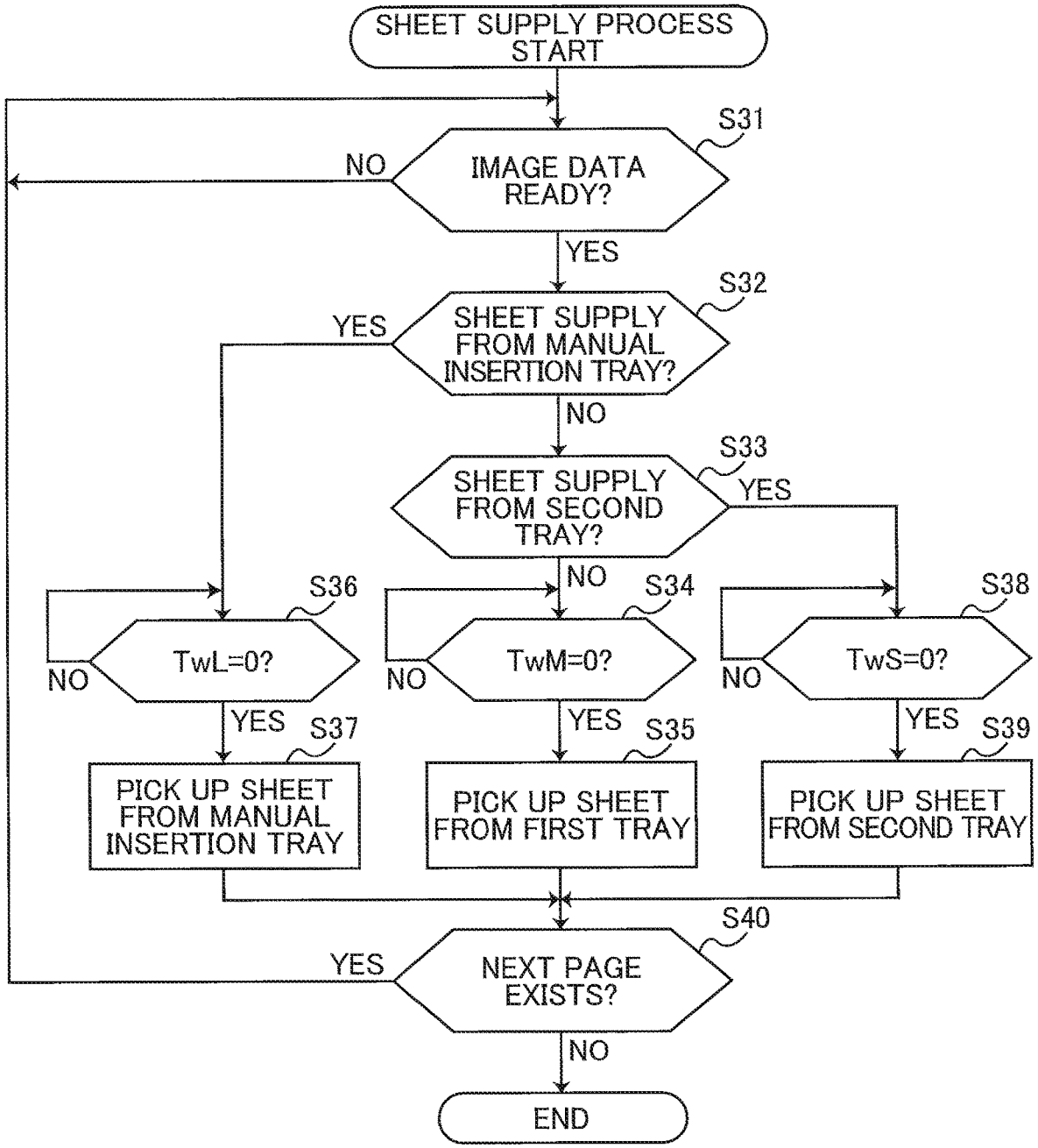
FIG. 17 is a flowchart illustrating an example of a process to perform sheet supply in the image-forming apparatus according to the embodiment.

Further, as illustrated in FIG. 17, after receipt of the print job, the controller 2 determines in S31 whether preparation of data of an image to be transferred to the sheet S is completed. In a case where preparation of the image data is completed (S31: Yes), the controller 2 determines in S32 whether the sheet supply source is the manual insertion tray 41 on a basis of information about the tray of the supply source determined by information contained in the print job on the supply source of the sheet S and on a size of the sheet S (S32).

In a case where the sheet supply source is not the manual insertion tray 41 (S32: No), the controller 2 determines in S33 whether the sheet supply source is the second tray 31. In a case where the sheet supply source is not the second tray 31 (S33: No), the sheet supply source is the first tray 21. Therefore, the controller 2 determines whether the down-counting of the first standby time period TwM reaches "0" (S34). In a case where the down-counting of the first standby time period TwM reaches "0" (S34: Yes), the controller 2 drives the sheet supply roller 23 for picking-up a sheet S accommodated in the first tray 21 to start conveying of the sheet S (S35).

On the other hand, in a case where the sheet supply source is the manual insertion tray 41 (S32: Yes), the controller 2 determines whether the down-counting of the second standby time period TwL reaches "0" (S36). In a case where the down-counting of the second standby time period TwM reaches "0" (S36: Yes), the controller 2 drives the sheet supply roller 43 for picking up a sheet S accommodated in the manual insertion tray 41 to start conveying of the sheet S (S37).

Further, in a case where the sheet supply source is the second tray 31 (S33: Yes), the controller 2 determines whether the down-counting of the third standby time period TwS reaches "0" (S38). In a case where the down-counting of the third standby time period TwS reaches "0" (S38: Yes), the controller 2 drives the sheet supply roller 33 for picking-up a sheet S accommodated in the second tray 31 to start conveying of the sheet S (S39).

After the sheet pick-up, the controller 2 determines in S40 whether a subsequent page exists for printing. In a case where the subsequent page exists (S40: Yes), the routine returns to the step S31. In a case where no subsequent page exists (S40: No), the sheet supply process is terminated.

Turning back to FIG. 16, after setting the standby time period Tw in the step S11, the controller 2 performs contact control process for contacting the developing roller 61 with the photosensitive drum 50 (S12). Th controller 2 then determines in S13 whether the predetermined time period (the fourth time period T4 in a case of color printing and the fourth time period T24 in a case of monochromatic printing) has elapsed from a timing at which the back sensor 28C is turned off after the trailing edge of the conveyed sheet S has moved past the back sensor 28C.

In a case where the predetermined time period is elapsed from the OFF timing of the back sensor 28C (S13: Yes), the controller 2 determines whether the subsequent page exists in S14. In a case of printing on only a single sheet S, since no subsequent page exists (S14: No), the routine proceeds to S15 where separation control process is performed for separating the developing roller 61 from the photosensitive drum 50. The contact/separation process is terminated upon termination of the separation control process in S15.

In a case of printing on a plurality of sheets S, the subsequent page (second sheet S) is determined to exist in S14 (S14:Yes). The controller 2 then determines in S16 whether the second sheet S is already in the midst of conveyance (S16). The controller 2 acquires a sheet interval between the first sheet S and the second sheet S in S18 in a case where the second sheet S has already been conveyed (S16:Yes). The controller 2 then determines in S19 whether the sheet interval is equal to or less than the predetermined sheet interval.

In a case where the sheet interval is not less than the predetermined sheet interval, i.e., greater than the predetermined sheet interval (S19: No), the controller 2 executes the separation control process in S20 after termination of the development of images to be transferred to the first sheet S. Upon termination of the separation control process, the controller 2 starts the contact control process in S12 so that the developing roller 61 is brought into contact with the photosensitive drum 50 for development of the image to be transferred to the second sheet S. Then, upon termination of the contact control process, the routine proceeds to S13.

On the other hand, in a case where the sheet interval is equal to or less than the predetermined sheet interval (S19: Yes), development of the image to be transferred to the second sheet S is performed while maintaining the developing roller 61 at the contact position without moving the developing roller 61 to the separated position. Then, the routine proceeds to the step S14 upon elapse of the predetermined time period (fourth time period T4 or T24) from the turning OFF timing of the back sensor 28C at which the trailing edge of the second sheet S moves past the back sensor 28C.

<Details of the Contact Control Process and the Separation Control Process>

Figure 18A:
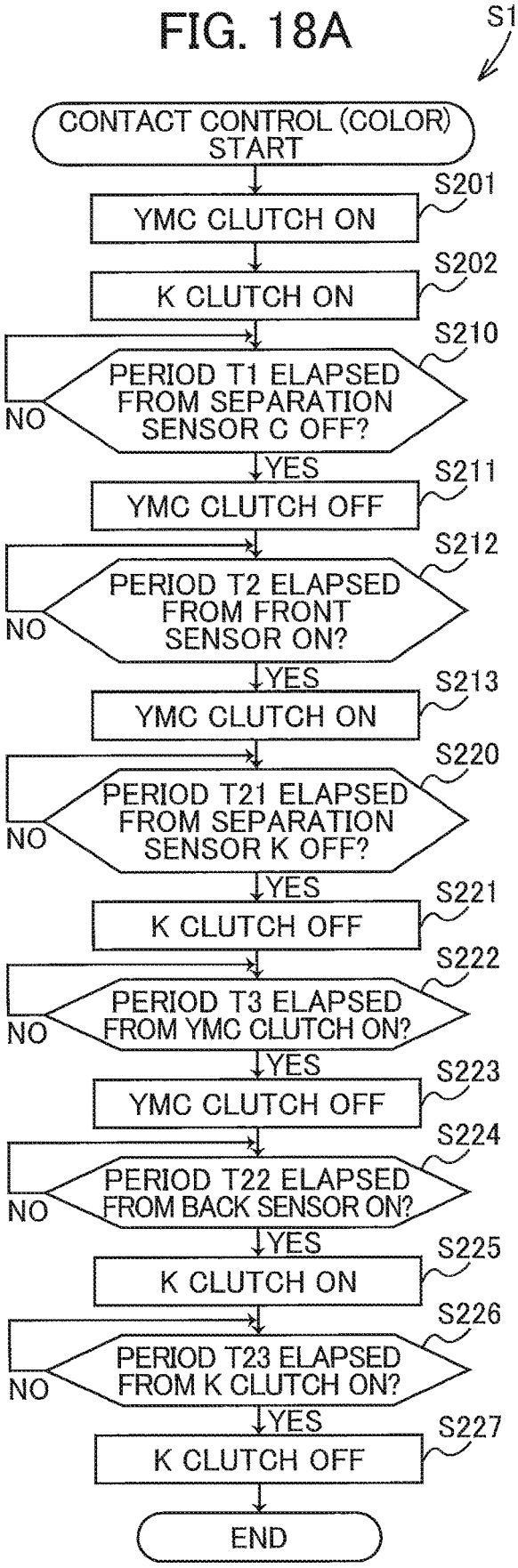
FIG. 18A is a flowchart illustrating a contact control process for color printing in the image-forming apparatus according to the embodiment.

Here, the contact control process (S12) and the separation control process (S15, S20) for color printing on a single sheet S will be described in detail with reference to flowcharts illustrated in FIGS. 18A and 18B and a timing chart illustrated in FIG. 19.

Figure 19:
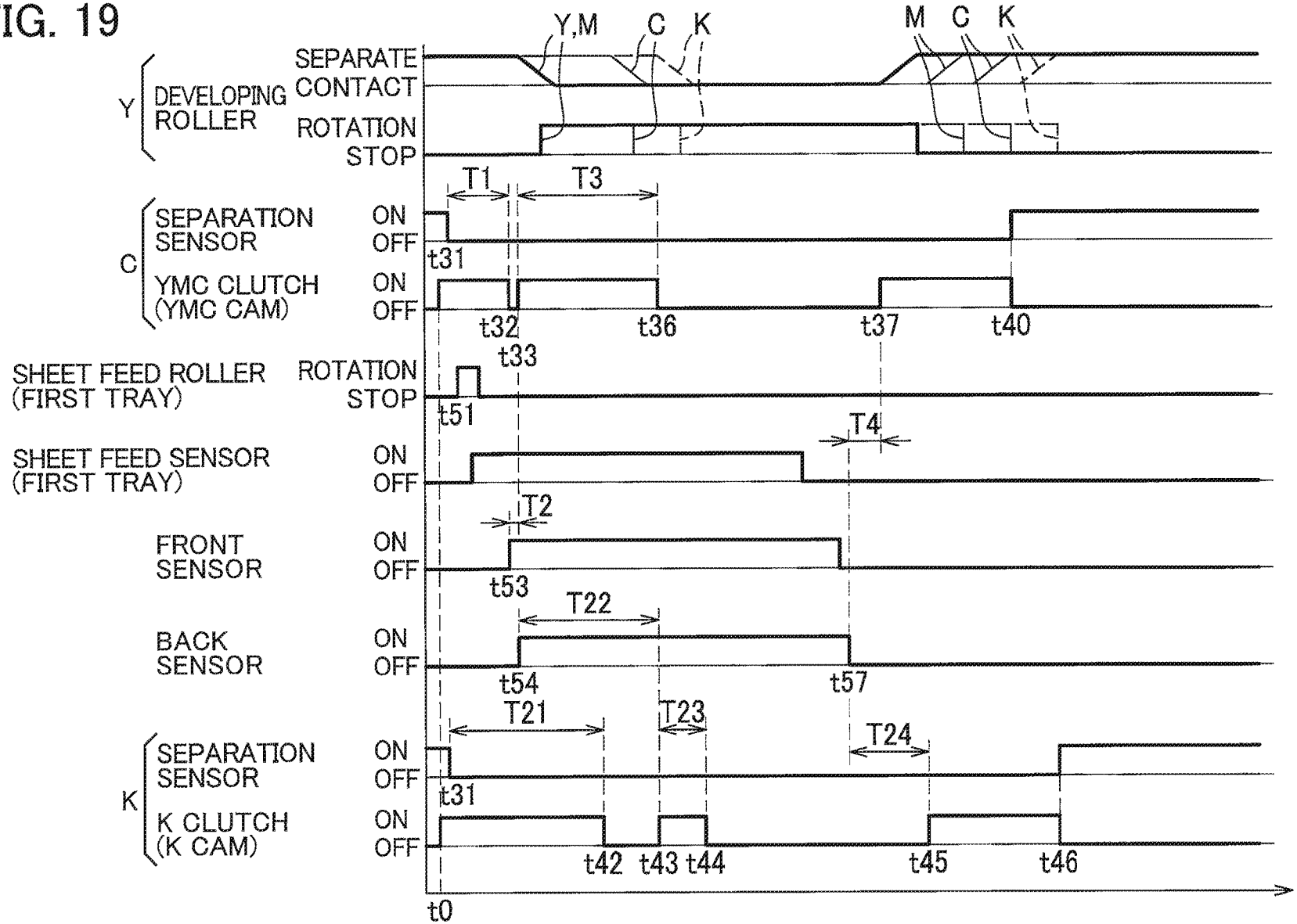
FIG. 19 is a timing chart for description of controls to a YMC clutch and a K clutch in response to output from each sensor for color printing in the image-forming apparatus according to the embodiment.

Incidentally, in the uppermost section in FIG. 19, operation timing of the first developing roller 61Y for the color of yellow is indicated by a bold line, and operation timing of the second through fourth developing rollers 61M, 61C and 61K for the colors of magenta, cyan and black are respectively indicated by normal lines and a broken line those being partly overlapped with the bold line.

In a case of color printing, all the developing rollers 61 are at their separated positions prior to image forming operation. Upon start of the contact control process of FIG. 18A, in order to successively move the developing rollers 61 to the contact positions, the controller 2 controls the YMC clutch 140A to be turned ON (S201, t0) and permits the K clutch 140K to be turned ON (S202, t0). As a result, the cams 150Y, 150M, 150C and 150K start rotating, and immediately thereafter, the separation sensors 4C and 4K are turned OFF (t31).

After picking up the sheet S for example from the first tray 21 and starting the sheet conveyance (S35 in FIG. 17, t51), the controller 2 determines in S210 whether the first time period T1 has elapsed from the timing (t31) at which the separation sensor 4C for the color of cyan outputs the OFF signal during a period from the start of the sheet conveyance until the arrival of the sheet S at the first photosensitive drum 50Y. In a case where the first time period T1 is determined to be elapsed (S210: Yes), the controller 2 controls the YMC clutch 140A to be turned OFF (S211, t32) to stop rotations of the cams 150Y, 150M and 150C at the temporary stop timing.

The first time period T1 is so set that, at the temporary stop timing, the contact portion 172 of the cam follower 170 for the color of yellow is positioned on a region of the second holding surface F2, the region being closest to the second guide surface F4 (see FIG. 15B). Hence, immediately after the restart of rotations of the cams 150Y, 150M and 150C, the cam follower 170 for the color of yellow is moved onto the second guide surface F4, so that the first developing roller 61Y starts moving to the contact position.

Then, the controller 2 determines in S212 whether the second time period T2 has elapsed from a timing (t53) at which the front sensor 28B is turned ON (at which the leading edge of the sheet S moves past the front sensor 28B). In a case where the second time period T2 has elapsed (S212: Yes), the controller 2 permits the YMC clutch 140A to be turned ON (S213) to restart rotations of the cam 150Y, 150M and 150C at the restart timing (t33). The second time period T2 is so set that the toner development on the first photosensitive drum 50Y by the first developing roller 61Y can be completed by the time when the toner image is transferred from the photosensitive drum 50Y to the conveyed sheet S.

Further, the controller 2 determines in S220 whether a first time period T21 is elapsed from the timing (t31) at which the separation sensor 4K for the color of black outputs the OFF signal during a period from the start of conveyance of the sheet S until arrival of the sheet S at the fourth photosensitive drum 50K. In a case where the first time period T21 is elapsed (S220: Yes), the controller 2 turns the K clutch 140K OFF (S221) to stop rotation of the cam 150K at the temporary stop timing (t42).

The first time period T21 is set so that, at the temporary stop timing, the contact portion 172 of the cam follower 170 for the color of black is positioned on a region of the second holding surface F2, the region being closest to the second guide surface F4 (see FIG. 15B). Hence, immediately after the restart of rotation of the cam 150K, the cam follower 170 for the color of black is moved to the second guide surface F4, so that the fourth developing roller 61K starts moving to the contact position. Incidentally, the first time period T21 is different from the first time period T1.

Then, the controller 2 determines in S222 whether a third time period T3 has elapsed from the restart timing (t33) at which the YMC clutch 140A is turned ON. In a case where the third time period T3 has elapsed (S222: Yes), the controller 2 permits the YMC clutch 140A to be turned OFF (S223, t36) to stop rotations of the cams 150Y, 150M and 150C. The third time period T3 is set to such a period of time within which the first developing roller 61Y, the second developing roller 61M, and the third developing roller 61C all move to the contact positions.

Then, the controller 2 determines in S224 whether a second time period T22 has elapsed from a timing (t54) at which the back sensor 28C is turned ON (at which the leading edge of the sheet S moves past the back sensor 28C). In a case where the second time period T22 is elapsed (S224: Yes), the controller 2 permits the K clutch 140K to turn ON (S225) to start rotation of the cam 150K at a timing t43. The second time period T22 is so set that the toner development on the fourth photosensitive drum 50K by the fourth developing roller 61K can be completed by the time when the toner image is transferred from the photosensitive drum 50K to the conveyed sheet S. Hence, the fourth developing roller 61K can move to the contact position at a timing immediately before exposure to the third photosensitive drum 50C is started.

Next, the controller 2 determines in S226 whether a third time period T23 has elapsed from the turning ON timing (t43) of the K clutch 140K. In a case where the third time period T23 has elapsed (S226: Yes), the controller 2 permits the K clutch 140K to turn OFF (S227, t44) to stop rotation of the cam 150K to end the contact control process. The third time period T23 is set to such a period of time within which the fourth developing roller 61K moves to the contact position.

In the case of printing on a single sheet S, since there is no next page (S14:No in FIG. 16), the controller 2 performs the separation control process in S15 of FIG. 16.

Figure 18B:
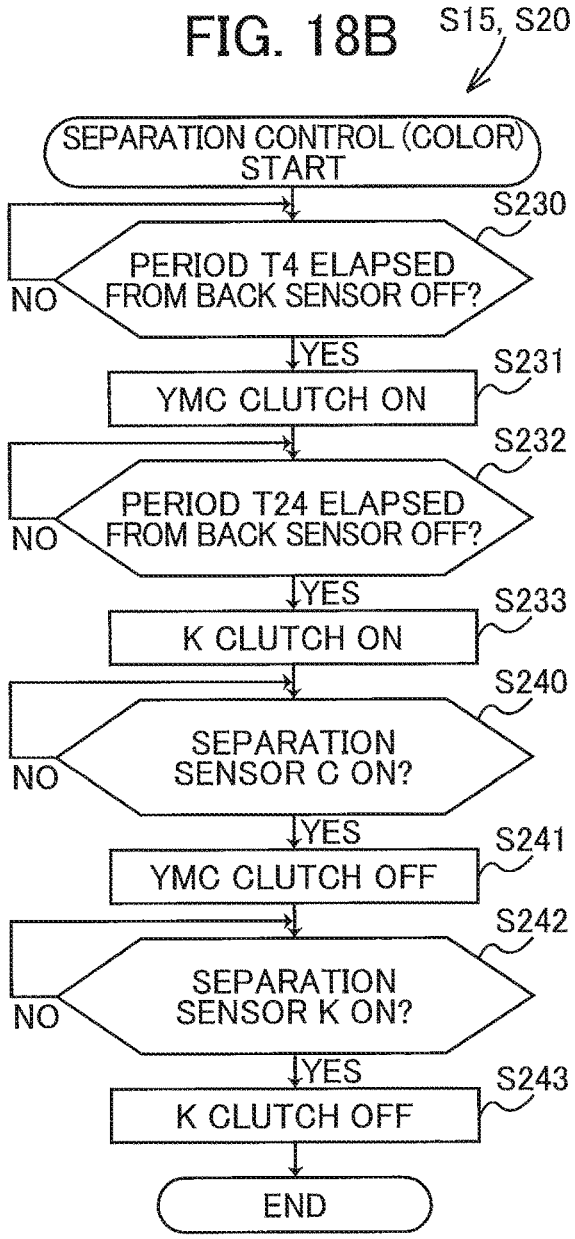
FIG. 18B is a flowchart illustrating a separation control process for color printing in the image-forming apparatus according to the embodiment.

Specifically, as illustrated in FIG. 18B, the controller 2 determines in S230 whether a fourth time period T4 has elapsed from a timing (t57) at which the back sensor 28C is turned OFF. In a case where the fourth time period T4 has elapsed (S230: Yes), the controller 2 permits the YMC clutch 140A to turn ON (S231, t37) to rotate the cams 150Y, 150M and 150C, to thus successively start separation of the first developing roller 61Y, the second developing roller 61M, and the third developing roller 61C from the respective photosensitive drums 50Y, 50M and 50C.

The fourth time period T4 is set to such a period of time within which the first developing roller 61Y can move to the separated position after the completion of development on the first photosensitive drum 50Y by the first developing roller 61Y and immediately after the completion of image transfer from the first photosensitive drum 50Y to the sheet S.

The controller 2 then determines in S232 whether the fourth time period T24 has elapsed from the OFF timing (t57) of the back sensor 28C. In a case where the fourth time period T24 has elapsed (S232: Yes), the controller 2 permits the K clutch 140K to turn ON (S233, t45) to rotate the cam 150K. The fourth time period T24 is set to such a period of time within which the fourth developing roller 61K can be moved to the separated position after completion of development on the fourth photosensitive drum 50K by the fourth developing roller 61K and immediately after the completion of image transfer from the fourth photosensitive drum 50K to the sheet S.

Then, the controller 2 determines in S240 whether the separation sensor 4C for the color of cyan outputs the ON signal (separation signal). In a case where the ON signal is outputted (S240: Yes), the controller 2 controls the YMC clutch 140A to be turned OFF (S241, t40) to stop rotations of the cams 150Y, 150M and 150C.

The controller 2 then determines in S242 whether the separation sensor 4K for the color of black outputs the ON signal. In a case where the ON signal is outputted (S242: Yes), the controller 2 permits the K clutch 140K to turn OFF (S243, t46) to stop rotation of the cam 150K to end the separation control process.

Figure 20:
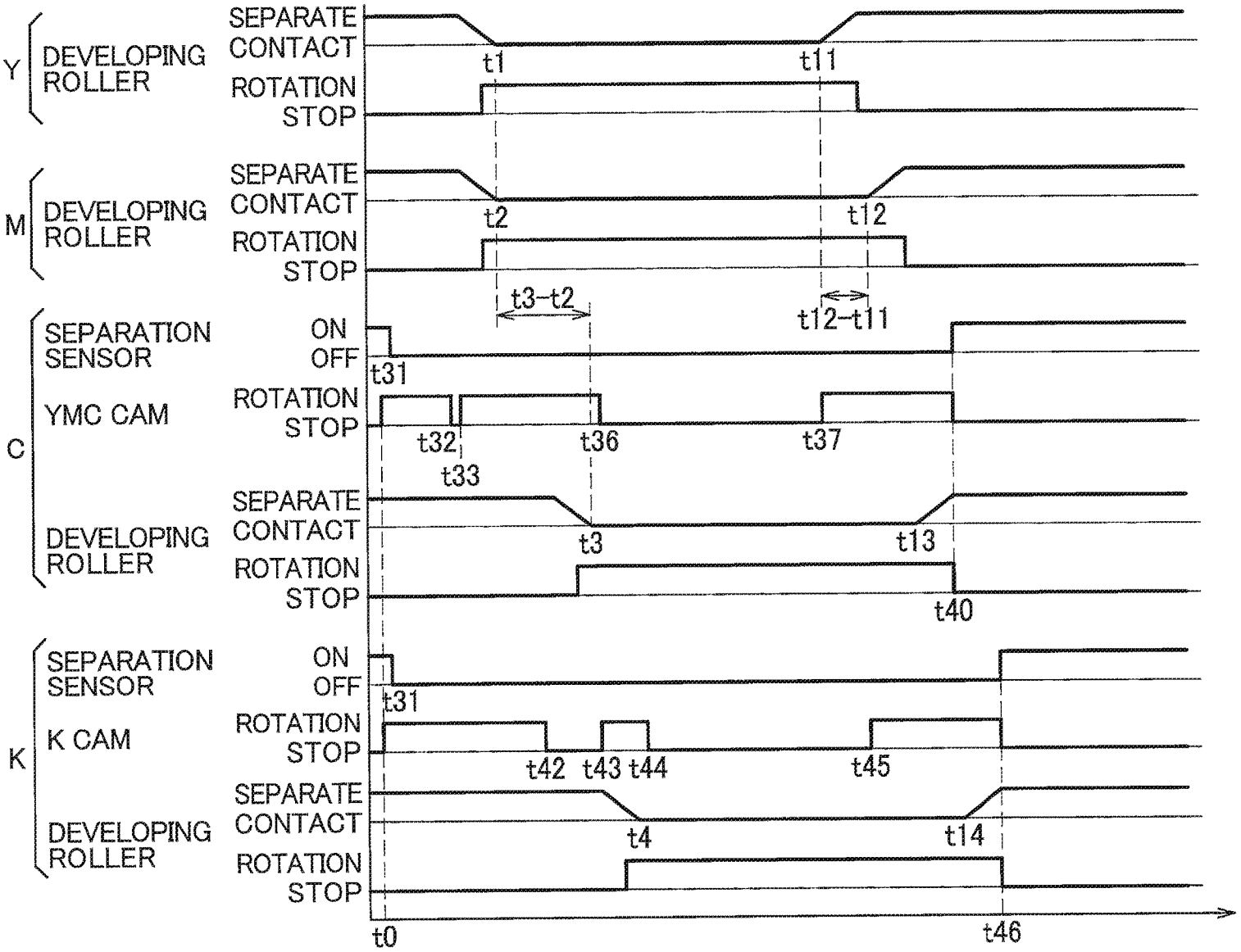
FIG. 20 is a timing chart for description of operations of the cam, separation sensors, and developing rollers of respective colors for color printing in the image-forming apparatus according to the embodiment.

In this way, the developing rollers 61 are sequentially moved from the separated positions to the contact positions, and then from the contact positions to the separated positions after completion of printing on each sheet S. Specifically, as illustrated in FIG. 20, the first developing roller 61Y is brought into contact with the first photosensitive drum 50Y at the time t1; the second developing roller 61M is brought into contact with the second photosensitive drum 50M at the time t2; the third developing roller 61C is brought into contact with the third photosensitive drum 50C at a time t3; and the fourth developing roller 61K is brought into contact with the fourth photosensitive drum 50K at a time t4.

In the depicted embodiment, the following expressions are satisfied: $t1=t2$, $t1<t3$, $t2<t3$, and $t3<t4$. Also, a relationship $|t1-t2|<|t2-t3|$ is met, provided that $|t1-t2|$ denotes a time period from the time t1 to the time t2 and $|t2-t3|$ denotes a time period from the time t2 to the time t3. Incidentally, a value of later time is greater than a value of earlier time; a value obtained by subtracting the earlier time from the later time is a positive value; and a value obtained by subtracting the later time from the earlier time is a negative value. An absolute value obtained by subtracting a time from a time implies a length of time. With respect to the relationship between the time t1 and the time t2, t2 may be earlier than t1 ($t2<t1$). In the latter case, t241 becomes a negative value. In a case where the time t2 is earlier than the time t1, the second developing roller 61M is moved to the contact position at an earlier timing than otherwise.

Further, in the image-forming apparatus 1, the first developing roller 61Y is separated from the first photosensitive drum 50Y at a time t11; the second developing roller 61M is separated from the second photosensitive drum 50M at a time t12; the third developing roller 61C is separated from the third photosensitive drum 50C at a time t13; and the fourth developing roller 61K is separated from the fourth photosensitive drum 50K at a time t14.

In the depicted embodiment, a relationship $t11<t12<t13<t14$ is satisfied. Here, a relationship $|t1-t2|<|t11-t12|$ is met, in which $|t1-t2|$ represents the time period from the time t1 to the time t2 and $|t11-t12|$ represents a time period from the time t11 to the time t12.

Figure 21A:
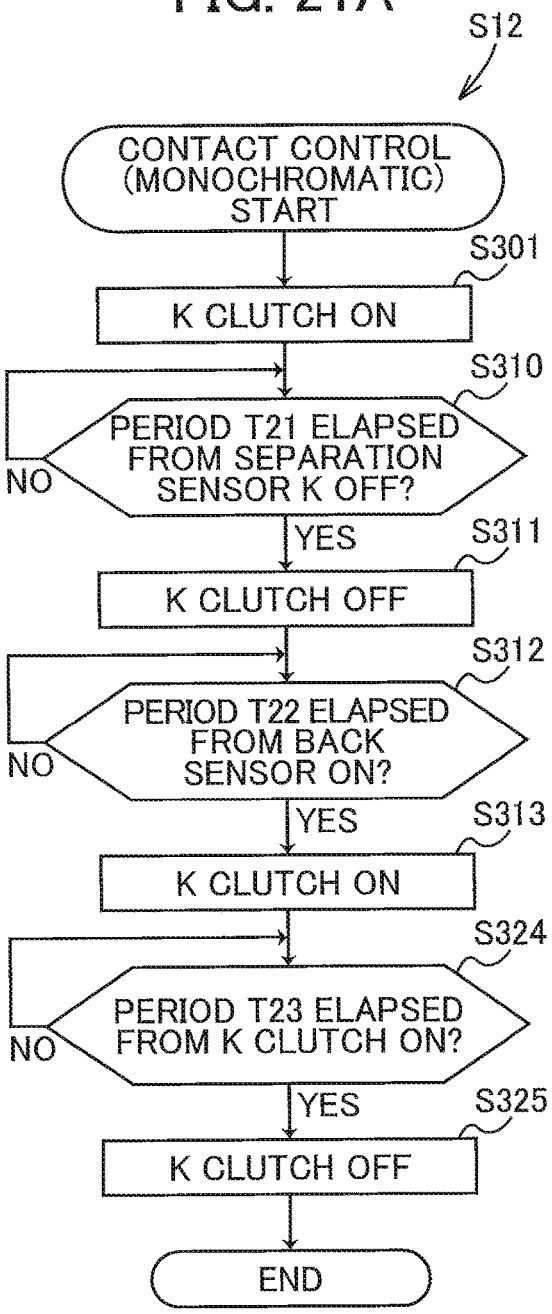
FIG. 21A is a flowchart for description of the contact control process for monochromatic printing in the image-forming apparatus according to the embodiment.
Figure 21B:
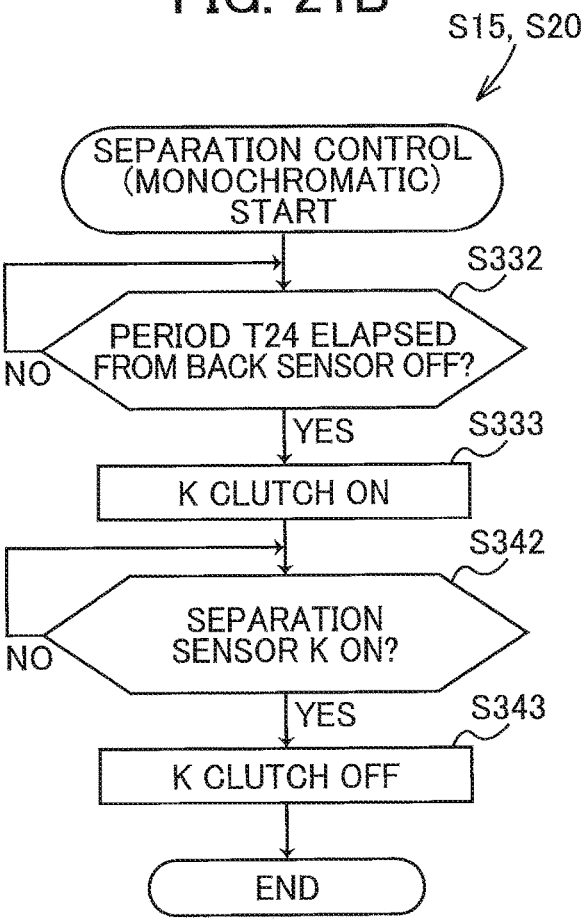
FIG. 21B is a flowchart for description of the separation control process for monochromatic printing in the image-forming apparatus according to the embodiment.
Figure 22:
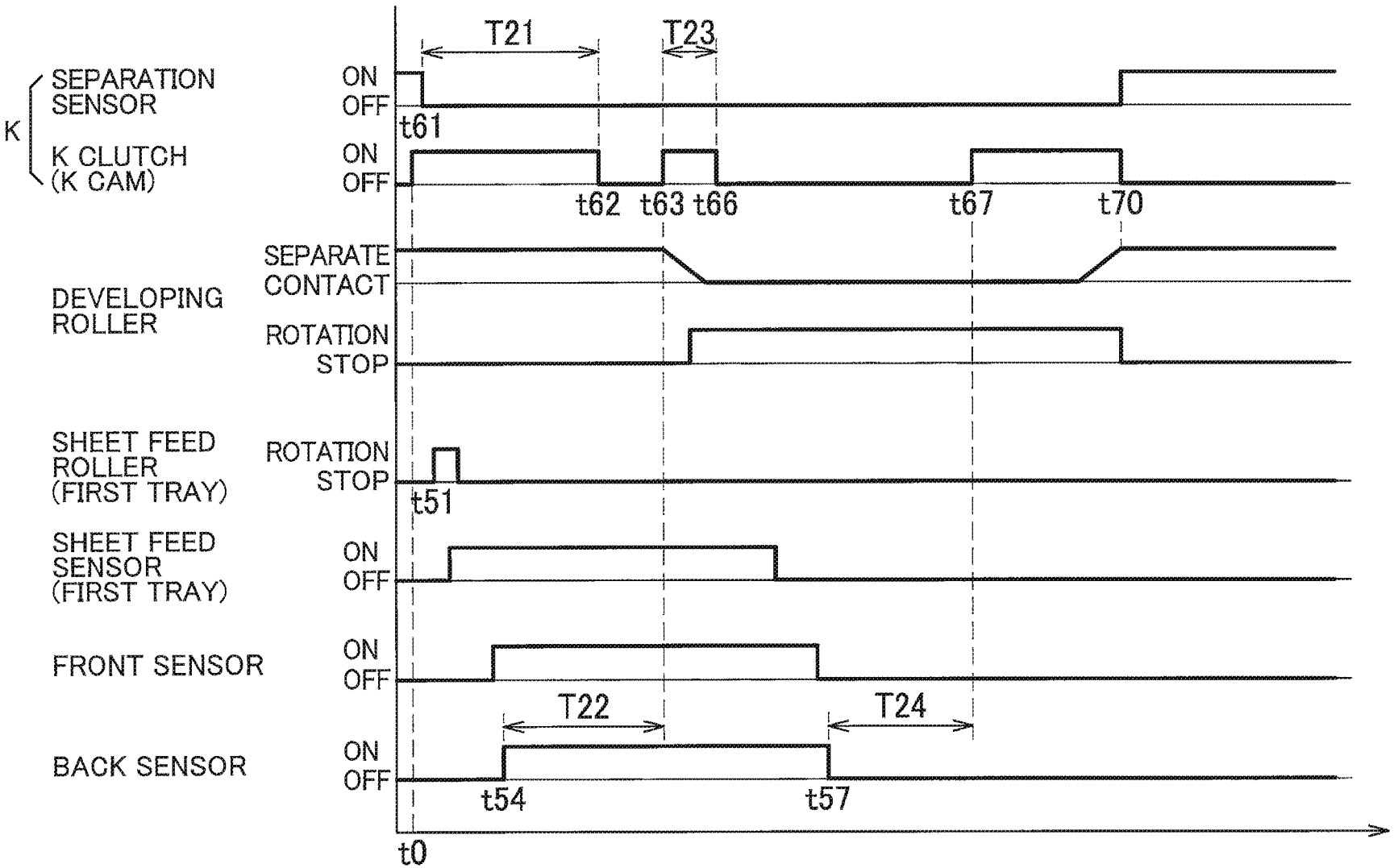
FIG. 22 is a timing chart for description of the control to the K clutch and the operation of the developing roller for the black color in response to output from each sensor for monochromatic printing in the image-forming apparatus according to the embodiment.

Next, monochromatic printing process for forming a monochromatic image on a single sheet S will be described with reference to a flowchart of FIG. 21 and a timing chart of FIG. 22.

For processing the monochromatic printing, all the developing rollers 61 are at their separated positions prior to an image forming operation. During the monochromatic printing process, the controller 2 does not permit the YMC clutch 140A to rotate, and maintains the first developing roller 61Y, the second developing roller 61M and the third developing roller 61C at the respective separated positions. On the other hand, the controller 2 starts the contact control process of FIG. 21A in order to bring the fourth developing roller 61K into the contact position.

First, the controller 2 permits the K clutch 140K to turn ON (S301, t0) to cause the cam 150K to rotate for moving the fourth developing roller 61K to the contact position. Immediately after the rotation of the cam 150K, the separation sensor 4K for the color of black is turned OFF (t61).

Then, the controller 2 determines in S310 whether the first time period T21 has elapsed from the timing (t61) at which the separation sensor 4K for the color of black outputs the OFF signal during a period from a timing of picking up of the sheet S from the first tray 21 and starting the conveyance of the sheet S until arrival of the sheet S at the fourth photosensitive drum 50K. In a case where the first time period T21 has elapsed (S310: Yes), the controller 2 permits the K clutch 140K to turn OFF (S311, t62) to stop rotation of the cam 150K at the temporary stop timing.

The first time period T21 is so set that, at the temporary stop timing, the contact portion 172 of the cam follower 170 for the color of black is positioned on a region of the second holding surface F2 of the cam 150K, the region being closest to the second guide surface F4 (see FIG. 15B). Hence, immediately after the restart of rotation of the cams 150K, the cam follower 170 for the color of black can move to the second guide surface F4 to allow the fourth developing roller 61K to start moving to the contact position. Incidentally, the first time period T21 in the monochromatic printing is different from the first time period T1 in the color printing.

Then, the controller 2 determines in S312 whether the second time period T22 has elapsed from the timing (t54) at which the back sensor 28C is turned ON. In a case where the second time period T22 has elapsed (S312: Yes), the controller 2 permits the K clutch 140K to turn ON (S313) to resume rotation of the cam 150K at the restart timing (t63). The second time period T22 is so set that the toner development on the fourth photosensitive drum 50K by the fourth developing roller 61K can be completed by the time when the toner image is transferred from the photosensitive drum 50K to the conveyed sheet S. Incidentally, the second time period T22 in the monochromatic printing is different from the second time period T2 in the color printing.

The controller 2 then determines in S324 whether the third time period T23 has elapsed from the turning ON timing (t63) of the K clutch 140K. In a case where the third time period T23 has elapsed (S324: Yes), the controller 2 permits the K clutch 140K to turn OFF (S325, t66) to stop rotation of the cam 150K to end the contact control process. The third time period T23 is set to such a period of time within which the fourth developing roller 61K is positioned at the contact position.

In the case of printing on a single sheet S, no subsequent page exists (S14: No in FIG. 16), and hence the routine proceeds to S15 to execute the separation control process. Specifically, as illustrated in FIG. 21B, the controller 2 determines in S332 whether the fourth time period T24 has elapsed from the turning OFF timing (t57) of the back sensor 28C. In a case where the fourth time period T24 has elapsed (S332: Yes), the controller 2 permits the K clutch 140K to turn ON (S333, t67) to start rotation of the cam 150K.

Next, the controller 2 determines in S342 whether the separation sensor 4K for the color of black outputs the ON signal. In a case where the ON signal is outputted (S342: Yes), the controller 2 permits the K clutch 140K to turn OFF (S343, t70) to stop rotation of the cam 150K to end the separation control process.

In this way, for printing on the single sheet S, the fourth developing roller 61K is moved from the separated position to the contact position, and is then moved from the contact position to the separated position after completion of the printing. Throughout the operation, the first developing roller 61Y, the second developing roller 61M, and the third developing roller 61C are respectively held at the separated positions. Hence, idle rotation of these developing rollers 16 can be prevented.

In the image-forming apparatus 1, as illustrated in FIGS. 23A through 25C, for performing color printing with the first developing roller 61Y, the second developing roller 61M, the third developing roller 61C, and the fourth developing roller 61K, these developing rollers 61 are configured to be moved to the respective contact positions to transfer a toner image to the sheet S, and moved to the separated positions after termination of the development of the toner image onto the corresponding photosensitive drums 50 in timed relation to the movement of the sheet S.

Figure 23A:
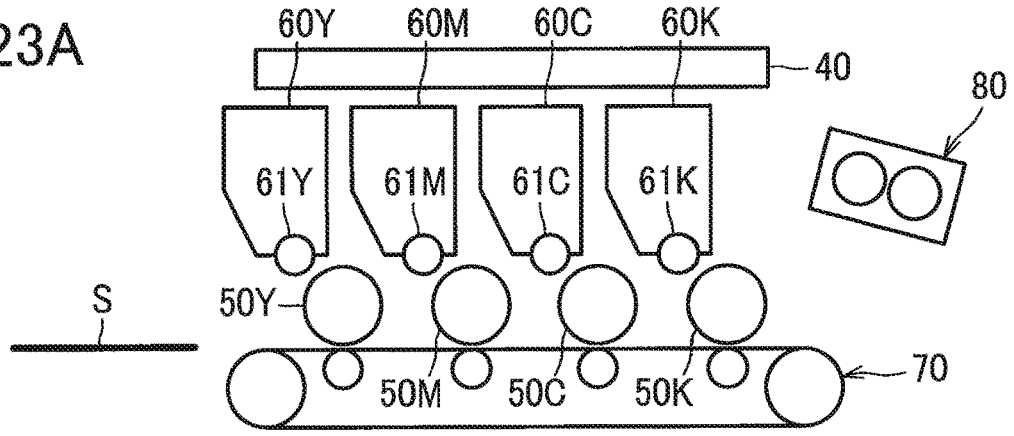
FIG. 23A is a view for description of separating/contacting operations of the developing rollers for color printing in the image-forming apparatus according to the embodiment, wherein a sheet is approaching the most upstream developing roller.

Specifically, as illustrated in FIG. 23A, the first developing roller 61Y, the second developing roller 61M, the third developing roller 61C, and the fourth developing roller 61K are set at the respective separated positions prior to arrival of the sheet S at the most upstream first photosensitive drum 50Y. In the state where all the developing rollers 61 are at the separated positions, the second developing cartridge 60M is overlapped with the path of the laser beam for exposing the first photosensitive drum 50Y; the third developing cartridge 60C is overlapped with the path of the laser beam for exposing the second photosensitive drum 50M; and the fourth developing cartridge 60K is overlapped with the path of the laser beam for exposing the third photosensitive drum 50C (see FIG. 1).

Figure 23B:
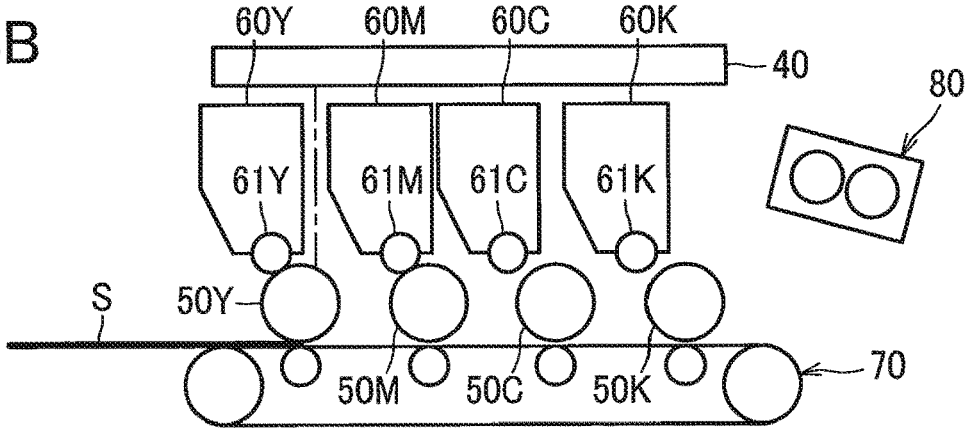
FIG. 23B is a view for description of the contacting/separating operations of the developing rollers for color printing in the image-forming apparatus according to the embodiment, wherein the sheet is about to reach the most upstream developing roller.

Then, as illustrated in FIG. 23B, when the sheet S is about to arrive at the first photosensitive drum 50Y, the first developing cartridge 60Y and the second developing cartridge 60M are simultaneously moved to move the corresponding developing rollers 61 (61Y and 61M) to the respective contact positions prior to start of the exposure of the first photosensitive drum 50Y. Hence, the second developing cartridge 60M does not become an obstacle against the path of the laser beam for exposing the first photosensitive drum 50Y, thereby enabling laser beam irradiation to the first photosensitive drum 50Y. Therefore, development of a toner image on the first photosensitive drum 50Y by the first developing roller 61Y can be performed, and the toner image can be transferred to the sheet S.

Figure 23C:
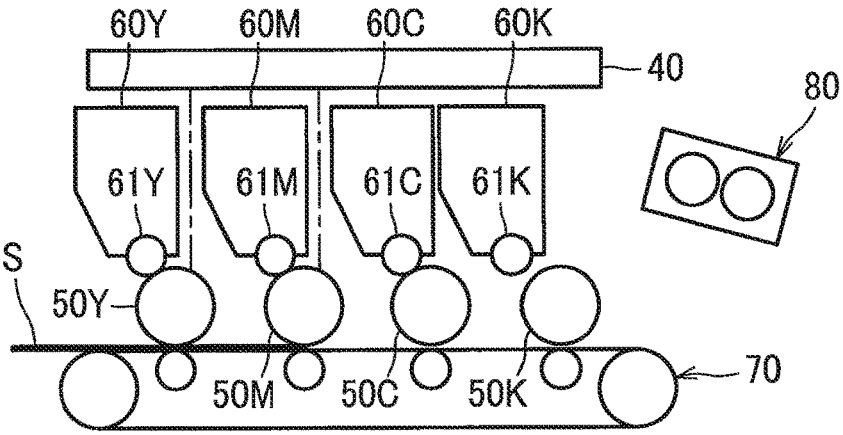
FIG. 23C is a view for description of the contacting/separating operations of the developing rollers for color printing in the image-forming apparatus according to the embodiment, wherein the sheet is about to reach a second developing roller immediately downstream of the most upstream developing roller.

Then, as illustrated in FIG. 23C, when the sheet S is about to arrive at the second photosensitive drum 50M, the third developing cartridge 60C is moved to move the developing roller 61C to the contact position prior to start of the exposure of the second photosensitive drum 50M to the laser beam. Hence, the third developing cartridge 60C does not become an obstacle against the path of the laser beam toward the second photosensitive drum 50M, thereby enabling laser beam irradiation to the second photosensitive drum 50M. Therefore, development of a toner image on the second photosensitive drum 50M by the second developing roller 61M can be performed, and the toner image can be transferred to the sheet S.

Figure 23D:
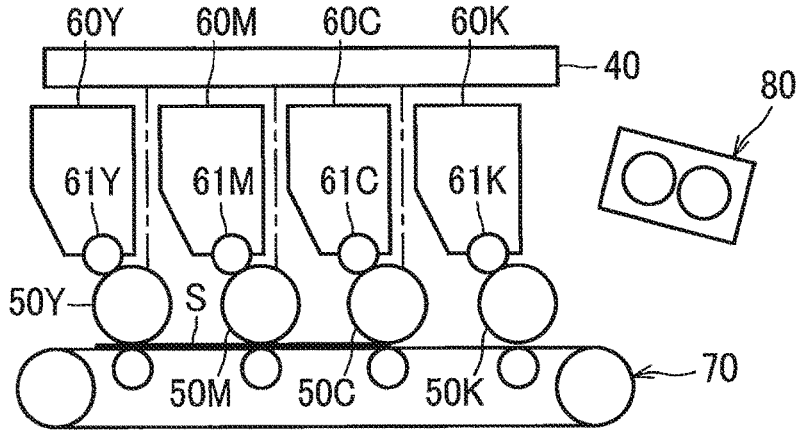
FIG. 23D is a view for description of the contacting/separating operations of the developing rollers for color printing in the image-forming apparatus according to the embodiment, wherein the sheet is about to reach a third developing roller immediately downstream of the second developing roller.

Then, as illustrated in FIG. 23D, when the sheet S is about to arrive at the third photosensitive drum 50C, the fourth developing cartridge 60K is moved to move the fourth developing roller 61K to the contact position prior to start of the exposure of the third photosensitive drum 50C to the laser beam. Hence, the fourth developing cartridge 60K does not become an obstacle against the path of the laser beam toward the third photosensitive drum 50C, thereby enabling laser beam irradiation to the third photosensitive drum 50C. Therefore, development of a toner image on the third photosensitive drum 50C by the third developing roller 61C can be performed, and the toner image can be transferred to the sheet S. Further, the development of a toner image on the fourth photosensitive drum 50K by the fourth developing roller 61K can be performed subsequently, since the fourth developing roller 61K is already at the contact position.

Figure 24A:
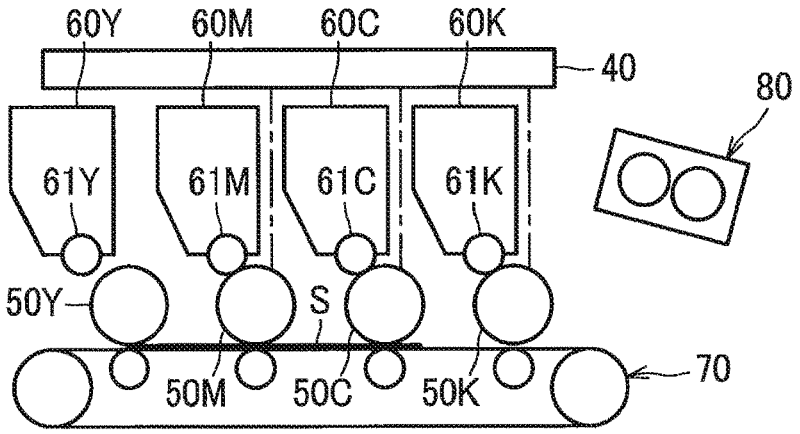
FIG. 24A is a view for description of the contacting/separating operations of the developing rollers for color printing in the image-forming apparatus according to the embodiment, and illustrating a state subsequent to the state of FIG. 23D.

Then, as illustrated in FIG. 24A, the first developing cartridge 60Y is moved for moving the first developing roller 61Y to the separated position, after termination of the development on the photosensitive drum 50Y by the first developing roller 61Y and prior to termination of the development on the photosensitive drum 50M by the second developing roller 61M.

Figure 24B:
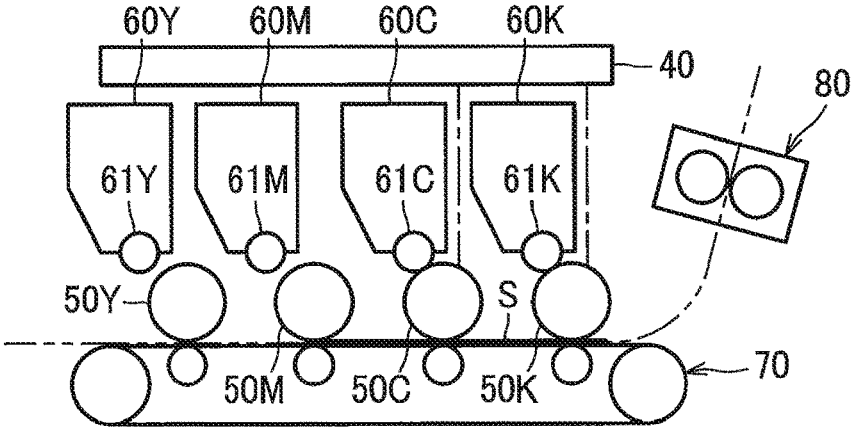
FIG. 24B is a view for description of the contacting/separating operations of the developing rollers for color printing in the image-forming apparatus according to the embodiment, and illustrating a state subsequent to the state of FIG. 24A.

Then, as illustrated in FIG. 24B, the second developing cartridge 60M is moved for moving the second developing roller 61M to the separated position, after the termination of the development on the photosensitive drum 50M by the second developing roller 61M and prior to termination of the development on the photosensitive drum 50C by the third developing roller 61C.

Figure 24C:
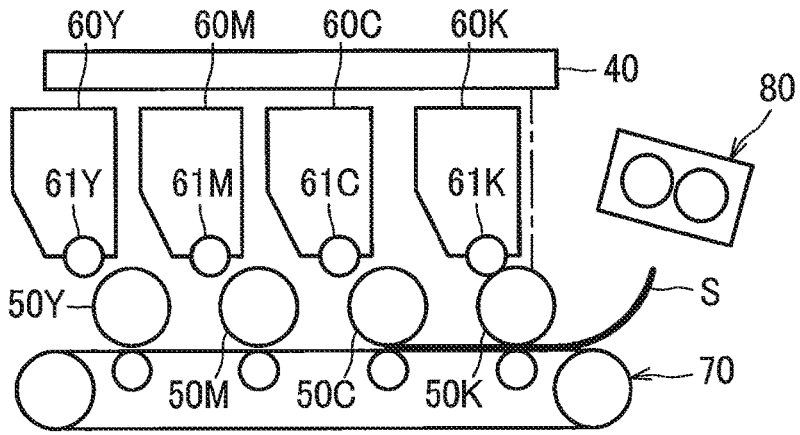
FIG. 24C is a view for description of the contacting/separating operations of the developing rollers for color printing in the image-forming apparatus according to the embodiment, and illustrating a state subsequent to the state of FIG. 24B.

Then, as illustrated in FIG. 24C, the third developing cartridge 60C is moved for moving the third developing roller 61C to the separated position, after termination of the development on the photosensitive drum 50C by the third developing roller 61C and prior to termination of the development on the photosensitive drum 50K by the fourth developing roller 61K.

Figure 24D:
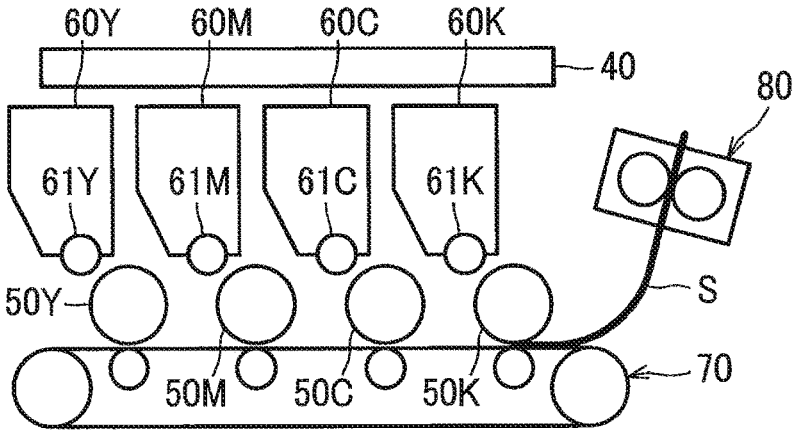
FIG. 24D is a view for description of the contacting/separating operations of the developing rollers for performing color printing in the image-forming apparatus according to the embodiment, and illustrating a state subsequent to the state of FIG. 24C.

Then, as illustrated in FIG. 24D, the fourth developing cartridge 60K is moved for moving the fourth developing roller 61K to the separated position, after termination of the development on the photosensitive drum 50K by the fourth developing roller 61K.

Figure 25A:
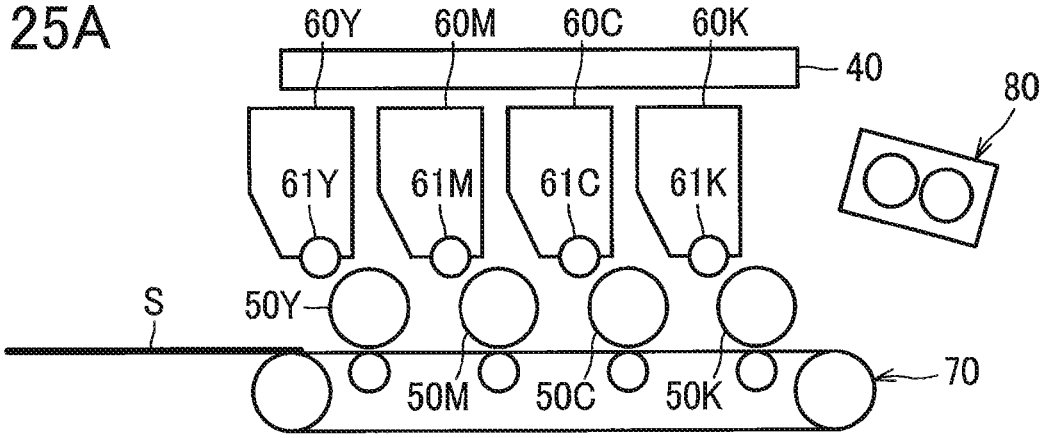
FIG. 25A is a view for description of the contacting/separating operations of the developing rollers for monochromatic printing in the image-forming apparatus according to the embodiment, wherein the sheet is approaching to the first developing roller.
Figure 25B:
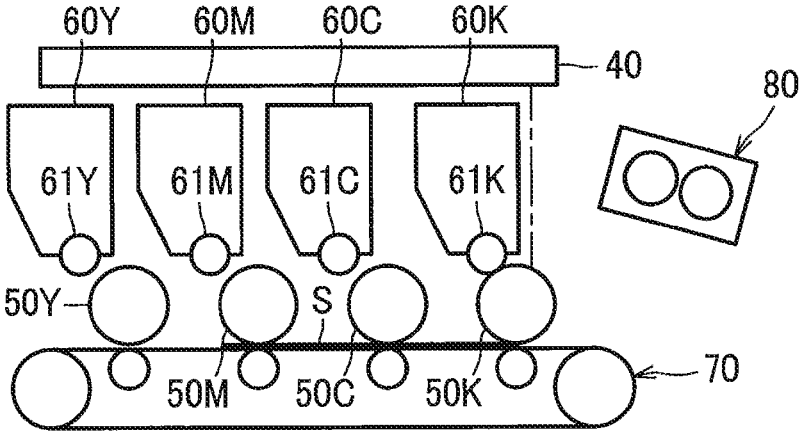
FIG. 25B is a view for description of the contacting/separating operations of the developing rollers for monochromatic printing in the image-forming apparatus according to the embodiment, wherein the sheet is about to reach a fourth developing roller.
Figure 25C:
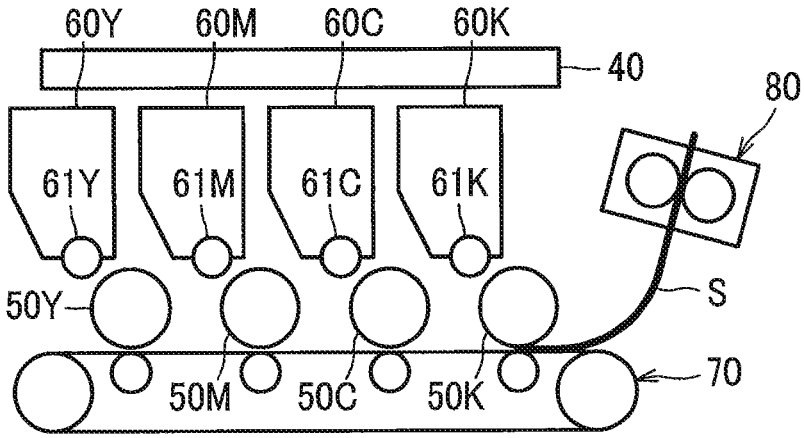
FIG. 25C is a view for description of the contacting/separating operations of the developing rollers for monochromatic printing in the image-forming apparatus according to the embodiment, wherein the sheet moves past the fourth developing roller.

On the other hand, for performing monochromatic printing employing only the fourth developing roller 61K in the image-forming apparatus 1, as illustrated in FIG. 25A through FIG. 25C, the first developing roller 61Y, the second developing roller 61M and the third developing roller 61C for the colors of yellow, magenta and cyan other than black are maintained at the respective separated positions during transfer of a toner image to the sheet S. The fourth developing roller 61K for the color of black is moved to the contact position, and then moved to the separated position after termination of the development of the toner image on the fourth photosensitive drum 50K by the fourth developing roller 61K in timed relation to the movement of the sheet S.

Specifically, as illustrated in FIG. 25A, the developing rollers 61 (61Y, 61M, 61C, and 61K) are all at the separated positions when the sheet S approaches the first photosensitive drum 50Y. Then, as illustrated in FIG. 25B, the fourth developing cartridge 60K is moved for moving the fourth developing roller 61K to the contact position prior to start of the exposure of the fourth photosensitive drum 50K to the laser beam. Then, as illustrated in FIG. 25C, the fourth developing cartridge 60K is moved for moving the fourth developing roller 61K to the separated position after termination of the development on the fourth photosensitive drum 50K by the fourth developing roller 61K.

Next, a process for successively printing color images on a plurality of sheets S will be described with reference to flowcharts illustrated in FIGS. 16 and 17 and timing charts illustrated in FIGS. 26 through 28.

Firstly, a case for printing on the second sheet S (subsequent sheet) to be supplied from the first tray 21 will be described with reference to the timing chart illustrated in FIG. 26.

In order to perform color printing consecutively on the plurality of sheets S, once the controller 2 determines (S13:Yes in FIG. 16) that the fourth time period T4 (predetermined time period) has elapsed from the timing (t57) at which the back sensor 28C outputs the OFF signal indicative of the trailing edge of the first sheet S (preceding sheet) moving past the back sensor 28C, since the second sheet S (subsequent sheet) exists (S14: Yes), the controller 2 then determines in S16 whether the second sheet S has already been picked-up and in the middle of conveyance thereof.

In a case where the second sheet S has not been picked-up and, therefore, has not been conveyed (S16: No), the controller 2 sets the standby time periods TwL, TwM, TwS (in S17) and starts the counting-down, and executes the separation control process (S20, t37) as illustrated in FIG. 18B by turning ON the YMC clutch 140A to start rotation of the cams 150Y, 150M, 150C after termination of development of the image to be transferred to the first sheet S. Incidentally, the standby time period Tw set in the step S17 may be equal to or different from the standby time period Tw set in the step S11 for the preceding first sheet S.

Further, the controller 2 suspends supply of the second sheet S from the first tray 21 until the first standby time period TwM has elapsed, irrespective of the fact that preparation of data of the image to be transferred to the second sheet S is completed (S31: Yes in FIG. 17) upon elapse of the fourth time period T4 from the OFF timing of the back sensor 28C (t37). In a case where the first standby time period TwM is down-counted to zero (S34: Yes), the controller 2 drives the sheet feed roller 23 to pick-up the second sheet S from the first tray 21 to start conveyance of the second sheet S (S35, t71).

In the meantime, after moving the developing rollers 61Y, 61M and 61C away from the corresponding photosensitive drums 50Y, 50M and 50C successively, the controller 2 executes the contact control process (S12 in FIG. 16) for contacting the developing rollers 61Y, 61M, 61C with the corresponding photosensitive drums 50Y, 50M, 50C. Specifically, the controller 2 permits the cams 150Y, 150M and 150C to continue rotating after the timing (t40) when the separation sensor 4C for the color of cyan outputs the ON signal, and permits the YCM clutch 140A to turn OFF (t38) to temporarily stop rotation of the cams 150Y, 150M and 150C upon elapse of the first time period T1 from the timing (t41) at which the separation sensor 4C for the color of cyan outputs the OFF signal.

Then, the controller 2 permits the YMC clutch 140A to turn ON (t39) to restart rotation of the cams 150Y, 150M, 150C upon elapse of the second time period T2 from the timing (t73) at which the leading edge of the second sheet S conveyed from the first tray 21 moves past the front sensor 28B, to successively move the developing rollers 61 to contact the corresponding photosensitive drums 50 to thus develop the images to be transferred to the second sheet S. Then, the controller 2 performs the steps subsequent to the step S13 illustrated in FIG. 16.

In this way, according to the present embodiment, for performing the separation control process and the contact control process, the first through third developing rollers 61Y, 61M and 61C are operable in discrete fashion against the operation of the fourth developing roller 61K. Therefore, the cams 150Y, 150M and 150C continue to rotate even after the timing t40 at which the separation sensor 4C for the color of cyan outputs the ON signal, so that the developing rollers 61Y, 61M and 61C can start the contact control process without waiting for a halt of the rotation of the cam 150K. Incidentally, the YMC clutch 140A may be turned ON to rotate the cams 150Y, 150M and 150C, immediately after temporarily stopping the rotations of the cams 150Y, 150M and 150C by turning OFF the YMC clutch 140A in response to output of the ON signal from the separation sensor 4C for the color of cyan at the timing t40.

Regarding the first tray 21, conveyance of the second sheet S is started at the timing t71 upon elapse of the first standby time period TwM from the timing (t37) which is upon elapse of the fourth time period T4 from the OFF timing (t57) of the back sensor 28C. With this configuration, the timing t75 at which the leading end of the image-forming region of the second sheet S arrives at the transfer position (i.e., upon elapse of the second arrival time period TA2 from the timing t71) can be coincident with the timing at which the developing roller 61Y, which has started separating from the photosensitive drum 50Y at the timing t37 and again come into contact the first photosensitive drum 50Y, arrives at the transfer position on the photosensitive drum 50Y for staring development on the first photosensitive drum 50Y (t75, i.e., upon elapse of the first arrival time period TA1 from the timing t37).

Next, a case for printing on the second sheet S (subsequent sheet) supplied from the manual insertion tray 41 will be described with reference to the timing chart illustrated in FIG. 27.

The controller 2 suspends supply of the second sheet S from the manual insertion tray 41 until the second standby time period TwL has elapsed, irrespective of the fact that preparation of data of the image to be transferred to the second sheet S is completed by the time (t37) when the fourth time period T4 is elapsed from the OFF timing of the back sensor 28C, the OFF signal being outputted at the timing when the trailing edge of the first sheet S moves past the back sensor 28C. In a case where the second standby time period TwL is down-counted to zero, the controller 2 drives the sheet feed roller 43 to pick-up the second sheet S from the manual insertion tray 41 to start conveyance of the second sheet S (t81).

Then, the controller 2 permits the YMC clutch 140A to turn ON at a timing (t39) to rotate the cams 150Y, 150M and 150C upon elapse of the second time period T2 from the turning ON timing (t81) at which the leading edge of the second sheet S supplied from the manual insertion tray 41 moves past the front sensor 48B. Rotations of the cams 150Y, 150M and 150C successively bring the developing rollers 61 into contact with the corresponding photosensitive drums 50 for development of the image to be transferred to the second sheet S.

Regarding the manual insertion tray 41, conveyance of the second sheet S is started at the timing t81 upon elapse of the second standby time period TwL from the timing (t37) which is upon elapse of the fourth time period T4 from the OFF timing (t57) of the back sensor 28C. With this configuration, the timing at which the leading end of the image-forming region of the second sheet S arrives at the transfer position (t75, i.e., elapse of the second arrival time period TA4 from the timing t81) can be coincident with the timing at which the developing roller 61Y, which has started separating from the photosensitive drum 50Y at the timing t37 and again come into contact the first photosensitive drum 50Y, arrives at the transfer position on the photosensitive drum 50Y for staring development on the first photosensitive drum 50Y (t75, i.e., upon elapse of the first arrival time period TA1 from the timing t37).

Since the path length from the manual insertion tray 41 to the first photosensitive drum 50Y is shorter than the path length from the first tray 21 to the first photosensitive drum 50Y, the second arrival time period TA4 with respect to the manual insertion tray 41 (FIG. 27) is shorter than the second arrival time period TA2 with respect to the first tray 21 (FIG. 26). Therefore, the second standby time period TwL is set longer than the first standby time period TwM.

Next, a case for printing on the second sheet S (subsequent sheet) to be supplied from the second tray 31 will be described with reference to the timing chart illustrated in FIG. 28.

The controller 2 suspends supply of the second sheet S from the second tray 31 until the third standby time period TwS has elapsed, irrespective of the fact that preparation of data of the image to be transferred to the second sheet S is completed by the time (t37) when the fourth time period T4 has elapsed from the OFF timing of the back sensor 28C, the OFF signal being outputted at a timing at which the trailing edge of the first sheet S moves past the back sensor 28C. In a case where the third standby time period TwS is down-counted to zero, the controller 2 drives the sheet feed roller 33 to pick-up the second sheet S from the second tray 31 to start conveyance of the second sheet S (t91).

Then, the controller 2 permits the YMC clutch 140A to turn ON at a timing (t39) to rotate the cams 150Y, 150M and 150C upon elapse of the second time period T2 from the turning ON timing (t93) at which the leading edge of the second sheet S supplied from the second tray 31 moves past the front sensor 28B. Rotations of the cams 150Y, 150M and 150C successively bring the developing rollers 61 into contact with the corresponding photosensitive drums 50 for development of the image to be transferred to the second sheet S.

Regarding the second tray 31, conveyance of the second sheet S is started at a timing t91 upon elapse of the third standby time period TwS from the timing (t37) which is upon elapse of the fourth time period T4 from the OFF timing (t57) of the back sensor 28C. With this configuration, the timing at which the leading end of the image-forming region of the second sheet S arrives at the transfer position (t75, i.e., upon elapse of the second arrival time period TA3 from the timing t91) can be coincident with the timing at which the developing roller 61Y, which has started separating from the photosensitive drum 50Y at the timing t37 and again come into contact the first photosensitive drum 50Y, arrives at the transfer position on the photosensitive drum 50Y for staring development on the first photosensitive drum 50Y (t75, i.e., upon elapse of the first arrival time period TA1 from the timing t37).

Since the path length from the second tray 31 to the first photosensitive drum 50Y is longer than the path length from the first tray 21 to the first photosensitive drum 50Y, the second arrival time period TA3 with respect to the second tray 31 (FIG. 28) is longer than the second arrival time period TA2 with respect to the first tray 21 (FIG. 26). Therefore, the third standby time period TwS is set shorter than the first standby time period TwM.

<Operational and Technical Advantages>

The image-forming apparatus 1 of the present embodiment constructed as above exhibits advantageous functions and effects as described below.

In the image-forming apparatus 1, in the case where conveyance of the second sheet S is not started upon elapse of the predetermined time period (fourth time period T4 or T24) from the turning OFF timing of the back sensor 28C, the OFF timing being at the timing at which the trailing edge of the first sheet S moves past the back sensor 28C, the developing rollers 61 are moved to be separated from the photosensitive drums 50 after termination of development of the image to be transferred to the first sheet S, and then, the developing rollers 61 are moved to contact the photosensitive drums 50 again for development of the image to be transferred to the second sheet S. Hence, the period of contact between the developing roller 61 and the photosensitive drum 50 can be reduced as much as possible.

Further, supply of the second sheet S from one of the trays 21, 31 and 41 is configured to be started upon elapse of the standby time period Tw (first standby time period TwM, second standby time period TwL, and third standby time period TwS) which is obtained by subtracting the second arrival time period TA2, TA3 or TA4 from the first arrival time period TA1. Therefore, the leading end of the image-forming region of the second sheet S can arrive at the transfer position at a timing coincident with the timing at which the leading end position of the toner image on each photosensitive drum 50Y arrives at the transfer position.

As a supplementary explanation, assume that a length of a sheet conveying path from a sheet tray to the most upstream photosensitive drum 50Y is excessively short. In such a case, if the cam 150 starts rotating at the same time as the start of the supply of the second sheet S from the sheet tray, the leading end of the image-forming region of the second sheet S may already move past the transfer position at a timing when the leading end of the developed toner image on the surface of the photosensitive drum SOY arrives at the transfer position. Therefore, it is likely that the contact of the developing roller 61Y with the photosensitive drum SOY cannot be realized by the time when the leading end of the image-forming region of the second sheet S arrives at the transfer position.

To this effect, according to the above-described embodiment, the standby time period Tw obtained by subtracting the second arrival time period TA2, TA3 or TA4 from the first arrival time period TA1 is set. Hence, the developing rollers 61 can be timely brought into contact with the corresponding photosensitive drums 50 by the time when the leading end of the image-forming region of the second sheet S arrives at the respective transfer positions even if the path length from the sheet tray to the photosensitive drum SOY is relatively short. Consequently, the developing rollers 61 can be brought into contact with the photosensitive drums 50 in time by the time when the leading end of the image-forming region of the second sheet S arrives at the respective transfer positions, irrespective of the path length from the sheet tray to the photosensitive drum SOY.

Further, the standby time period Tw is set longer as the path length up to the photosensitive drum SOY is shorter. Therefore, the second sheet S can be supplied toward the photosensitive drum SOY at an optimum timing in accordance with the position of each sheet tray.

Further, in a case where the sheet interval between the first sheet S and the second sheet S is greater than the predetermined sheet interval, the developing rollers 61 are configured to be separated from the photosensitive drums 50 after development of the image to be transferred to the first sheet S is completed, and thereafter, the developing rollers 61 are moved to the respective contact positions in accordance with the conveyance of the second sheet S. Hence, the contact between the developing rollers 61 and the corresponding photosensitive drums 50 can be avoided as much as possible.

Further, the power transmission mechanism 100 is configured to transmit the driving force to the developing rollers 61 while the developing rollers 61 are at the contact position, and not to transmit the driving force to the developing rollers 61 while the developing rollers 61 are at the separated position. Therefore, the contact of the developing rollers 61 with the photosensitive drums 50 can be restrained as much as possible, and hence, needless rotations of the developing rollers 61 can be prevented. Consequently, degradation of toner can be restrained.

Various modifications are conceivable.

For example, according to the above-described embodiment, the sheet interval is calculated on a basis of signals transmitted from the sheet feed sensor 28A, or 38A, the front sensor 28B or 48B, and the back sensor 28C. Instead, the sheet interval may be determined on a basis of information as to: which tray the sheet S comes from; and how much time has elapsed after picking up of the second sheet S.

Further, according to the above described embodiment, the image-forming apparatus 1 includes three sheet trays, i.e., the first tray 21, the manual insertion tray 41, and the second tray 31 positioned below the first tray 21. However, the second tray may be omitted. That is, an image-forming apparatus of the disclosure may include the first tray 21 and the manual insertion tray 41 without the second tray 31. Alternatively, the image-forming apparatus of the disclosure may include a single sheet tray. Still alternatively, a third tray having the same structure as the second tray 31 may be additionally provided below the second tray 31. In other words, the image-forming apparatus of the disclosure may include at least four sheet trays. In a case where the third tray is provided, the standby time period Tw for the third tray may be "0", provided that the third tray is positioned below the second tray 31, so that a path length from the third tray to a most upstream photosensitive drum in the sheet conveying direction is greater than the path length from the second tray to the most upstream photosensitive drum.

Further, according to the above-described embodiment, the third standby time period TwS for the second tray 31 is greater than "0" (See FIG. 28). However, the third standby time period TwS may be "0", depending on the path length from the second tray 31 to the photosensitive drum 50Y.

Further, according to the above-described embodiment, the back sensor 28C functions as the sheet sensor. However, the front sensor 28B or the sheet feed sensor 28A may be used as the sheet sensor of the disclosure.

Further, the image-forming apparatus 1 according to the above-described embodiment is a color printer using toners of the four colors. However, the image-forming apparatus of the disclosure may be a color printer employing toners of three colors or five colors for forming color images. As a further modification, the image-forming apparatus may be a monochromatic printer including a single photosensitive drum, a single developing roller, and a single cam and using a toner of single color.

Still alternatively, a multifunction device and a copying machine are also available as the image-forming apparatus of the disclosure.

While the description has been made in detail with reference to the embodiments, it would be apparent to those skilled in the art that many modifications and variations may be made thereto.

<Remarks>

The photosensitive drums 50 are an example of a photosensitive drum. The developing rollers 61 are an example of a developing roller. The cams 150 are an example of a cam. The YMC clutches 140A, 140K are an example of a switching mechanism. The first tray 21, the second tray 31 and the manual insertion tray 41 are examples of at least one sheet tray. The sheet feed mechanism 22 is an example of a sheet feed mechanism. The back sensor 28C is an example of a sheet sensor. The controller 2 is an example of a controller. The first standby time period TwM, the second standby time period TwL, the third standby time period TwS are examples of a predetermined standby time period. The fourth time periods T4 and T24 are examples of a prescribed period of time. The motor 3 is an example of a motor. The power transmission mechanism 100 is an example of a transmission mechanism. The developing cartridges 60 are an example of a developing cartridge. The cam followers 170 are an example of a cam follower. The support member 90 is an example of a support member. The slide members 64 are an example of a slide member. The registration rollers 27 are an example of a registration roller.

What is claimed is:

1. An image-forming apparatus comprising:

a photosensitive drum;

a developing roller movable between a contact position in contact with the photosensitive drum and a separated position away from the photosensitive drum;

a cam rotatable to move the developing roller between the contact position and the separated position;

a switching mechanism configured to control the rotation of the cam;

at least one sheet tray configured to accommodate a plurality of sheets including a first sheet and a second sheet;

a sheet feed mechanism configured to feed each of the sheets from the at least one sheet tray toward the photosensitive drum in a sheet conveying direction;

a sheet sensor positioned upstream of the photosensitive drum in the sheet conveying direction and configured to detect passage of each sheet therethrough; and a controller configured to provide control to the switching mechanism and the sheet feed mechanism, wherein:

in a case where feeding of the second sheet is not started upon elapse of a prescribed period of time from a timing when the sheet sensor detects a trailing edge of the first sheet, the controller is configured to control the switching mechanism to rotate the cam to move the developing roller from the contact position to the separated position after development of a first image to be transferred to the first sheet is completed; and in a case where data of a second image to be transferred to the second sheet is ready and a predetermined standby time period has elapsed from elapse of the prescribed period of time, the controller is configured to control the sheet feed mechanism to start feeding the second sheet toward the photosensitive drum and subsequently control the switching mechanism to rotate the cam to move the developing roller from the separated position to the contact position in accordance with conveyance of the second sheet for development of the second image on the photosensitive drum.

2. The image-forming apparatus according to claim 1, wherein the predetermined standby time period is equal to or greater than a time period obtained by subtracting a time period from start of feeding of the second sheet from the at least one tray until a time when a leading end of an image-forming region on the second sheet in the sheet conveying direction arrives at a transfer position where the second image developed on the photosensitive drum is to be transferred to the second sheet from a time period from a time when the developing roller is started to be separated from the photosensitive drum until a time when the developing roller again comes into contact with the photosensitive drum for development of the second image on the photosensitive drum and a leading end of the developed second image on the photosensitive drum arrives at the transfer position.

3. The image-forming apparatus according to claim 1, wherein the at least one sheet tray comprises a plurality of sheet trays each defining a sheet conveying path up to the photosensitive drum in the sheet conveying direction, the sheet conveying paths having lengths different from one another, and wherein the controller is configured to set the predetermined standby time period longer as the path length of the sheet conveying path is shorter.

4. The image-forming apparatus according to claim 1, wherein, in a case where feeding of the second sheet is started upon elapse of the prescribed period of time from the detection of the trailing end of the first sheet by the sheet sensor, and in a case where a sheet interval between the first sheet and the second sheet is determined to be greater than a predetermined sheet interval, the controller is configured to control the switching mechanism to rotate the cam to move the developing roller from the contact position to the separated position, and subsequently control the switching mechanism to rotate the cam to move the developing roller from the separated position to the contact position in accordance with the conveyance of the second sheet.

5. The image-forming apparatus according to claim 4, wherein, in the case where the feeding of the second sheet is started upon elapse of the prescribed period of time from the detection of the trailing end of the first sheet by the sheet sensor, and in a case where the sheet interval between the first sheet and the second sheet is determined to be equal to or smaller than the predetermined sheet interval, the controller is configured to control the switching mechanism not to rotate the cam to maintain the developing roller at the contact position for development of the second image to be transferred to the second sheet.

6. The image-forming apparatus according to claim 1, further comprising:

a motor configured to generate a driving force; and a transmission mechanism mechanically connected to the cam and configured to transmit the driving force of the motor to the developing roller through the cam, wherein the transmission mechanism is configured to transmit the driving force from the motor to the developing roller while the developing roller is at the contact position, and wherein the transmission mechanism is configured not to transmit the driving force from the motor to the developing roller while the developing roller is at the separated position.

7. The image-forming apparatus according to claim 1, further comprising:

a developing cartridge comprising the developing roller, the developing roller being rotatable about an axis extending in an axial direction; and a cam follower movable in the axial direction, wherein the cam is rotatable about an axis extending in parallel to the axial direction, the cam having a first cam portion protruding in the axial direction toward the developing cartridge, the first cam portion being configured to contact the cam follower to move the cam follower in the axial direction to press the developing cartridge.

8. The image-forming apparatus according to claim 7, further comprising a support member configured to support the developing cartridge, wherein the developing cartridge comprises a slide member having a sloped surface sloping relative to the axial direction, the slide member being configured to be pressed by the cam follower to move in the axial direction in a state where the developing cartridge is supported by the support member, and wherein, in response to pressing by the cam follower in the axial direction, the sloped surface is configured to contact the support member to urge the developing cartridge in a direction perpendicular to the axial direction.

9. The image-forming apparatus according to claim 8, wherein the sheet feed mechanism comprises a plurality of conveyor rollers positioned upstream of the photosensitive drum in the sheet conveying direction, the conveyor rollers including a registration roller positioned closest to the photosensitive drum in the sheet conveying direction among the plurality of conveyor rollers, and wherein the sheet sensor is positioned between the registration roller and the photosensitive drum in the sheet conveying direction and is configured to detect that each of the sheets moves past the registration roller.

10. An image-forming apparatus comprising:

a photosensitive drum;

a developing roller movable between:

a contact position where the developing roller is in contact with the photosensitive drum; and a separated position where the developing roller is separated from the photosensitive drum;

a rotatable cam configured to move the developing roller between the contact position and the separated position;

a sheet tray configured to accommodate a first sheet and a second sheet;

a sheet feed mechanism configured to feed each of the first sheet and the second sheet from the sheet tray to the photosensitive drum along a sheet feeding path; and a controller configured to control the rotatable cam and the sheet feed mechanism, wherein:

in a case where feeding of the second sheet is not started upon elapse of a prescribed period of time from a timing when the sheet sensor detects a trailing edge of the first sheet, the controller is configured to rotate the rotatable cam to move the developing roller from the contact position to the separated position after development of a first image to be transferred to the first sheet is completed; and in a case where data of a second image to be transferred to the second sheet is ready and a predetermined standby time period has elapsed from elapse of the prescribed period of time, the controller is configured to control the sheet feed mechanism to start feeding the second sheet toward the photosensitive drum and subsequently rotate the rotatable cam to move the developing roller from the separated position to the contact position in accordance with conveyance of the second sheet for development of the second image on the photosensitive drum.

* * * * *